US011872433B2

(12) United States Patent
Whalen et al.

(10) Patent No.: US 11,872,433 B2
(45) Date of Patent: Jan. 16, 2024

(54) UNWEIGHTING ENCLOSURE, SYSTEM AND METHOD FOR AN EXERCISE DEVICE

(71) Applicant: Boost Treadmills, LLC, Palo Alto, CA (US)

(72) Inventors: Sean Tremaine Whalen, Mountain View, CA (US); Thomas Jack Waldo Allen, Palo Alto, CA (US); Robert Tremaine Whalen, Los Altos, CA (US); Gunnar Manglus, Unikula (EE); Kristjan Tiimus, Tabasalu (EE)

(73) Assignee: Boost Treadmills, LLC, Palo Alto, CA (US)

( * ) Notice: Subject to any disclaimer, the term of this patent is extended or adjusted under 35 U.S.C. 154(b) by 0 days.

(21) Appl. No.: 17/540,225

(22) Filed: Dec. 1, 2021

(65) Prior Publication Data

US 2022/0288439 A1 Sep. 15, 2022

Related U.S. Application Data

(60) Provisional application No. 63/255,001, filed on Oct. 12, 2021, provisional application No. 63/254,969, (Continued)

(51) Int. Cl.

| | |
|---|---|
| ***A63B 21/008*** | (2006.01) |
| ***A63B 22/02*** | (2006.01) |
| ***A63B 21/00*** | (2006.01) |

(52) U.S. Cl.

CPC .... *A63B 21/0088* (2013.01); *A63B 21/00181* (2013.01); *A63B 21/4009* (2015.10); (Continued)

(58) Field of Classification Search

CPC ..... A63B 21/00181; A63B 22/02; A63B 2208/053; A63B 2225/093; A63B 2225/62

See application file for complete search history.

(56) References Cited

U.S. PATENT DOCUMENTS

| | | | |
|---|---|---|---|
| 44,198 | A | 9/1864 | Jones |
| 54,530 | A | 5/1866 | Hadfield |

(Continued)

FOREIGN PATENT DOCUMENTS

| | | | |
|---|---|---|---|
| CA | 2236774 | C | 11/1999 |
| CN | 2034152 | U | 3/1989 |

(Continued)

OTHER PUBLICATIONS

Lei Zu et al., "Design of filament-wound isotensoid pressure vessels with unequal polar openings," Composite Structures, Elsevier, Jul. 16, 2009, Delft Univ. of Technology, Kluyverweg I, The Netherlands.

(Continued)

*Primary Examiner* — Joshua Lee

(74) *Attorney, Agent, or Firm* — KandareIP, LLC; Anthony Kandare

(57) ABSTRACT

An inflatable unweighting enclosure for an exercise device is provided formed from a pair of opposing sheets attached to each other by a seam along a closed shape at their perimeter portions, each of which has a top region, an opposite base region, and central region. A trim path interrupts each articulated shape at the base region that defines a perimeter of a base opening for the enclosure when inflated, in which the base and base opening are substantially planar and the base perimeter defines an enclosure inlet. When inflated, the pair of flexible sheets expand laterally apart to define an enclosure inner space and form an elongate, disc-shaped structure interrupted by the base opening. The base opening attaches to a base support of the exercise device, which is shaped and sized to orient and support the enclosure vertically for providing unweighting to a user attached to a top opening.

14 Claims, 54 Drawing Sheets

Related U.S. Application Data filed on Oct. 12, 2021, provisional application No. 63/254,972, filed on Oct. 12, 2021, provisional application No. 63/157,697, filed on Mar. 6, 2021, provisional application No. 63/119,659, filed on Dec. 1, 2020.

(52) U.S. Cl.
CPC ..... *A63B 22/02* (2013.01); *A63B 2208/053* (2013.01); *A63B 2225/093* (2013.01)

(56) References Cited

U.S. PATENT DOCUMENTS 60,883 A 12/1866 Hadfield
72,631 A 12/1867 Hadfield
100,867 A 3/1870 Curran
871,074 A 11/1907 Stockton
1,152,014 A 8/1915 Farkell
1,182,018 A 5/1916 Koenig
1,336,774 A 4/1920 Cooper
1,504,166 A 8/1924 Thornley
2,134,879 A 11/1938 Levy
2,262,019 A 11/1941 Lincoln
2,785,004 A 3/1957 Leon
2,910,994 A 11/1959 Joy
3,121,451 A 2/1964 Schuerch
3,165,314 A 1/1965 Clearman
3,176,793 A 4/1965 Hlacia
3,192,014 A 6/1965 Leyshon
3,254,457 A 6/1966 Gedney
3,332,176 A 7/1967 Knetzer
3,335,529 A 8/1967 Gedney
3,353,309 A 11/1967 Kwake
3,428,015 A 2/1969 Cloud
3,654,050 A 4/1972 Fraser
3,744,191 A 7/1973 Bird
3,768,467 A 10/1973 Jennings
3,911,913 A 10/1975 June
4,068,739 A 1/1978 Gordon et al.
4,149,712 A 4/1979 Murphy
4,257,407 A 3/1981 Macchi
4,303,728 A 12/1981 Houdek et al.
4,343,302 A 8/1982 Dillon
4,411,422 A 10/1983 Solloway
4,509,513 A 4/1985 Lasley
4,536,163 A 8/1985 Schnirch et al.
4,576,376 A 3/1986 Miller
4,614,337 A 9/1986 Schonenberger
4,621,621 A 11/1986 Marsalis
4,712,788 A 12/1987 Gaudreau, Jr.
4,731,882 A 3/1988 Ekman
4,776,581 A 10/1988 Shepherdson
4,805,601 A 2/1989 Eischen, Sr.
4,887,317 A 12/1989 Phillips, Sr. et al.
4,934,694 A 6/1990 McIntosh
4,959,047 A 9/1990 Tripp, Jr.
4,974,829 A 12/1990 Gamow et al.
5,029,579 A 7/1991 Trammell
5,075,902 A 12/1991 McReynolds et al.
5,109,837 A 5/1992 Gamow
5,129,647 A 7/1992 Castellanos
5,133,339 A 7/1992 Whalen et al.
5,221,241 A 6/1993 Bare, II
5,242,339 A 9/1993 Thornton
5,287,988 A 2/1994 Murray
5,340,625 A 8/1994 Weitsman et al.
5,356,361 A 10/1994 Watenpaugh
5,360,001 A 11/1994 Brill et al.
5,368,532 A 11/1994 Farnet
5,398,678 A 3/1995 Gamow
5,470,293 A 11/1995 Schonenberger
5,471,797 A 12/1995 Murphy
5,518,141 A 5/1996 Newhouse et al.
5,526,994 A 6/1996 Murphy
5,527,242 A 6/1996 Gangloff
5,543,194 A 8/1996 Rudy
5,571,062 A 11/1996 Saganovsky
5,577,598 A 11/1996 Schoenenberger
5,582,561 A 12/1996 Gonzalez
5,623,944 A 4/1997 Nashner
5,662,311 A 9/1997 Waedekin et al.
5,678,543 A 10/1997 Bower
5,700,232 A 12/1997 Clausen et al.
5,702,323 A 12/1997 Poulton
5,704,881 A 1/1998 Dudley
5,706,822 A 1/1998 Khavari
5,738,612 A 4/1998 Tsuda
5,799,652 A 9/1998 Kotliar
5,830,162 A 11/1998 Giovannetti
5,860,857 A 1/1999 Wasastjema et al.
5,919,419 A 7/1999 Majuri
5,921,892 A 7/1999 Easton
5,960,480 A 10/1999 Neustater et al.
6,027,464 A 2/2000 Dahlquist
6,033,344 A 3/2000 Trulaske et al.
6,042,537 A 3/2000 Kaiser
6,146,315 A 11/2000 Schonenberger
6,176,386 B1 1/2001 Beukers et al.
6,179,118 B1 1/2001 Garrill et al.
6,220,992 B1 4/2001 Shafik
6,273,844 B1 8/2001 Kelsey et al.
6,321,746 B1 11/2001 Schneider et al.
6,332,290 B1 12/2001 Delamare
6,332,354 B1 12/2001 Lalor et al.
6,348,025 B1 2/2002 Schonenberger
6,405,685 B1 6/2002 Cox
6,443,148 B1 9/2002 Rodocker
6,482,128 B1 11/2002 Michalow
6,508,850 B1 1/2003 Kotliar
6,527,678 B1 3/2003 Wang et al.
6,539,946 B2 4/2003 Weyergans
6,554,747 B1 4/2003 Rempe
6,565,624 B2 5/2003 Kutt et al.
6,609,054 B2 8/2003 Wallace
6,645,126 B1 11/2003 Martin et al.
6,656,091 B1 12/2003 Abelbeck et al.
6,666,831 B1 12/2003 Edgerton et al.
6,712,832 B2 3/2004 Shah
D495,384 S 8/2004 Rolfes
6,783,482 B2 8/2004 Oglesby et al.
D497,961 S 11/2004 Rolfes
6,821,233 B1 11/2004 Colombo et al.
6,905,459 B2 6/2005 Humphries, Jr.
6,918,858 B2 7/2005 Watterson et al.
7,028,553 B2 4/2006 Smith et al.
7,063,678 B1 6/2006 Cook
7,141,007 B2 11/2006 Egger
7,166,064 B2 1/2007 Watterson et al.
7,219,812 B2 5/2007 Debecker et al.
7,494,450 B2 2/2009 Solomon
7,556,040 B2 7/2009 Meyer et al.
7,591,795 B2 * 9/2009 Whalen ..... A63B 22/02 600/19
7,594,281 B1 9/2009 Stinson et al.
7,762,930 B2 7/2010 Egger
7,780,587 B2 8/2010 Thornton et al.
7,785,242 B2 8/2010 Solomon
7,837,597 B2 11/2010 Reyes et al.
7,850,629 B2 12/2010 Ravikumar
7,857,731 B2 12/2010 Hickman et al.
7,862,478 B2 1/2011 Watterson et al.
7,914,420 B2 3/2011 Daly et al.
8,025,056 B2 9/2011 Lewis
8,087,536 B2 1/2012 Koussios et al.
8,186,708 B2 5/2012 Zhou et al.
8,231,139 B2 7/2012 Hellot et al.
8,235,724 B2 8/2012 Gilley et al.
8,308,618 B2 11/2012 Bayerlein et al.
8,375,938 B2 2/2013 Gaumond et al.
8,447,401 B2 5/2013 Miesel et al.
8,464,716 B2 * 6/2013 Kuehne ..... A63B 21/068 601/19
8,480,602 B1 7/2013 Cook

(56) References Cited

U.S. PATENT DOCUMENTS

D695,856 S 12/2013 Jacobs et al.
8,639,455 B2 1/2014 Horst et al.
8,679,040 B2 3/2014 Horst
8,739,792 B2 6/2014 Holley et al.
8,840,572 B2 * 9/2014 Whalen ..... A61G 10/023 601/6
8,900,074 B1 12/2014 Johnson et al.
8,900,098 B2 * 12/2014 Egan ..... A63B 24/0087 482/4
8,968,163 B1 3/2015 Vidmar
9,205,797 B2 12/2015 Ostman et al.
9,272,175 B2 * 3/2016 Egan ..... A63B 21/00181
9,327,673 B2 5/2016 Fukawatase et al.
9,554,964 B1 1/2017 Johnson et al.
9,561,149 B2 2/2017 Johnson et al.
9,642,764 B2 * 5/2017 Kuehne ..... A61H 1/00
9,708,830 B2 7/2017 Henderson et al.
9,914,003 B2 3/2018 Kuehne et al.
10,004,656 B2 * 6/2018 Whalen ..... A63B 21/00181
10,130,554 B2 11/2018 Aronson
10,132,011 B2 11/2018 Malina et al.
10,179,078 B2 1/2019 Bhugra et al.
10,219,734 B2 * 3/2019 Williams ..... A61B 5/02055
10,265,565 B2 4/2019 Jue et al.
10,265,566 B2 4/2019 Bayerlein et al.
10,342,461 B2 7/2019 Basta et al.
10,398,619 B2 9/2019 Crombie et al.
10,427,293 B2 10/2019 Asbeck et al.
10,493,309 B2 12/2019 Jue et al.
10,533,913 B2 1/2020 Lee et al.
10,596,365 B2 3/2020 Hyde et al.
10,683,658 B1 6/2020 Poehner
10,709,926 B2 7/2020 Bayerlein et al.
10,773,121 B2 9/2020 Del Monaco et al.
10,816,177 B1 10/2020 Bayerlein et al.
10,843,036 B2 * 11/2020 Bayerlein ..... A63B 69/0064
10,905,914 B2 2/2021 Bayerlein et al.
10,918,926 B2 2/2021 Pennington
11,517,781 B1 * 12/2022 Whalen ..... A61G 10/023
11,559,720 B2 * 1/2023 Bayerlein ..... A61H 1/005
2001/0018564 A1 8/2001 Manor et al.
2002/0010056 A1 1/2002 Borsheim
2002/0025889 A1 * 2/2002 Egger ..... A63B 22/0605 482/57
2002/0032103 A1 3/2002 Cook
2003/0010870 A1 1/2003 Chafer
2003/0032904 A1 2/2003 Egger
2003/0204148 A1 10/2003 Lange et al.
2004/0019304 A1 1/2004 West
2004/0171465 A1 9/2004 Hald et al.
2004/0238285 A1 12/2004 Stokes
2005/0075680 A1 4/2005 Lowry et al.
2005/0164839 A1 7/2005 Watterson et al.
2006/0009333 A1 1/2006 Wang
2006/0185065 A1 8/2006 Allen
2006/0190051 A1 8/2006 Gerber et al.
2006/0199712 A1 9/2006 Barnard et al.
2007/0016116 A1 1/2007 Reinkensmeyer et al.
2007/0054783 A1 * 3/2007 Egger ..... A63B 24/00 601/1
2007/0219059 A1 9/2007 Schwartz et al.
2007/0272484 A1 11/2007 Helms
2008/0026657 A1 1/2008 Sollars
2008/0246581 A1 10/2008 Irie et al.
2008/0281633 A1 11/2008 Burdea et al.
2008/0306412 A1 12/2008 Nieminen et al.
2009/0014004 A1 1/2009 Whalen et al.
2009/0036272 A1 2/2009 Yoo
2009/0047644 A1 2/2009 Mensah et al.
2009/0221404 A1 9/2009 Dorogusker et al.
2009/0236176 A1 9/2009 Sheu
2009/0255531 A1 10/2009 Johnson et al.
2009/0269728 A1 10/2009 Verstegen et al.
2011/0098157 A1 4/2011 Whalen et al.
2012/0152243 A1 6/2012 Hingley et al.
2012/0238921 A1 * 9/2012 Kuehne ..... A63B 71/0009 601/5
2013/0095459 A1 4/2013 Tran
2013/0187367 A1 7/2013 Kim et al.
2014/0194252 A1 * 7/2014 Arimoto ..... A63B 23/04 482/51
2014/0296037 A1 10/2014 Razzaq
2015/0102037 A1 4/2015 Nettis et al.
2015/0379239 A1 12/2015 Basta et al.
2016/0000155 A1 1/2016 Marecek et al.
2016/0001118 A1 1/2016 Kuehne et al.
2016/0001119 A1 1/2016 Jue et al.
2016/0007885 A1 1/2016 Basta et al.
2016/0008650 A1 1/2016 Jue et al.
2016/0073704 A1 3/2016 Basta et al.
2017/0128769 A1 * 5/2017 Long ..... H04L 67/10
2017/0367916 A1 * 12/2017 Kuehne ..... A63B 21/00181
2019/0150530 A1 5/2019 Basta et al.
2019/0323662 A1 10/2019 Kent et al.
2019/0392939 A1 * 12/2019 Basta ..... G16H 20/30
2020/0016025 A1 1/2020 Devanaboyina
2020/0108291 A1 4/2020 Piazza et al.
2020/0221975 A1 * 7/2020 Basta ..... A63B 71/0622
2020/0384309 A1 12/2020 Long et al.
2021/0187348 A1 * 6/2021 Phillips ..... A63B 22/025

FOREIGN PATENT DOCUMENTS

CN 2208414 Y 9/1995
CN 2920312 Y 7/2007
CN 203372186 U 1/2014
CN 103638633 B 3/2014
CN 203647961 U 6/2014
CN 203663349 U 6/2014
CN 203915904 U 11/2014
CN 104759060 B 7/2015
CN 104800047 A 7/2015
CN 204628542 U 9/2015
CN 105380657 B 3/2016
CN 105380658 B 3/2016
CN 105579014 B 5/2016
CN 107158648 A 9/2017
CN 207838129 U 9/2018
CN 208115027 U 11/2018
CN 208541744 U 2/2019
CN 208893547 U 5/2019
CN 209845965 U 12/2019
CN 108506487 U 5/2020
CN 111135537 A 5/2020
CN 210494475 U 5/2020
DE 20305670 U1 8/2003
DE 10362043 A1 5/2005
DE 102006010887 A1 9/2007
EP 0626338 B1 11/1994
GB 2128488 A 5/1984
JP S592993 A 1/1984
JP S63109878 A 5/1988
JP 63163097 A 7/1988
JP H05500760 A 2/1993
JP H0549596 A 3/1993
JP H1022334 A 1/1998
JP H11113988 A 4/1999
JP 2000342713 A 12/2000
JP 2001112886 A 4/2001
JP 2001517187 A 10/2001
JP 2002028202 A 1/2002
JP 2002360644 A 12/2002
JP 2004073445 A 3/2004
JP 2005102798 A 4/2005
JP 2007151676 A 6/2007
JP D1395000 8/2010
WO 2004103176 A1 12/2004
WO 2006050787 A1 5/2006
WO 2006061834 A2 6/2006
WO 200706705 A1 1/2007
WO 2007038888 A1 4/2007
WO 2007079971 A1 7/2007
WO 2007115565 A2 10/2007
WO 2008058567 A1 5/2008

(56) References Cited

FOREIGN PATENT DOCUMENTS

| | | | |
|---|---|---|---|
| WO | 2012065553 | A1 | 5/2012 |
| WO | 2014138228 | A1 | 9/2014 |
| WO | 2017171334 | A1 | 10/2017 |
| WO | 2019089850 | A1 | 5/2019 |

OTHER PUBLICATIONS

Hongyan Wang et al., "Airdrop Recovery Systems with Self-Inflating Airbag," Modeling and Analysis, Academy of Armed Forces Engineering, China, WILEY, National Defense Industry Press, 2017.

William R. Doggett et al., "Non-Axisymmetric Inflatable Pressure Structure (NAIPS) Concept that Enables Mass Efficient Packageable Pressure Vessels with Sealable Openings," National Aeronautics and Space Administration, Langley Research Center, Hampton, VA, Aug. 2016.

Showa Denki Taiwan, ("Terasu Walker, Instruction Manual"), May 14, 2015, Taiwan.

Showa Denki Taiwan, "Showa For Medical", Oct. 16, 2014, Taiwan.

* cited by examiner

PRIOR ART

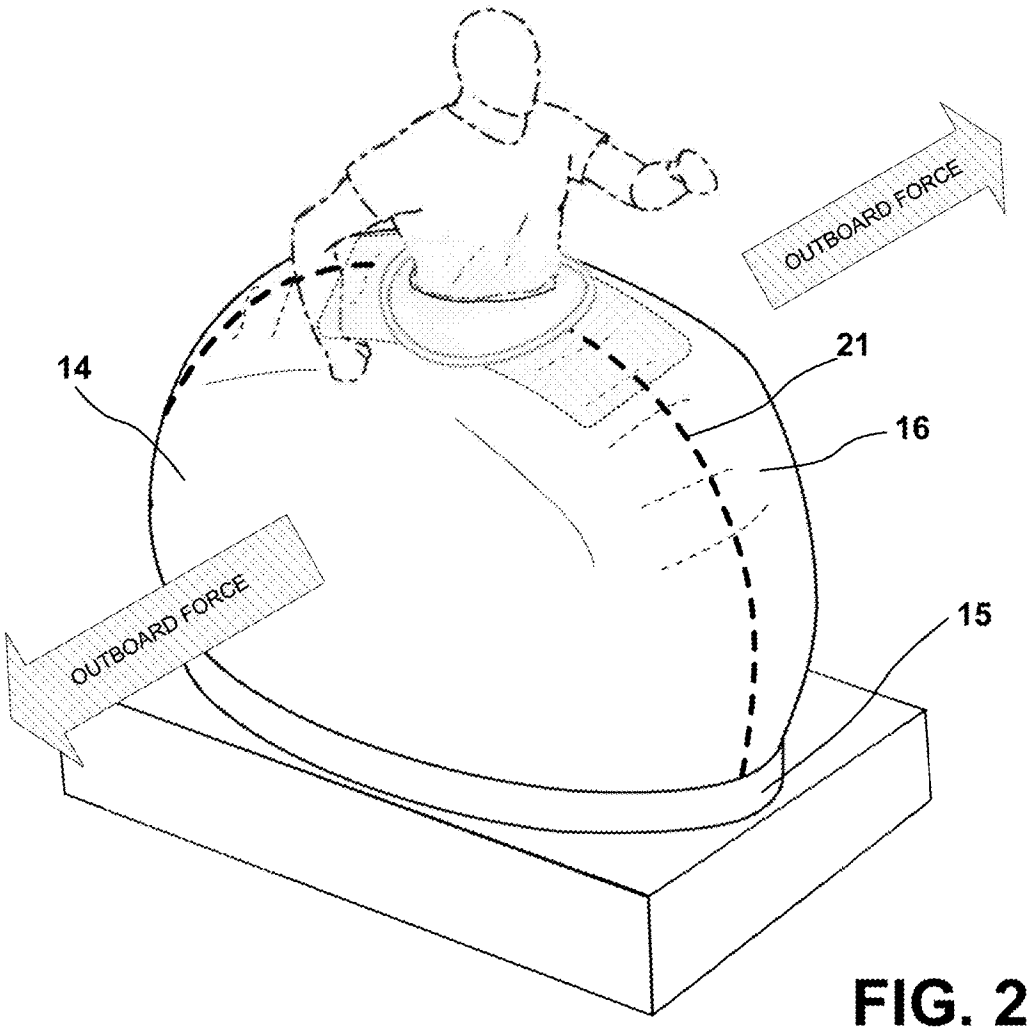
FIG. 2G
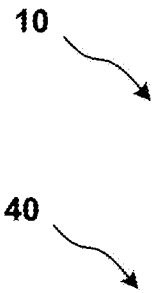

UNWEIGHTING ENCLOSURE, SYSTEM AND METHOD FOR AN EXERCISE DEVICE

CROSS-REFERENCES TO RELATED APPLICATIONS

This application is related to copending U.S. patent application Ser. No. 17/351,236 filed on Jun. 18, 2021 entitled "Unweighting Exercise Equipment", which is a continuation of U.S. patent application Ser. No. 16/016,340 filed on Jun. 22, 2018 entitled "Unweighting Exercise Equipment" (now abandoned), which claims priority to U.S. provisional patent application No. 62/523,363 filed on Jun. 22, 2017. This application is also related to U.S. provisional patent application No. 63/157,697 filed on Mar. 6, 2021 Entitled "DAP System Adjustments Via Flexible Restraints and Related Devices, Systems and Methods. This application is further related to provisional patent application No. 63/119,659, filed on Dec. 1, 2020, entitled "Unweighting Enclosure, System and Method for an Exercise Device." In addition, this application is related to co-pending provisional patent applications filed on Oct. 12, 2021 entitled "DAP System, Platform, Integrated Lifts and Related Devices and Methods" (Patent application No. 63/254,969); "DAP System, Enclosure, Controls and Related Devices and Methods" (Patent application No. 63/255,001); and "DAP System, Enclosure, Seal Frame and Related Devices and Methods" (Patent application No. 63/254,972). Each of the above applications is hereby specifically incorporated by reference in its entirety.

BACKGROUND

The embodiments described herein relate to supplemental equipment for exercise and rehabilitation devices, and particularly to unweighting or differential air pressure enclosures, systems and methods for exercise or rehabilitation devices.

Systems for unweighting individuals for rehabilitation and fitness training have been a popular modality. Traditional methods have included aquatic training and using a hoist to lift a person or animal off a walking surface. Harness and hoist systems provide benefits related to their historical use in that they are well-known and can also allow for precise and granular unweighting, but become significantly uncomfortable at off-loading greater than about 25% of normal body weight. Further, aquatic systems can be difficult to control in terms of degree of off-loading, and are cumbersome to use along with having large space and resource requirements.

Systems that create a pressure differential can vary pressure differentials more precisely and are easier to use allowing for a wide range of unloading in small steps. One benefit of this is in the case of rehabilitation, for which it has been shown that increments as small as 1% of normal body weight can effectively determine and bypass a pain threshold below which a user can exercise pain free. More recently, systems creating a pressure differential across a portion of a user have been developed and are generally in commercial use in the rehabilitation and training centers around the world. These systems apply a pressure difference at a portion of the user's body with a net force at the center of pressure. If the net pressure differential is oriented parallel with the force of gravity and located near the user's waist, this off-loading force acts approximately directly counter to the force of gravity and therefore minimally alters the users natural gait patterns.

DAP systems have been commercialized by companies like Showa Denki in Japan, Sasta Fitness of the UK, Vacuwell of Poland, and AlterG Inc. in the US. While these systems offer benefits, they are expensive, large, non-adjustable, require specialized power sources, or are generally limited in access to the market because of the high cost and space burden, or general discomfort in design for users of different body types or heights.

Conventional DAP systems rely on the use of a shell placed around an existing treadmill or similar exercise device. A completely separate chamber is formed that encompasses a base portion of the exercise equipment including the running belt/rollers/deck of a treadmill or the seat and pedals of a stationary bicycle placed inside. These structures duplicate the framing of the combined system and therefore increase the cost, size, shipping bulk, part count, and overall complexity of the system. Further, such conventional DAP systems limit user adjustment of the corresponding exercise device including modifying incline or tilt settings, which impact the pressure differential of conventional DAP systems.

In addition, conventional DAP systems develop substantial vertical and lateral forces in the thousands of pounds in the DAP chamber during use due to conventional unweighting designs exposing large surface areas to unweighting pressures. These systems include supplemental reinforcements and structural additions for the corresponding exercise equipment, which typically is not designed to accommodate such extreme external loading. The elevated forces developed by such conventional systems include outboard expansion forces exerting lateral forces and upward/downward expansion forces applying vertical loads against nearby components of the exercise equipment or applying torque to the framing that may impact lifetime and function of the exercise equipment. Further, even though safety mechanisms and system can reduce and mitigate risks of failure and user injury in conventional DAP systems within low probability ranges, the extreme forces involved, and potential harms inflicted in the event of failure nonetheless amount to significant design risk.

Thus, a need exists for overcoming drawbacks and limitations of conventional DAP systems, and enable greater availability and usage of DAP systems and corresponding substantial benefits for a larger portion of the public.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

One general aspect includes a differential air pressure (DAP) exercise system that includes an inflatable enclosure having a base portion secured to a DAP platform and a collapsible chamber connected to the base portion. The collapsible chamber includes a pair of opposing substantially inelastic flexible sheets and a seam, in which each sheet has a base region attached to the inflatable enclosure base portion and a perimeter portion extending upward from the base region, each base region attached to the inflatable enclosure base portion at an opposite lateral side of the DAP platform from each other, each perimeter portion defining a chamber profile shape corresponding with a lateral profile of the chamber in an inflated, uncollapsed state, and each perimeter portion having a top region, a front region, and a rear region. The seam securely attaches the pair of flexible sheets to each other along the corresponding perimeter portions at the corresponding top, front and rear regions. In the inflated state: inner regions of each of the flexible sheets expand apart under pressure and define an enclosure inner space therebetween; the flexible sheets each transmit outboard forces created by the pressure to the seam, in which the outboard forces applied at the seam are from opposite transverse directions in a counterbalanced arrangement; and application of the outboard forces through each sheet to the seam define a curved, low hoop stress edge portion along the enclosure at the corresponding top, front and rear regions when inflated.

Implementations can include one or more of the following features. The collapsible chamber of the DAP exercise system can include: a low hoop stress zone formed along a top edge portion of the enclosure, the low hoop stress zone can include a series of spaced apart transverse wrinkles in the enclosure skin and a plurality of unwrinkled enclosure edge portions extending between adjacent wrinkles, each transverse wrinkle corresponding with zero or negative hoop stress extending across the edge portion, and each unwrinkled enclosure edge portion corresponding with low hoop stresses extending across the edge portion. Further, the collapsible chamber can include a notch defined in each flexible sheet along a middle section of the top region, in which the corresponding notches are excluded from attachment to each other and to the seam along a perimeter region. The pair of corresponding notches define a top opening through the enclosure top for user access into and through the enclosure inner space. The collapsible chamber can also include a user seal interface secured at a first end to a perimeter portion of the top opening, in which an opposite second end of the user seal interface is configured to form an airtight attachment with a pelvic harness of a user; and a seal frame extending about the perimeter of the top opening and attached to each of the pair of sheets proximate the top opening, such that the seal frame receives and transmits across the top opening outboard forces applied by each of the flexible sheets toward the top opening. The seal frame can include: a rigid closed loop having a pre-determined shape; the pre-determined shape can be formed according to an inflated shape at the middle section of the top region as a location of the top opening and an inflated shape across low hoop stress edge portions corresponding with the top opening; the rigid closed loop can extend around a perimeter of the top opening and can be attached to the enclosure at a plurality of locations proximate the top opening; and the rigid closed loop can be configured to maintain a contoured perimeter corresponding with the inflated shape for the location of the top opening.

In addition, the top opening can be defined through the enclosure top along a low hoop stress edge portion, the seal frame can be disposed about the top opening and attached to the pair of sheets along the low hoop stress edge portion, the seal frame can have a contoured saddle-like shape for matching a low hoop stress edge portion shape; and the seal frame can be coupled to the pair of sheets and supported at the enclosure top about the top opening in a floating arrangement with the enclosure, such that the seal frame and the top opening allow freedom of movement for the user in combination with flexibility provided via the low hoop stress edge portions. Further, at least one pair of transverse wrinkles and at least one unwrinkled enclosure edge portion can be disposed along the enclosure top adjacent to the seal frame in each of a forward position in front of the seal frame and a rearward position behind the seal frame, such that the seal frame and the top opening can provide the user freedom of movement in forward and rearward directions along with the low hoop stress edge portions. Also, at least one pair of transverse wrinkles and at least one unwrinkled enclosure edge portion can be disposed along the enclosure top adjacent to the seal frame in a position longitudinally in front of and behind the seal frame, and the seal frame can be configured to tilt frontward and rearward freely within the low stress zone. In addition, a forward low hoop stress edge portion of the enclosure can be defined along portions of the front central regions of the pair of sheets, and a rearward low hoop stress edge portion of the enclosure can be defined along portions of the rear central regions of the pair of sheets, such that the forward, rearward, and top low hoop stress edge portions cooperate to provide enhanced freedoms of movement for the user and enable an expanded floating arrangement for the seal frame.

One general aspect also includes a DAP exercise device that includes an exercise device for a user defining an access region above the device, an enclosure support providing a vertical path to the access region, and an inflatable flexible enclosure secured to the enclosure support at a base of the enclosure extending vertically therefrom in the inflated condition. The enclosure can include: a pair of opposing substantially inelastic curvilinear-shaped sheets joined along a perimeter of each sheet and spaced apart in the inflated condition and form an elongate disc-shaped enclosure; a base opening attached to the enclosure support above the access region defined through the base into an inner cavity of the enclosure and establishing a pathway between the inner space and the access region; and a top opening defined through the joined sheets to the inner cavity at a top portion of the enclosure having an attached seal frame retaining the sheets connections at portions of their perimeters and at each side of the top port, in which the top port is configured to form a sealed connection with the user traversing the top port. The enclosure also includes a base opening defined by edge portions of the joined sheets within a surface intersecting the disc shape of the enclosure and forming an enclosure support shape having a perimeter length, a maximum base length, and a maximum base depth providing independent support for retaining the vertical orientation of the enclosure in the inflated condition along with transferring lift force from the base support, through the enclosure and a user interface to the user while accessing the exercise device for the range of motion through the enclosure.

Implementations can include one or more of the following features. The DAP exercise device can include: an inflatable enclosure platform disposed about the exercise device and including the enclosure support, the enclosure support defining an access opening above the access region, the enclosure platform retaining the enclosure opening above the access region for maintaining the pathway between the inner space and the access region through the access opening. The base opening and the access opening can each define a cross-sectional shape having a cross-sectional area less than a cross-sectional area of the access region. The exercise device can be a treadmill having a movable track and defining a running surface of the track, in which the track has a track length and a track width of the running surface of the track, and the user access to the exercise device for the range of motion through the enclosure includes user access to the track length and the track width of the running surface; and the base opening covering a portion of the running surface. The base opening can have a substantially elliptical shape, and a cross-sectional area of the base opening can be larger than a cross-sectional area of the top opening. The exercise device can have an outer perimeter, and the enclosure can remain within the boundary of the outer perimeter when inflated.

One general aspect includes a method for providing a structurally independent DAP system to an exercise device for unweighting a user while exercising. The method includes determining an access region above the exercise device for a range of motion for performing an exercise on the exercise device. The method also includes forming a pair of opposing substantially inelastic flexible sheets each defining a closed shape having a perimeter portion including a top region, a central region, a base region at an opposite side of the central region from the top region, in which a portion of a base perimeter is defined by a trim path interrupting the articulated shape at the base region. The method also includes attaching the flexible sheets to each other along the perimeter portion, the pair of portions of each base perimeter together outlining a base defining a base opening, the attached sheets defining a disc-shaped flexible enclosure interrupted by the base and having an inner space between the pair of sheets, and the inner space accessible through the base opening. The method also includes coupling a user interface to the top region configured to form an airtight support connection with the user and provide user access through the enclosure to the access region. The method further includes securing the base to a support via an airtight connection disposing the base opening above the access region, the support retaining the base opening in a foundation shape corresponding with the access region and configured for independently supporting the inflated enclosure from the base in a vertical orientation. In addition, the method includes providing an air flow into the inner space through the air inlet to inflate the enclosure, such that in the inflated condition the flexible enclosure provides unweighting to the user along with user access to the exercise device through the enclosure for the range of motion, and independently supports the enclosure in a vertical orientation from the base.

Implementations can include one or more of the following features. The method where: for determining an access region, the access region can include a cross-sectional length and a cross-sectional depth for the access region; and for securing the base to the support, the base opening in the foundation shape includes a base cross-sectional area substantially the same or less than a product of the cross-sectional length and the cross-sectional depth of the access region. The method can also include: installing a rigid seal frame around the top port, the rigid seal frame retaining a shape of the top port and a connection between the pair of sheets at perimeter portions of the sheets disposed at each side of the top port, and for securing the base to a support, the base opening defines a curvilinear shape. The curvilinear shape can be an elliptical shape.

Other exercise-related support devices, related systems, and components, and/or methods according to embodiments will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIG. 2G is a schematic perspective view of a DAP System and inflatable enclosure corresponding with the joined pair of sheets of FIG. 2B.

DETAILED DESCRIPTION

Figure 1A:
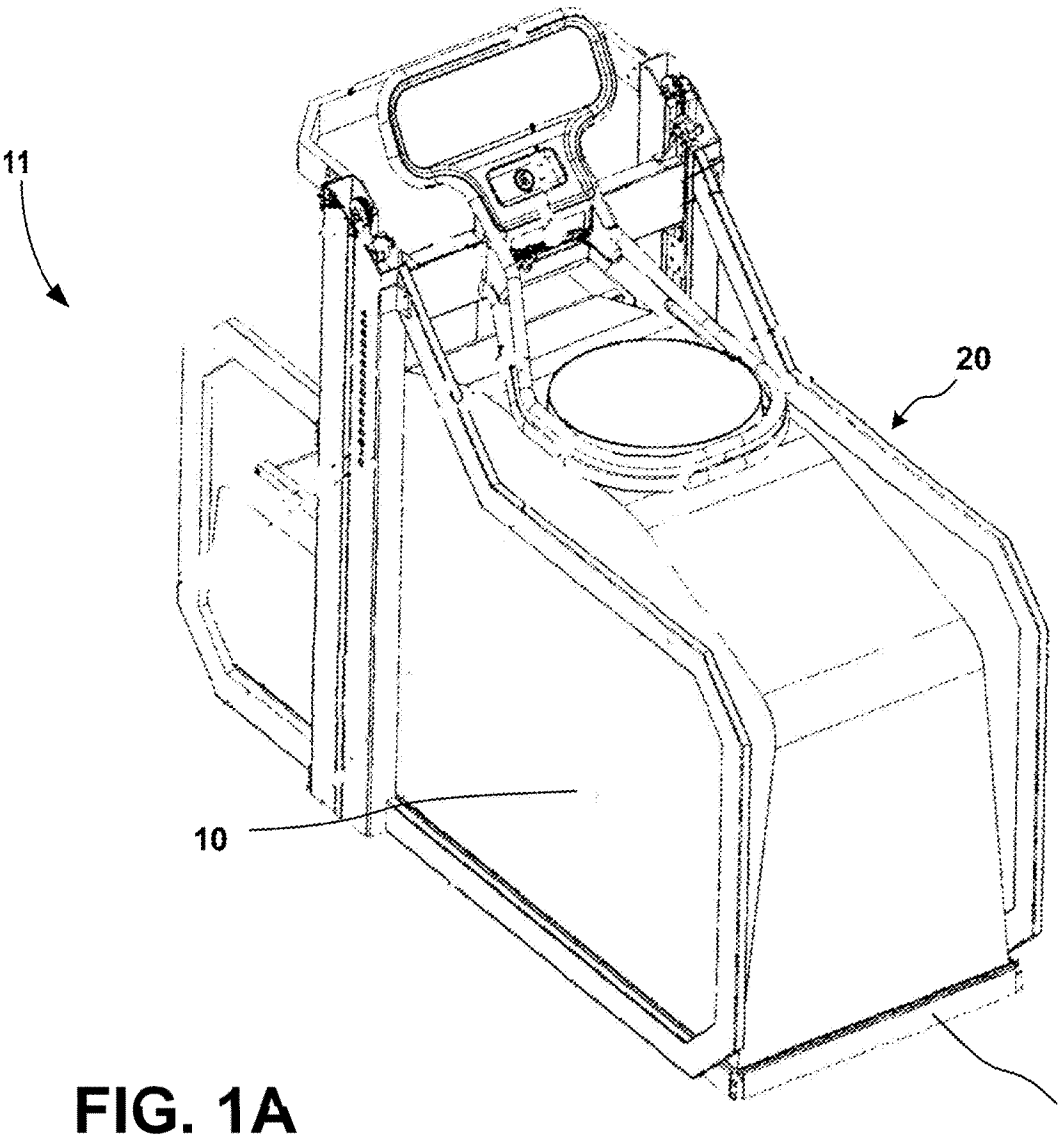
FIG. 1A is a perspective view of a conventional PRIOR ART DAP exercise device in the form a treadmill, which includes a conventional unweighting enclosure.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly, or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more embodiments and optional elements or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below" or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may be already designed prior to consideration for use as a DAP system and an existing exercise machine may be further already installed in the field, for example in a gym, training facility, etc. The reader shall interpret minor modifications of the exercise machine or existing exercise machine for use with a DAP system as still part of the exercise machine and still within the spirit of the scope of this Referring now to FIGS. 1A and 1B, a conventional differential air pressure (DAP) system 11 is shown in FIG. 1A as published and described in U.S. Pat. No. 8,464,716 to Kuehne et al. (hereinafter "Kuehne"). The Kuehne DAP system 11 includes a pressure chamber 10, an exercise device (not shown) located within the chamber, and a frame 20 having a plurality of connecting bars or rails including a base 21 arranged as a system platform. Inner lower edges (not shown) of the pressure chamber 10 are attached to platform or base 21 via a sealed connection. In addition, the pressure chamber 10 is attached to bars, rails, and other frame components around the perimeter of the chamber at varying heights above the attachment to the platform or base attachment via mounts, connectors and/or interference/contact connections.

Figure 1B:
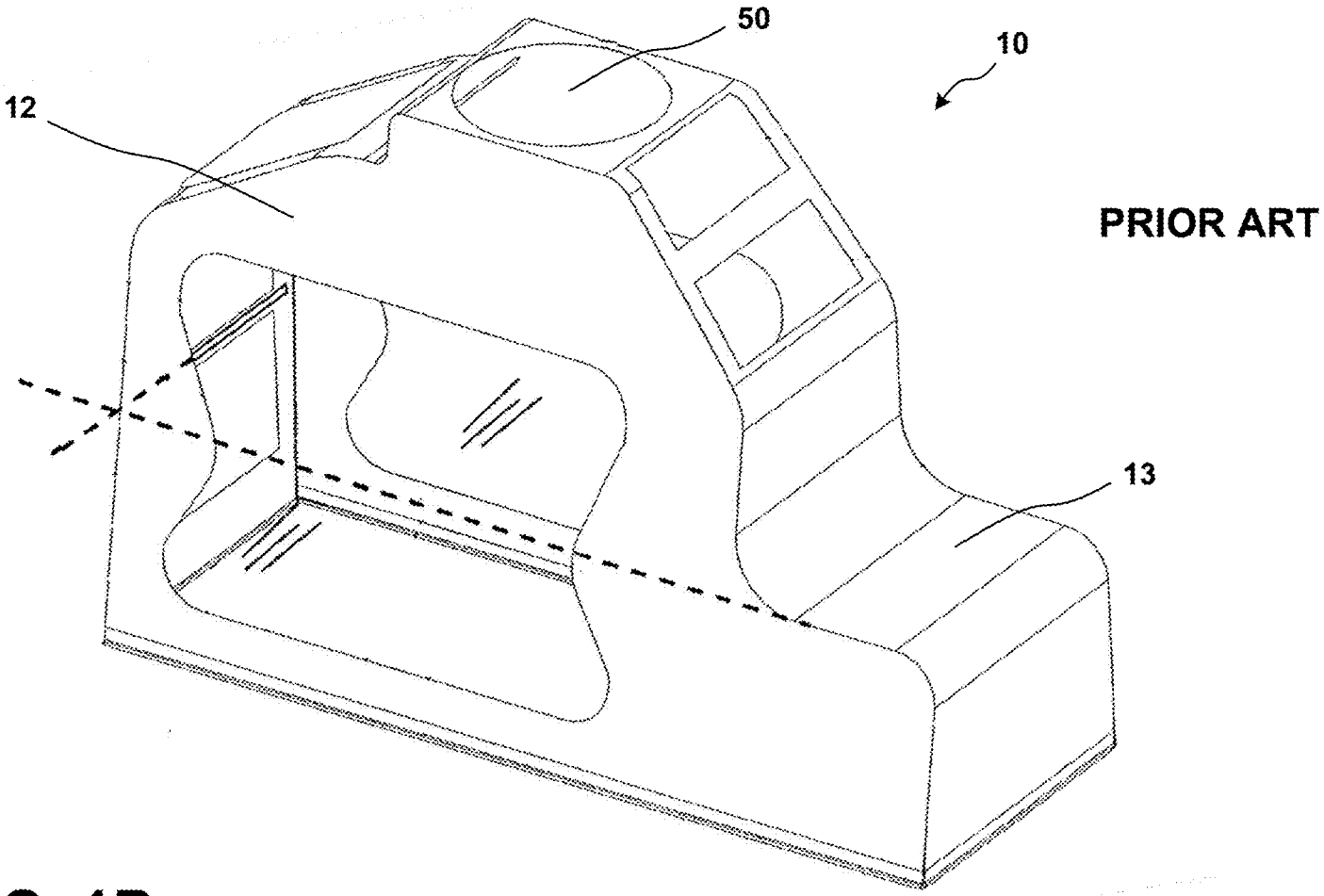
FIG. 1B is a perspective view of the PRIOR ART enclosure of FIG. 1A.

FIG. 1B shows the pressure chamber 20 without the frame 20 or other system components obscuring the view. The pressure chamber 10 includes a plurality surfaces joined to each other and/or the base in an airtight arrangement that defines the pressure chamber size, shape, and contour. An opening is defined through a top portion of the pressure chamber within which a user seal 50 is installed at an outer portion of the opening for providing an airtight seal with a user extending through the opening during use. The pressure chamber 10 is pressurized during use to exert unweighting support for the user connected through the user seal, which exerts substantial reactionary and resistance forces on the frame and other rigid reinforcements to counteract and constrain high forces generated from pressurization. Further, the frame 20 and related attachments are arranged to help shape the pressure chamber and/or control volume of the chamber overall, as well as to limit unneeded surface area of the chamber upon which applied internal pressures apply outward forces based on the surface area.

Conventional DAP system 11 describes a wide range of reinforcement, guiding, volume and shape controlling, and safety restraining features for controlling and counteracting extreme forces in addition to forces applied for user unweighting, which are exerted against the chamber when pressurized. Further, Kuehne contemplates using any available design feature to light the high forces applied and limit failure including advising that the "contours and/or seams of the chamber may be rounded or curved using sufficient radii on corners to reduce fabric stress, or may incorporate reinforcement patches where stresses are high." Col. 8, lines 30-35 of Kuehne. Kuehne further employs significant system safety monitoring devices and controls for monitoring forces exerted, alerting the user if potentially unsafe or dangerous force management circumstances are detected, and/or attempting protective shut-down or deflation actions if emergency circumstances are detected.

FIGS. 2A-2G: Dual-Sheet, Perimeter-Seamed, Enclosure & Low Hoop Stress

Referring now to FIGS. 2A to 2F, various schematic example representations pertaining to DAP system inflatable enclosures are generally shown without particular reference to an overall DAP system or enclosure arrangement for providing insights pertaining to some of the enclosure concepts discussed further below with more detailed examples, and to more particularly identify concepts addressed in general terms herein with discussion of other examples, for which further clarification can be helpful.

Figure 2D:
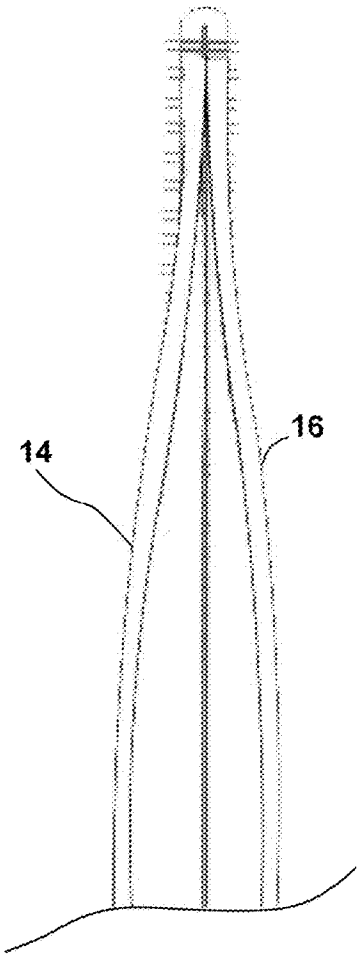
FIGS. 2C and 2D are cross-sectional side views of the joined pair of flat sheets of FIG. 2B.
Figure 2C:
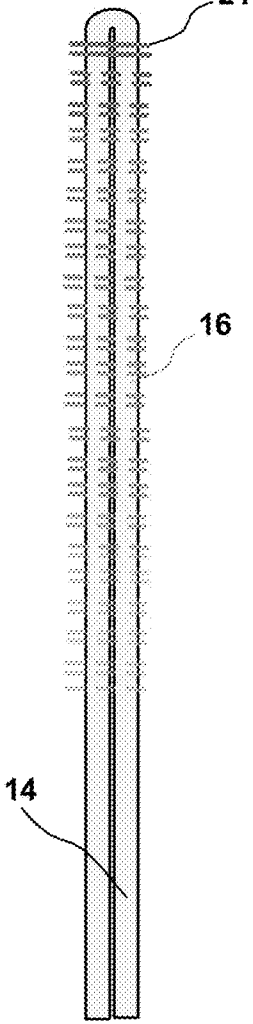
Figure 2A:
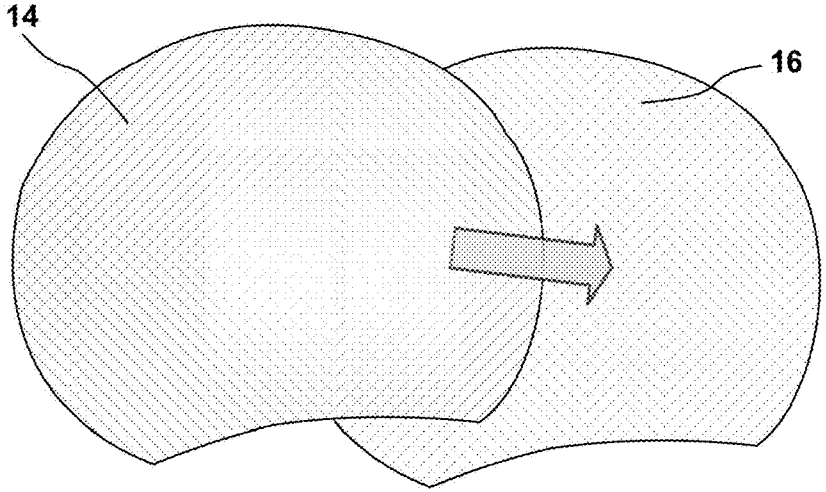
FIGS. 2A and 2B are elevation views of schematic representations of a pair of flat sheets joined to each other along perimeter portions for forming an inflatable enclosure according to aspects and features of inventive concepts described herein.
Figure 2B:
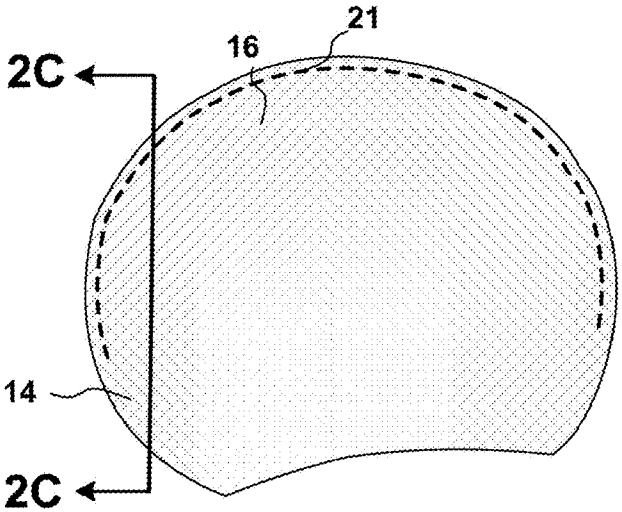

With particular reference to FIGS. 2A to 2C, concepts related to dual-sheet options are shown including forming an inflatable enclosure that can be used with a DAP system, and more particularly related to dual-sheet, perimeter-seamed options. With respect to dual-sheet or dual flat-sheet options for forming an enclosure, FIG. 2A shows a pair of flat sheets 14, 16 having the same or substantially the same size and shape, which can be used to form an inflatable enclosure for use with a DAP system by placing the sheets in an opposed (e.g., stacked) arrangement and installing a seam 21 along a perimeter region of the pair of sheets as shown in FIG. 2B. However, simply attaching a pair of opposing sheets to each other may provide few, if any, benefits for use with a DAP system if, for instance, the sheets have not been modified such that each sheet has an appropriate shape for providing desired DAP functionality or lacks sufficient space along perimeter portions of the shape for effectively connecting the sheets. Further, many other considerations can be evaluated, such as material type, permeability, attachment space or features for mounting on a DAP system, and so on.

Design features and options discussed herein for attaching a pair of opposed sheets to each other and, in particular, for doing so via a seam or other attachment device installed along a perimeter of the pair of sheets can provide significant novel and non-obvious benefits and advantages pertaining to DAP systems, their operability and efficiency. FIGS. 2A and 2B schematically depict the component pair of flexible sheets and attachment of the same to each other while in an opposed relationship. FIG. 2C shows a schematic cross-sectional view of the pair of perimeter-stitched opposing sheets of FIG. 2B as indicated thereon and discussed further below. Note that the stacked pair of flexible sheets 14, 16 depicted in the example schematic representation of FIG. 2C are attached to each other via both a seam 21 AND as a physical connection, such as a connector or fabric attachment as shown at the top of FIG. 2C.

Comparative consideration of the schematic cross-sectional view of a portion of the dual-sheet, perimeter-seam assembly of FIG. 2C can provide insights pertaining to novel and inventive subject matter for attaching a pair of opposing sheets directly to each other via a seam or other secure connection along a perimeter of the sheets. A wide range of advantages and benefits can be obtained from these and related aspects and features described herein, as well as optional features. With respect to teachings for placing a seam along a perimeter region of a pair of opposing sheets, FIG. 2C denotes potential benefits for attaching flexible enclosure sheets to each other via use of a seam or stitching. As shown in FIG. 2C along with reference to FIG. 2B, the use of a seam or stitches for attaching the opposing sheets to each other can bias the pair of sheets toward a flat arrangement of the sheets when not inflated. Further, additional nearby seam or stitch material at other locations along the sheet perimeter can reinforce a bias against the pair of sheets readily expanding apart from each other when pressure is applied to the enclosure, and can also limit the extent of movement and corresponding amount of inflation therein. FIG. 2D generally depicts effects of increased bias and inflation limitations that can occur from the placement of a seam or stitches along a perimeter portion of the opposing sheets. The gap shown between sheets 14 and 16 can be formed when the enclosure is inflated, which as shown has been limited by the seam proximity. Depending on design intent and options for potentially influencing the enclosure to form low hoop stress regions, for example, these and similar effects on enclosure inflation can be beneficial and/or interfere with intended DAP system operations.

For instance, significant benefits and advantages can be realized with respect to the inventive features described herein pertaining to joining a pair of flexible sheets along corresponding perimeter portions for a DAP enclosure. As noted above with respect to FIGS. 2B to 2D, placement of a seam or other attachment through a pair of opposed flexible sheets for a DAP enclosure can affect an amount or size of inflation for the enclosure. Further, such impacts can help guide applications of pressure and resultant forces against interior regions of the pair of sheets and the enclosure, such that increased pressure and forces are transmitted by the pair of flexible sheets laterally in opposite directions against the seam or attachment between the sheets. The pressure and applied forces against the seam or connection from each of the flexible sheets can counter each other along opposite lateral directions, while also exerting extreme force concentrations inwardly toward the joint or seam along top portions of the sheets and enclosure, which can thereby define low or no hoop stress regions along a top of the enclosure. As discussed in greater detail below, design options and features that can guide the formation of zero or low hoop stress zones along edge portions of the enclosure can provide many significant benefits for the inflatable enclosure and for operability of the DAP system, as well as for expanding features of the DAP system and movement freedoms for users.

Figure 2F:
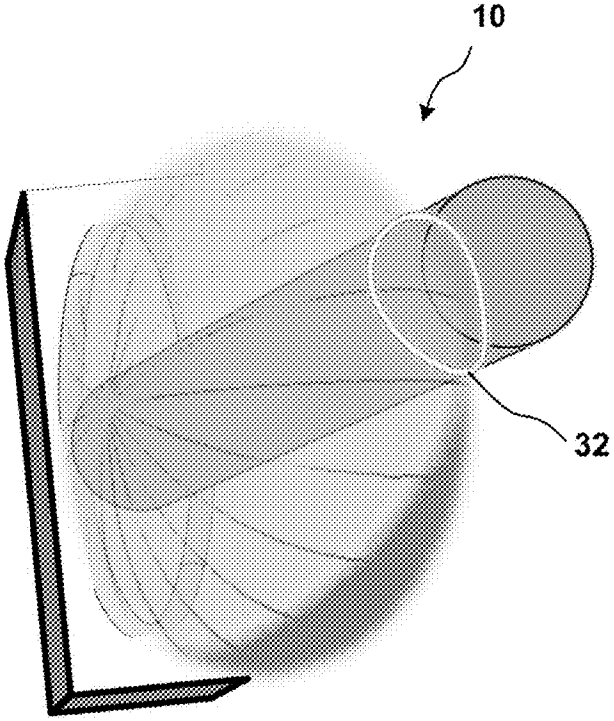
FIGS. 2E and 2F are schematic perspective views of an inflatable enclosure according to aspects and features of inventive concepts described herein.
Figure 2E:
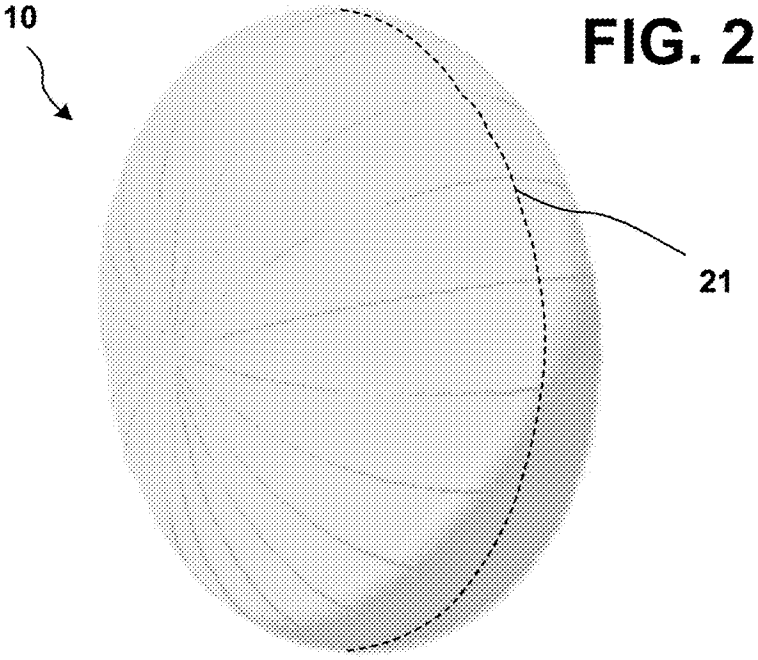

Referring now to FIGS. 2E and 2F, a schematic representation of an inflatable enclosure 10 is shown, which includes a low hoop stress arrangement including curved low hoop stress edge portions along a top region of the enclosure that can provide a range of benefits for DAP systems and corresponding enclosures. FIG. 2F shows the enclosure of FIG. 2E attached to a DAP platform along with showing a potential vertical accessway through the enclosure for a user of the DAP system. As further shown, an intersection of the vertical accessway with a top of the enclosure having a curved low hoop stress edge portion identifies a contoured shape for a corresponding top opening through the enclosure top, as well as a seal frame for retaining the top edge portion shape. As can be seen in FIG. 2F, a contoured shape for the top opening and the seal frame for maintaining the curved edge portion shape at the enclosure top would include a generally saddle-shaped seal frame.

Referring now to FIG. 2G, a schematic representation is shown for an example DAP System 40 and inflatable enclosure 10 corresponding with the pair of opposing flat sheets 14 and 16 of FIG. 2B joined to each other along their perimeter portions via a joint 21, such as a seam or heat seal attachment 21. As shown in FIG. 2G, the arrangement of the opposing pair of flat sheets 14, 16 can provide a collapsible chamber and inflatable enclosure 10 that, when inflated, form a zero or low hoop stress structure having a generally curved edge portion oriented parallel with the perimeter attachment or seam 21 between the pair of sheets. When inflated, pressure applied to the inside surfaces of each sheet generate high, lateral outboard forces pushing the sheets laterally apart from each other along the joint or seam 21. The high, lateral, outboard forces are equal and in opposite directions such that the forces are applied in an offset or counter-balanced arrangement with respect to the pair of sheets. However, such an arrangement creates zero or low hoop stress curved edge portions along the seam based on the high, lateral outboard forces.

Depending on the particular geometry or lateral profile shape of the pair of sheets, the zero or low hoop stress edge portions can fully extend along the seam 21, extend continuously along significant portions of the seam, and/or exist along discrete regions, such as along the top region of the sheets fore and aft of the top opening. Wrinkles are formed along the zero or low hoop stress edge portions, which have zero or negative hoop stress therein whereas intervening edge portions have low hoop stress therein. Such an arrangement can provide a low profile (relatively thin) inflatable enclosure arrangement compared with other arrangements. Further, such an arrangement can allow for improved freedom of movement for the user extending through a top opening and seal frame while exercising. Although the joined pair of flat sheets are referred to as an inflatable enclosure, it is understood that the enclosure can include other components. For example, the joined pair of sheets can generally form a collapsible chamber pair connected to an intervening structure of the inflatable enclosure, such as a flexible interface 15 for attaching and removing the flat sheets or a rigid base structure 15.

Example Inflatable Enclosure and DAP System Having Low Hoop Stress

Figure 3A:
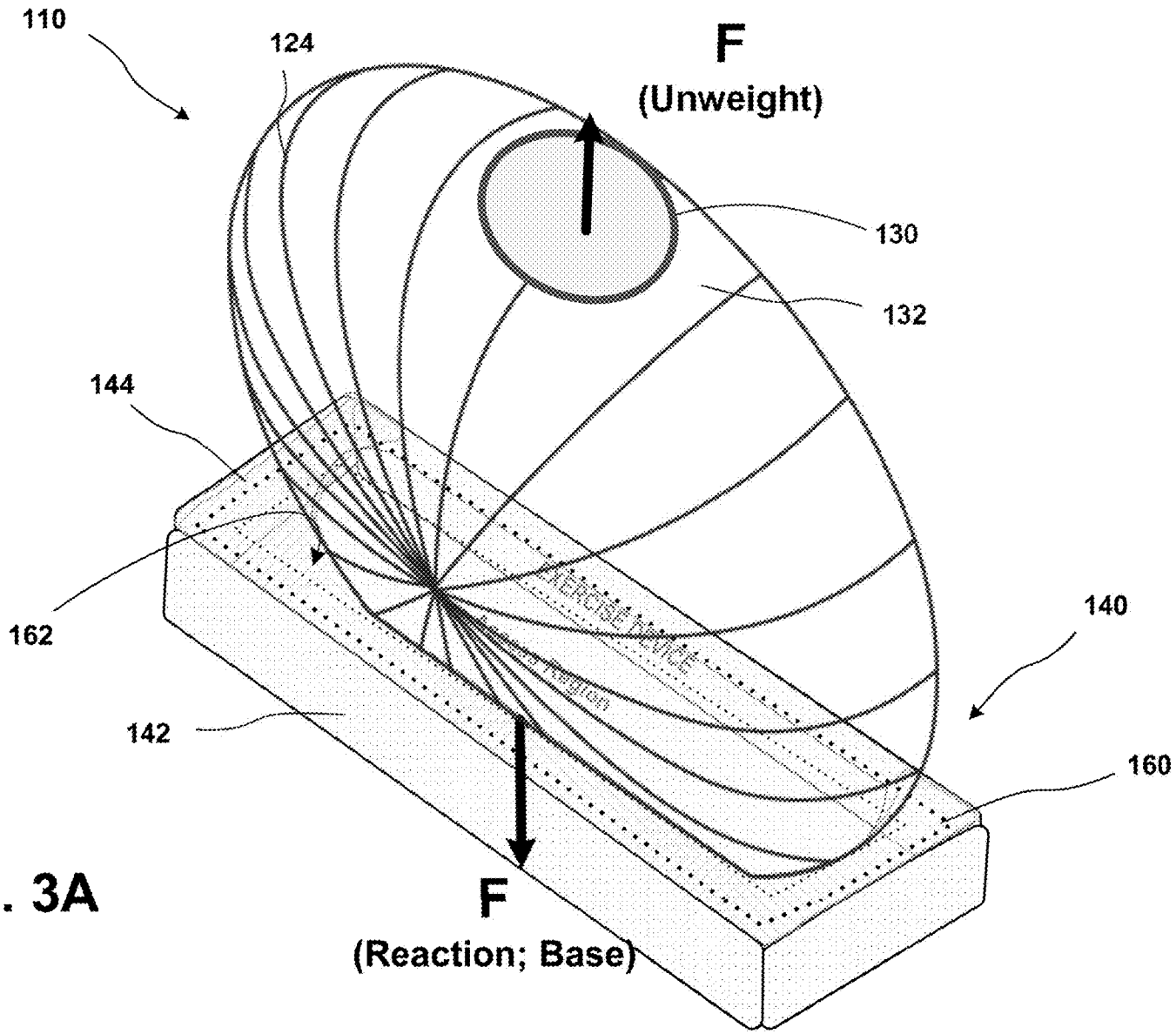
FIG. 3A is a top perspective view of a schematic representation of an independently-supportable inflatable enclosure as part of an example DAP System according to aspects and features described herein.
Figure 3C:
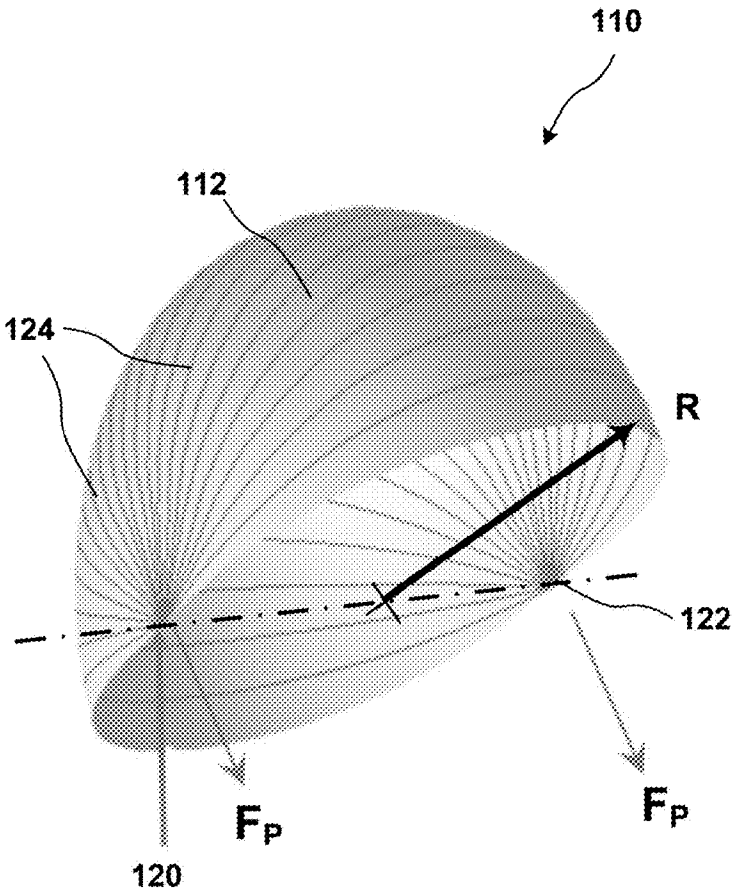
FIG. 3C shows a cut view of the upper half of the inflatable enclosure of FIG. 3A based on cut line 3B-3B shown in FIG. 3A.

Referring now to FIG. 3A, a schematic example inflatable lifting enclosure 110 for use with a DAP System 140 is generally shown, which when in the inflated condition can offset portions of the user's weight while using the exercise device via access through an inflatable enclosure 100 to access region 162 for the exercise device. An inflatable enclosure 110 is generally shown in an inflated condition operating as part of a schematic representation of a DAP system 140. DAP system 140 generally includes a support platform 142 to which a base 152 of inflatable enclosure 110 is securely attached in a sealed or airtight connection with an inflation device (not shown), as well as a generic exercise device 160, which can include a treadmill. Although DAP system 140 is illustrated as having a support platform 142 arranged as a structure enclosing the exercise device 160 and supporting a base connection with the enclosure, it is understood that the enclosure can be attached directly to the exercise device, supported by a skeletal frame, hybrid framework or other attachment arrangement without partially or fully enclosing the exercise device, and/or via other frameworks or arrangements that operatively secures a base portion of the inflatable enclosure for unweighting operations of the user for the exercise device while inflated. Further, the base portion of the inflatable enclosure can be arranged vertically over exercise device 160 along with aligning the base portion with an access region 162 for the exercise device that allows a user to access the exercise device and perform exercises via the exercise device.

In addition, the support platform 142 provides a secure support surface 144 closely arranged about the base of the inflatable enclosure 110, which can firmly attach or secure the base of the inflatable enclosure in an airtight connection permitting independent support of the enclosure when inflated as it extends from base 152 upward in a substantially vertical direction for supporting a user above the access region 162 of the exercise device 160. Further, the inflatable enclosure 110 in such an orientation and arrangement operatively supports itself and the user within in a low-profile, space-saving environment about the same size as the profile and environment as for using the exercise device apart from the DAP system 160. When in the inflated condition shown, air pressure acting against the surface of the flexible enclosure skin 113 applies upward unweighting forces on the user and opposite reaction forces against the support platform 142 at the support surface 144, as well as support forces for independently supporting the enclosure in upward orientation are carried within the enclosure skin 113.

As further shown in FIG. 3A, a top port or top opening 130 can be formed through a top portion of the inflatable enclosure 110, which as shown can be arranged generally in a vertical alignment with, and above, the exercise device 160 and corresponding access region 162 through an inner space of the inflatable enclosure. A top port frame 132 (also referred to as seal frame 132) can be installed proximate and within a perimeter region of top port 130 for securely retaining an air-tight seal connection with a user interface support garment for supporting a user in an airtight unweighting arrangement with the inflatable enclosure 110. In addition, top port frame 132 can be formed as a rigid frame that maintains a low surface stress, mechanical equilibrium arrangement of the inflatable enclosure 110. In short, the top port frame 132 can be affixed to top port 130 in an inner, outer, or inner/outer, sleeve arrangement or other rigid support arrangement that transmits tensile and compressive forces, and any other stresses and strains encountered in the top portion of the inflatable enclosure proximate the top port frame, which can maintain the mechanical equilibrium arrangement with internal pressure of the enclosure as would be provided in the absence of top port 130 in the inflated condition.

The meridional radial lines 124 shown for the inflatable enclosure 110 are representative of a surface stress arrangement that can be provided through the enclosure while inflated and used by a user (not shown), for which the top port frame 132 can maintain despite top port 130 interrupting a portion of the enclosure surface, for which stresses can be transmitted across the frame. However, the radial lines are shown only for schematic, illustrative purposes without necessarily denoting any tension members, reinforcements and the like integrated in the enclosure surface, such as embedded fibers, isotensoid supports and the like. Rather, the radial lines are indicative of the innovative, low surface tension arrangement of the inflatable enclosure, which enables many of the numerous beneficial features, improvements, and aspects of inventive subject matter described herein including, in particular, providing flexible movement zone 101 at least at a top, central region of enclosure 110 within which the seal frame 132, top opening 130 and the user can flexibly move within.

Moreover, the radial lines 124 generally represent meridional stress orientations that can be associated with zero or low hoop stress arrangements used for supporting a user, such as a low hoop stress dome structure forming an upper dome end 115 of the enclosure or an overall low hoop stress shape. The use of zero or low hoop stress arrangements can enable many and various beneficial features for inflatable enclosures used with DAP Systems, such as features pertaining to height adjustment, user freedom of movement, low profile enclosure shapes, low and balanced force arrangements, and enhanced freedom of movement for the user within the enclosure (lack of leg kick interference) and externally (arm swing clearance).

Base 152 of the inflatable enclosure 110 can be readily secured to a base support 146 of the DAP system located above an access region 162 of the exercise device 160. In addition, inflatable enclosure 110 can provide unweighting support and related benefits to the user while overcoming drawbacks, disadvantages, and challenges of conventional DAP systems, as well as provide effective unweighting functionality to users through low-profile configurations, which can greatly enhance overall advantages and benefits for using inflatable enclosure 110 as part of DAP systems beyond avoiding drawbacks and disadvantages of conventional systems. For instance, an inflatable enclosure described herein can be arranged to include a comparatively small, low cross-sectional area, intake port 158 through the base opening 154 for the enclosure, which can further limit or reduce reaction forces applied at the enclosure base 152 that attaches to a base support 146. Further, the availability of a low cross-sectional area intake at the base of the enclosure enhances design flexibility options for the enclosure that can permit the use of custom-designed shapes, sizes, or arrangements of the enclosure for various benefits, such as providing enhanced toe or heel kick space.

Thus, reactionary forces applied to the platform connection via the enclosure base and forces exerted on the enclosure when pressurized based on its volume and related surface area against which pressure is applied can be kept low along with providing other significant benefits, such as low-profile enclosure designs, enhanced safety, and increased design flexibility and customization options. Low profile arrangements can provide for small profile DAP system implementations that allow for greater utilization within facilities, and naturally enhance user freedom of movement, such as related to arm swing and leg kick.

In other words, not only are drawbacks and challenges of conventional DAP systems avoided with respect to reinforcement structures and protective components, but size and overall efficiency of unweighting functionality are enhanced along with various additional benefits. These enhancements and improvements can permit further optimizations and customizations in the absence of significant force-mitigation concerns and limitations, such as a low-profile enclosure having a small attachment size, shape and area at its base permitting the inflatable enclosure 110 to fit within the profile of the corresponding exercise device 160 while inflated and provide intended exercise operations.

FIGS. 3-5B: DAP System and Enclosure Overview

Referring again to FIG. 3A along with FIGS. 3B-5B, an inflatable enclosure 110 is generally shown in an inflated condition operating as part of a schematic representation of a DAP system 140. DAP system 140 generally includes a support platform 142 to which a base portion of inflatable enclosure 110 is securely attached in a sealed or airtight connection with an inflation device (not shown), as well as a generic exercise device 160. Although DAP system 140 is illustrated as having a support platform 142 arranged as a structure enclosing the exercise device 160 and supporting a base connection with the enclosure, it is understood that the enclosure could be attached directly to the exercise device, supported by a skeletal frame or other attachment arrangement without partially or fully enclosing the exercise device, and/or via other frameworks or arrangements that operatively secures a base portion of the inflatable enclosure for unweighting operations of the user for the exercise device while inflated. However, the general arrangement of DAP system 140 shown enables various beneficial features, such as arranging the base portion of the inflatable enclosure vertically over exercise device 160 along with aligning the base portion with an access region 162 for the exercise device that allows a user to access the exercise device and perform exercises via the exercise device.

In addition, as depicted in FIG. 3A the support platform 142 provides a secure support surface 144 closely arranged about the base of the inflatable enclosure 110, which as described in greater detail below along with DAP system of FIGS. 24-30 can firmly attach the base of the inflatable enclosure in an airtight connection permitting independent support of the enclosure when inflated to extend from its base upward in a vertical direction for supporting a user above the access region of the exercise device. Further, the inflatable enclosure 110 in such an orientation and arrangement operatively supports itself and the user within in a low-profile, space-saving environment about the same size as the profile and environment as for using the exercise device apart from the DAP system 160.

As further shown in FIG. 3A, a top port 130 can be formed through a top portion of the inflatable enclosure 110, which as shown can be arranged generally in a vertical alignment with, and above the exercise device 160 and corresponding access region 162 through an inner space of the inflatable enclosure. A top port frame 132 can be installed proximate top port 130 for securely supporting a user in an airtight, supported arrangement with the inflatable enclosure 110. In addition, top port frame 132 can be formed as a rigid frame that maintains a low surface stress, mechanical equilibrium arrangement of the inflatable enclosure 110 as described hereafter. In short, the top port frame 132 can be affixed to top port 130 in an outer, or inner/outer rigid support arrangement that transmits tensile and compressive forces, and any other stresses and strains encountered in the top portion of the inflatable enclosure proximate the top port frame, which can maintain the mechanical equilibrium arrangement with internal pressure of the enclosure as would be provided in the absence of top port 130 in the inflated condition. The radial lines shown for the inflatable enclosure 110 are representative to an extent of a surface stress arrangement that can be provided through the enclosure while inflated, for which the top port frame 132 can maintain despite top port 130 interrupting a portion of the enclosure surface. However, the radial lines are shown only for schematic, illustrative purposes without denoting any tension members, reinforcements integrated in the enclosure surface, embedded fibers, isotensoid supports and the like. Rather, the radial lines are indicative of the innovative, low surface tension arrangement of the inflatable enclosure, which enables many of the numerous beneficial features, improvements, and aspects of inventive subject matter described herein.

Moreover, the radial lines 124 generally represent meridional stress orientations that can be associated with zero or low hoop stress arrangements, such as a low hoop stress dome structure or overall low hoop stress shape. As discussed further below, the use of zero or low hoop stress arrangements can enable many and various beneficial features for inflatable enclosures for use with DAP Systems, such as features pertaining to low profile shapes, low and balanced force arrangements, and enhanced freedom of movement for the user internally (lack of leg kick interference) and externally (arm swing clearance).

Referring now to FIGS. 3B-5B, schematic views of inflatable enclosure 110 of FIG. 2 are shown including depicting operative features of the enclosure pertaining to surface stress and pressure load parameters when fully inflated. Inflatable enclosure 110 illustrates aspects and features pertaining to innovative ranges, types and classes of inflatable enclosures developed by the inventors, which provide beneficial features for use with DAP Systems that uniquely enable solutions and improvements for overcoming drawbacks and challenges that have plagued conventional DAP systems for many years. Note that inflatable enclosure 110 and other inflatable enclosures described herein are sometimes described in accordance with various engineering and technical theories that can be helpful for describing similar or related aspects and features pertaining to inventions described herein. However, it is understood that the aspects and features described along with example implementations, arrangements and schematic representation may or may not fall within any particular or general engineering or technical fields, theories, concepts, or related terminology.

Rather, the inventors have independently developed, tested, created, and identified the innovative aspects and features described herein along with the examples shown and described. Stated differently, the inventors independently developed the subject matter described herein based on their knowledge and experience in the field coupled with significant personal design, testing, and development efforts without ascribing to particular technical fields.

In general, inflatable enclosure 110 is arranged as a low-pressure deployable pressure structure in that it is configured for repeated inflation and deflation to a pressure nominally greater than atmospheric pressure, such as 15.0 psig. or less, generally 5.0 psig. or less, and typically 1.5 psig. or less. The inflatable enclosure is formed from flexible sheet material, such that it is collapsible when not inflated and does not become operative for providing unweighting support until it reaches equilibrium in the inflated condition.

Although enclosure 110 may share similar features with and may be able to provide similar functions as a pneumatic lift system that typically relies on an elastomeric enclosure and can provide lift functions as soon as sufficient pressure has been applied, the enclosures operate on different principles. An elastomeric lift system operates according to relatively simple principles of linear shell theory, in that stresses in the elastomeric-loaded enclosure via increasing pressure produce responsive changes in the enclosure shape, and when the internal pressure times the lift cross-sectional area exceeds the load, the shape continues to change as the load is lifted. In contrast, inflatable enclosure 110 is configured to operate with DAP Systems for providing unweighting support to a user actively engaged in exercise activities rather than provide lifting operations, and relies on a substantially inelastic flexible sheet arrangement that does not become pressure-loaded and generally able to follow linear shell theory until it reaches equilibrium in the inflated condition.

Inflatable enclosure 110, however, is configured to operate as a substantially air impermeable structure, which includes the enclosure forming airtight connections with an inflation source and through any openings such as with the user through top opening 130. Further, inflatable enclosure 110 is arranged as a substantially geometrically continuous enclosure with the exception of intentional openings formed therein. Otherwise, inflatable enclosure 110 operates according to complex stress distribution principles-based factors such as its shape, shape interruptions including openings for providing user support and connecting with the DAP System, and material properties of its sheet material that creates its thin shell such as whether the material is isotropic and includes filamentary or other supports.

Aspects and features of inflatable enclosure 110 and other inflatable enclosures described herein and variations of the same may likewise appear to share similarities with pressure vessels including inflatable or flexible pressure vessels. However, inflatable enclosure 110 is configured to provide unweighting support for a user while maintaining low internal inflation pressures, rather than being configured for extended storage of gases or fluids; for operating in a pressurized state for long time periods, such as weeks, months, or years; and/or operating with or maintaining high internal pressure conditions upon which pressure vessel calculations and evaluations are direct to meet. Further, inflatable enclosure 110 is generally formed from substantially inelastic flexible sheets rather than elastic material reinforced with embedded tensile members, over-wrapped by filament structures, and/or including isotensoid members for tensile pressure reinforcement, which fail to meet parameters for evaluations according to pressure vessel principles.

That said, it is understood that configurations of inflatable enclosures according to aspects and features described herein including inflatable enclosures used with DAP Systems can include flexible sheets having reinforced sheet arrangements, which configurations are intended to fall within the scope of inventions described herein. In particular, configurations of flexible sheet inflatable enclosures having reinforced arrangements are intended to fall within the scope of the inventions described herein, particularly for arrangements addressing custom functionality or needs, or for providing additional features requiring reinforcement such as adjustments for particular users, or for enhancing operations of the inflatable enclosure, as well as for general arrangements such as flexible sheet materials including additional material layers combined with or part of the flexible sheets, separate or integrated reinforcement or adjustment members including tension members and cables, and/or isotensoid supports. Nonetheless, the addition of general reinforcements to inflatable enclosure examples, aspects and features described herein would fail to meet reinforced pressure vessel parameters absent significant reinforcements like filamentary overwrapping, which would render such enclosures unable to provide the intended functionality of unweighting operations. As such, configurations, shapes, and arrangements of flexible sheet inflatable enclosures for use with DAP Systems present different challenges compared with analogous enclosures.

Inflatable enclosure 110 can be formed from substantially inelastic sheet material, such an isotropic fabric formed from fibers, threads, mesh materials having sufficiently high modulus of elasticity, yield strength, and other material properties for withstanding anticipated stresses beyond appropriate safety margins, such as a warp weft nylon fabric. Design considerations for various substantially inelastic sheet materials are intended to fall with the scope of aspects and features of inventions pertaining to inflatable enclosures described herein, such as warp/weft orientations, reinforced fiber materials, directional fiber orientations or integrated reinforcement, and the like. Further, it is contemplated that particular configurations and arrangements of inflatable enclosures according to inventive aspects and features described herein can include and make beneficial use of custom designed materials or weaves, as well as use of supplemental or specialty materials like elastomeric coatings for reinforcement regions or airtight connections, or the use of appropriate, sufficiently flexible, composite materials.

Figure 4B:
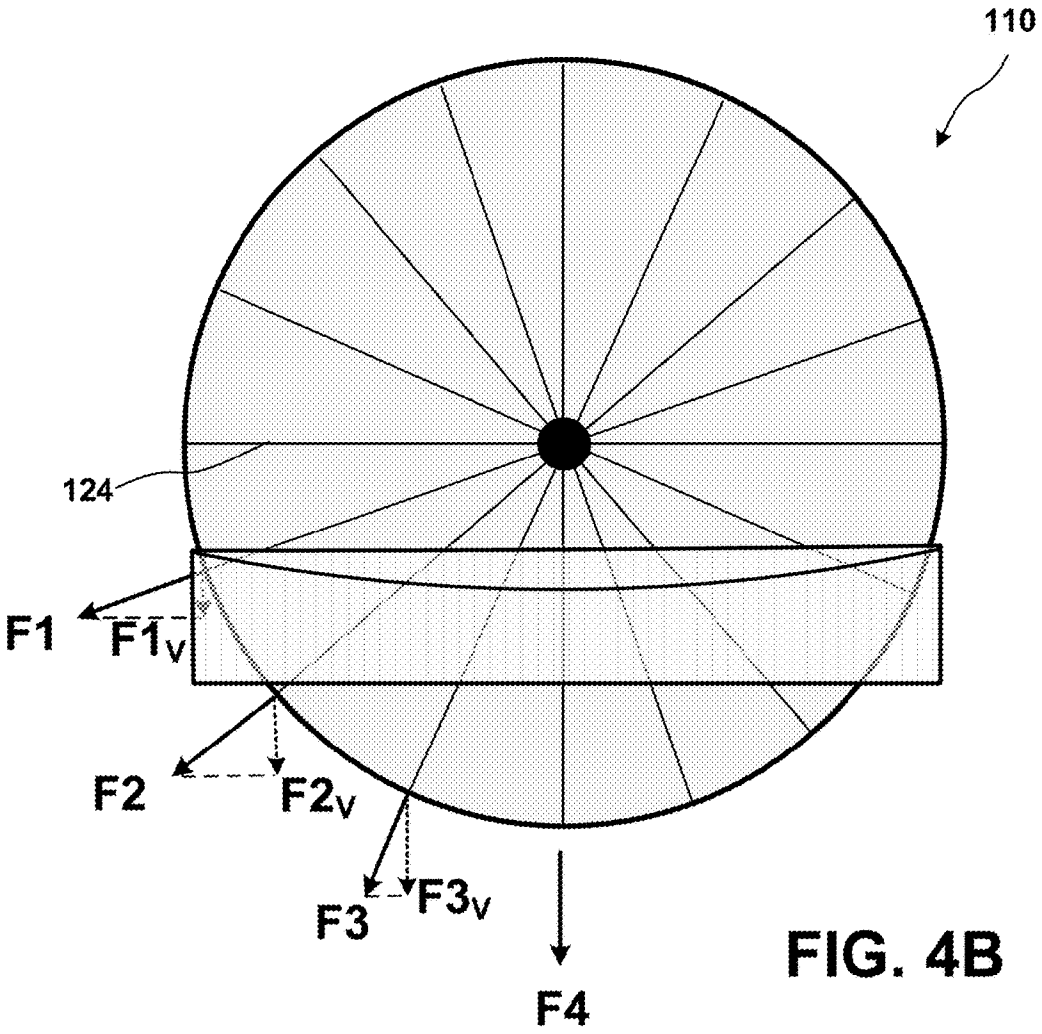
FIG. 4B is an elevation view of the same according to line 4B-4B showing potential interface options for the enclosure base with a platform and/or exercise device.
Figure 4A:
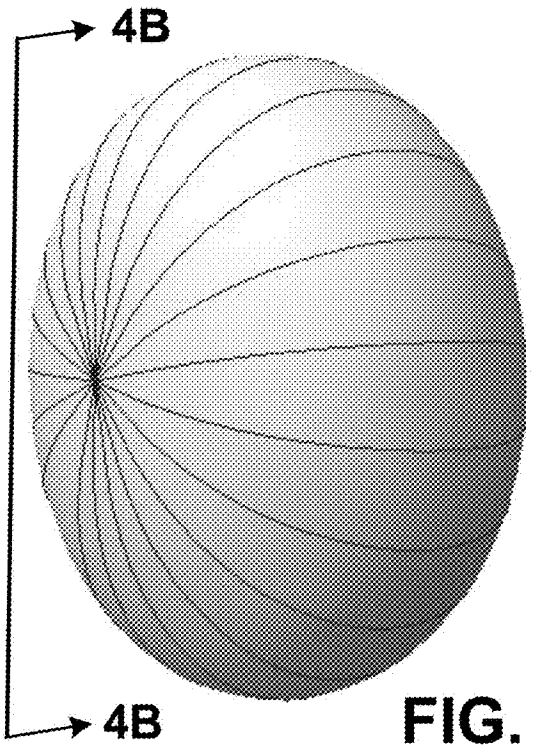
FIG. 4A is a perspective view of the inflatable enclosure of FIG. 3B including view line 4B-4B.
Figure 4C:
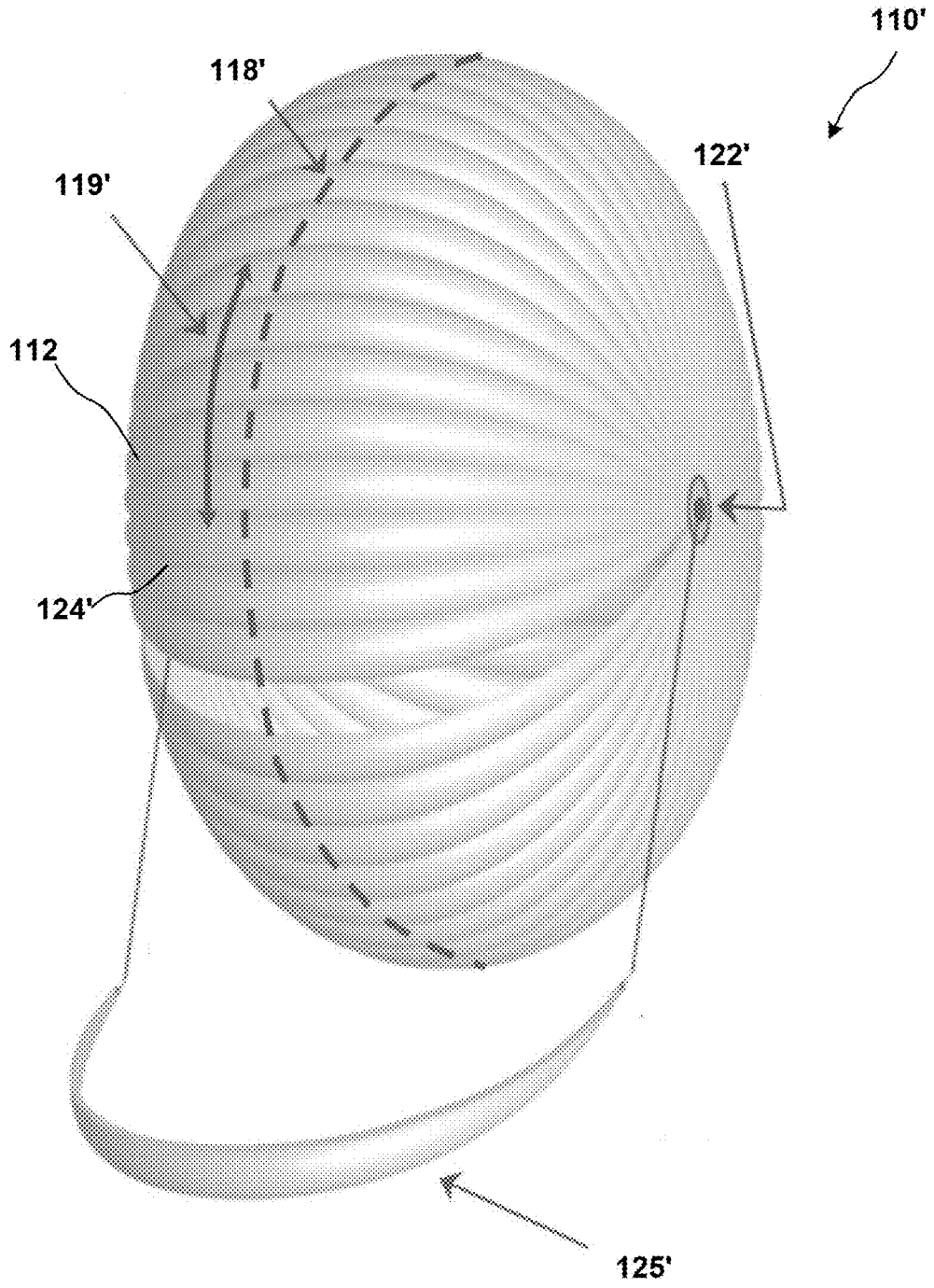
FIG. 4C is a front perspective view of a schematic representation of an alternative arrangement of the inflatable enclosure of FIGS. 3A to 4B.

As best shown in FIGS. 3A and 4C, inflatable enclosure 110 has been configured to have a shape (including a portion of the overall shape) that, when inflated, has a zero or low hoop stress and a low surface tension arrangement that is similar to modified pressure vessel configurations, such as a cylindrical pressure vessel having a zero-cylinder length (mated end caps). Although similar designs may exist for rigid, fully closed pressure vessels or isotensoid pressure vessel arrangements, implementing similar designs in low-pressure, flexible sheet inflatable enclosures for DAP systems present additional challenges. For example, shape interruptions, such as top opening 132 and a base opening and inlet, disrupts stresses for an enclosure that may generally follow principles for analogous enclosures. In addition, the use of inelastic flexible material as appropriate for unweighting functionality and configuring the enclosure for use in a low pressure environment of a DAP system render analogous principles and evaluations inapplicable, which are based on rigid structure assumptions and directed to solutions for determining corresponding rigid shapes, thicknesses, material properties and the like vs. a collapsible, thin shell system reliant on inflation state to define geometry and become operative.

However, the inventors been able to identify innovative aspects and principles for providing inflatable enclosures shapes and designs for use with DAP systems that can provide significant benefits and enhancements compared with conventional DAP Systems. For example, aspects and features of inflatable enclosure described herein can enable low-profile unweighting structures for the DAP System, which reduce drawbacks and challenges related to controlling and mitigating high forces encountered by conventional DAP Systems. Further, zero or low hoop stress arrangements applicable to inflatable enclosures or portions thereof described herein can further increase safety for DAP System users by supporting users within zero or low hoop stress regions of the enclosure shape. In addition, aspects and features of inflatable enclosures described herein can provide low cross-sectional areas for vertical support provided for the user along with related low contact areas for reaction forces on the system, which simplify the structure and operations for the unweighting enclosure and overall system, reduce overall size and profile, and avoid corresponding wear and structural support requirements.

Figure 3B:
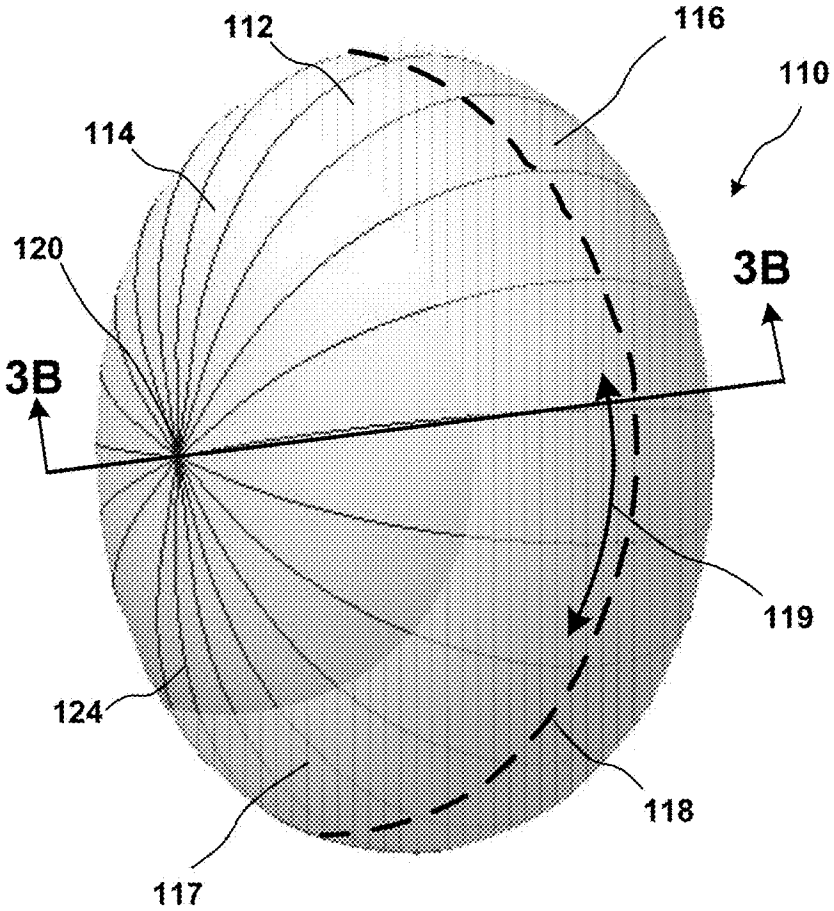
FIG. 3B is a perspective view of the inflatable enclosure of FIG. 3A shown apart from the DAP System.

Referring now to FIGS. 3A and 3B, inflatable enclosure 110 is generally shown in FIG. 3A independent of a DAP System, which can be the same as the general representation of an inflatable enclosure for a DAP System as shown in FIG. 2. Inflatable enclosure 110, while in the inflated condition, generally includes a pair of opposing, circular, dome-shaped structures 114, 116 mated to each other at their concave faces along corresponding perimeters to form equator 118. Fabrication of inflatable enclosure 110 and related enclosures will be described along with other examples starting with example enclosure of FIGS. 8A-9D, as well as discussed along with the example enclosures thereafter. FIGS. 3A and 3B represent inflatable enclosure 110 while in an inflated condition, during which inflatable enclosure 110 forms a low surface-stress pressure structure having very low hoop stress (theoretical zero hoop stress structure) along equator 118, as well as a low stress band 117 along the radial edge portions of the enclosure.

Inflatable enclosure 110 while in the inflated condition can meet the shape requirements for a cylindrical pressure vessel having a zero-length cylinder, but does so with an isotropic skin/surface lacking isotensoids or other tensile reinforcing members, and of course is under low pressure. Nonetheless, inflatable enclosure 110 meets the theoretical zero/low hoop stress arrangement as would a cylindrical pressure vessel lacking a cylinder, such that the end caps (circular domes 114, 116) are mated to each other without any or little hoop stress. Inflatable enclosure 110 in its arrangement as a collapsible, thin shell enclosure can be considered to be a zero or low hoop strength pressure structure rather than a pressure vessel, which nonetheless can provide a zero/low hoop stress shape capable of supporting significant beneficial features as an inflatable enclosure for DAP System in the inflated condition.

As noted above, meridional or radial lines 124 shown in FIGS. 3A and 3B are not physical structures of the inflatable enclosure. Rather, lines 124 identify the location and orientation of the load or stresses on inflatable enclosure 110 or zero/low hoop stress portions thereof, in which all stresses are oriented in the meridional direction extending between the left pole 120 and the right pole 122 and in a perpendicular direction across equator 118. FIG. 3B further illustrates the relationship between the meridional stress/load orientations with respect to the poles as a cut view of the upper half of inflatable enclosure 110 along line 3B-3B4 between the left pole 120 and right pole 122. Left pole 120 and right pole 122 together share the overall pressure load acting on the cross-sectional area of the inflatable enclosure, which is indicated as $F_P$ or Force at the Pole for each pole (½ each) that together add up to the overall Force applied according to the internal pressure.

Inflatable enclosure 110 in such a zero or low hoop stress shape can provide significant beneficial features pertaining to unweighting functionality for a DAP System. The arrangement of inflatable enclosure 110 can provide a low-profile (relatively thin in comparison with the circumference of the circular domes) inflatable enclosure for the DAP system. In addition, the zero/low stress equator 118 and low stress radial zone 117 can provide a safe location within the inflatable enclosure for the user to extend through as a top port location and, in particular, avoid being proximate high system forces in the event of a failure or accident.

The arrangement and orientation of the loads and stresses along the meridional direction normal to the equator for inflatable enclosure 110 can be a particularly useful relationship for customizing interconnections and operations of the inflatable enclosure with the DAP system and/or an exercise device. For example, as indicated along with the elevational view of inflatable enclosure 110 in FIG. 4B, the arrangement and orientation of meridional loads/stresses can be beneficial for evaluating attaching the inflatable enclosure with a particular base support for an exercise device or a DAP System, which may involve considering limitations for securing the inflatable enclosure to the base support, such as size or structural strength/limitations concerns. The simplified meridional load/stress arrangement for the inflatable enclosure 110 can permit relatively simple determination or estimation of load levels that could be applied to a platform having limited space or concerns about structural integrity.

In addition, such an arrangement can allow for expanded usage options for the inflatable enclosures and DAP Systems, such as enabling secure attachment of the inflatable enclosure on an existing exercise device and/or platform including attaching to curved or other surface profiles. Further, it can permit enhanced customization for installation of the inflatable enclosure, and/or allow for modifying the secure attachment arrangement when required or beneficial. For instance, attachment of the inflatable enclosure to a new type of exercise device or a different platform having less available space could allow for, and warrant, preparing a curved base support for engaging the meridional loads and stresses at enhanced engagement angles that can improve strength of a new or modified installation even if there is an associated size reduction. Based on a primarily meridional orientation of loads/stresses along the enclosure surface 112, a corresponding load could be determined at a base attachment according to the vertical force components across the base attachment.

Referring now to FIG. 4C, an optional arrangement for an inflatable enclosure 110' is shown, which generally includes the same aspects and features discussed above along with inflatable enclosure 110, except pertaining to the arrangements and use of lobed structures 125'. Lobed structures 125' are an optional arrangement for use with inflatable enclosures, which create explicit individual meridional links that ensure directional control of the loads and stresses along the meridional chords between the poles. In addition, each meridional segment has 'lobed structure' that is curved across its width in the longitudinal direction, which increases surface area in contact with the internal pressure and increases surface strength of the inflatable enclosure based on the curved individual meridional chords. Although overall strength of the inflatable enclosure can be enhanced along with guiding stresses/loads to maintain the zero-hoop stress arrangement, the use of lobed structures can reduce flexibility of the inflatable enclosure and the extent of deflation when not in use. However, it is understood that the use of lobed structures and other structural or geometric modifications pertaining to sheet materials and enclosure surface 112/112' can be desirable for in some circumstances as implementation options for inflatable enclosure with DAP systems, which fall within the scope of inventive concepts described herein.

Figure 5A:
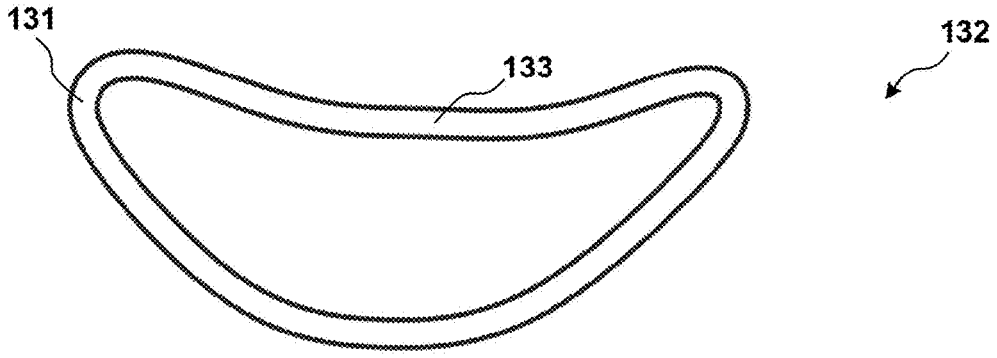
FIG. 5A is a perspective view of an example inflatable enclosure according to aspects and features of inventive concepts discussed herein.
Figure 5B:
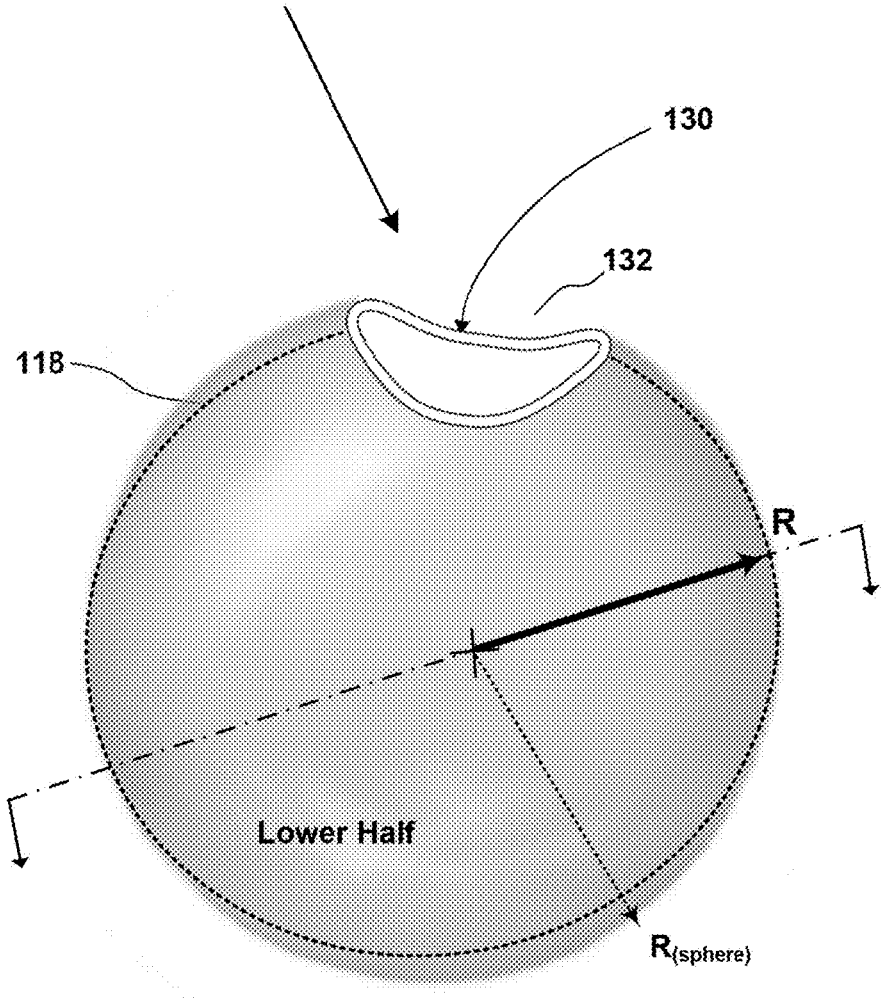
FIG. 5B is a perspective view of an example seal frame used with the inflatable enclosure of FIG. 5A.

Referring now to FIGS. 5A and 5B, inflatable enclosure 110 is generally shown along with a closer view of top port bracket 132 for the DAP System example of FIG. 3A. Inflatable enclosure 110 includes the same aspects and features of inflatable enclosure 110 discussed above, and represents the same general inflatable enclosure arrangement. However, the schematic information has been removed, such that the meridional or radial lines are not shown nor are there indications of the enclosure having zero or no hoop stress portions or an overall low hoop stress arrangement. For reference purposes pertaining to description of FIGS. 7A and 7B and thickness/depth relationships for some of the inflatable enclosures discussed herein, note that the radius R of the circular shape is identified in FIG. 5B.

FIGS. 5A and 5B illustrate installation of the top port bracket 132 along with interrupting the zero/low hoop stress arrangement via the top port 130. As discussed above in general and along with FIGS. 2, 3A and 4C, the configuration and resulting zero/low hoop stress arrangement of the inflatable enclosure 110 or portions thereof when in the inflated configuration can provide many benefits and enable beneficial modifications and customizations that can flow from the arrangements and orientation of load/stress properties. These properties generally occur as a result of aspects and features discussed above pertaining to inflatable enclosure 110 and related configurations, such as a geometrically continuous shape, the use of a substantially inelastic sheet material, and a shape conducive to mechanical equilibrium and balanced force arrangements, among others. These and other aspects and features were identified by the inventors and implemented along with inflatable enclosure 110 and various other enclosures described herein.

Along with determining these and other aspects and features pertaining to the innovative subject matter described herein, aspects and features were further identified and developed for modifying, interrupting and/or combining aspects and features pertaining to inflatable enclosures that can provide benefits for use with DAP Systems. Interrupting the inflatable enclosure arrangement for creation of a top port to enable user access of the inflatable enclosure for DAP System usage with little no operational impact on the enclosure can be a significant feature for these enclosures. Placement of the top port 130 along the zero/low stress equator 118 can reduce the impact from interrupting the geometric shape and mitigate stress impacts via use of a low stress region. However, maintaining continuity of the load/stress interactions and arrangements can further help ensure adverse impacts are avoided.

Top port bracket 132 is configured as rigid device having sufficient strength to withstand anticipated loads and stresses during use of the enclosure for exercise via the DAP System along with a safety factor. The top port bracket 132 can be installed proximate the interrupted opening prior to inflation to avoid any tears or failures associated with the interruption. Further, the top port bracket 132 can be fully installed within top port opening 130 such that the bracket maintains existing load/stress relationships provided by the enclosure including transmitting loads and stresses at each side of the top port bracket along the equator 118. In addition, top port bracket can be installed proximate a seam along the equator to ensure the seam or other panel attachment is maintained.

Such an arrangement can ensure that both expansive loads and stress, as well as compressive loads and stresses are transmitted through the bracket. Such an arrangement and installation can mitigate any impacts from the geometric interruption and ensure transmission of the loads and stresses. Further, top bracket can be configured to act as an interface with the user while performing exercises along with creating an airtight interface, or reinforce top opening where user interface is coupled directly to the enclosure as in prior art DAP systems. Thus, in addition to withstanding and transmitting loads and stresses along the surface of the enclosure and resulting from internal pressure, the top bracket can be configured to withstand and transmit to the enclosure any impacts received from the user along with ensuring upweighting operations.

It is understood that the example representation for top bracket 132, as with example representations of enclosures and other features described herein, merely describe potential arrangements and implementations for a top port bracket according to aspects and features of inventive concepts described herein. Other arrangements and implementations can be employed that would fall within the intended scope of the application. Similarly, a top bracket (not shown) could be employed along with an arrangement of sleeves or loops (not shown) sewn to the inflatable enclosure 112 proximate top port 130, around the outside of the bag. Such an interconnection of the enclosure with the top port bracket would retain the top port shape with respect to both compressive and tensile loads and stresses encountered at the top port 130, and transmit such stresses and load via interconnection with the rigid top port bracket. Alternatively, the top port bracket may be bonded or glued to the inner or outer surface of the enclosure.

FIGS. 6A-10C: Arrangements Having Zero/Low Hoop Stress

Referring now to FIGS. 6A, 6B and 8A-10C, aspects and features of modified and/or hybrid inflatable enclosure arrangements having zero/low hoop stress features for use with DAP Systems are described, which generally include the aspects and features described above along with inflatable enclosure 110 except as identified. Similar reference numbers generally refer to similar characteristics unless otherwise noted.

Figure 6A:
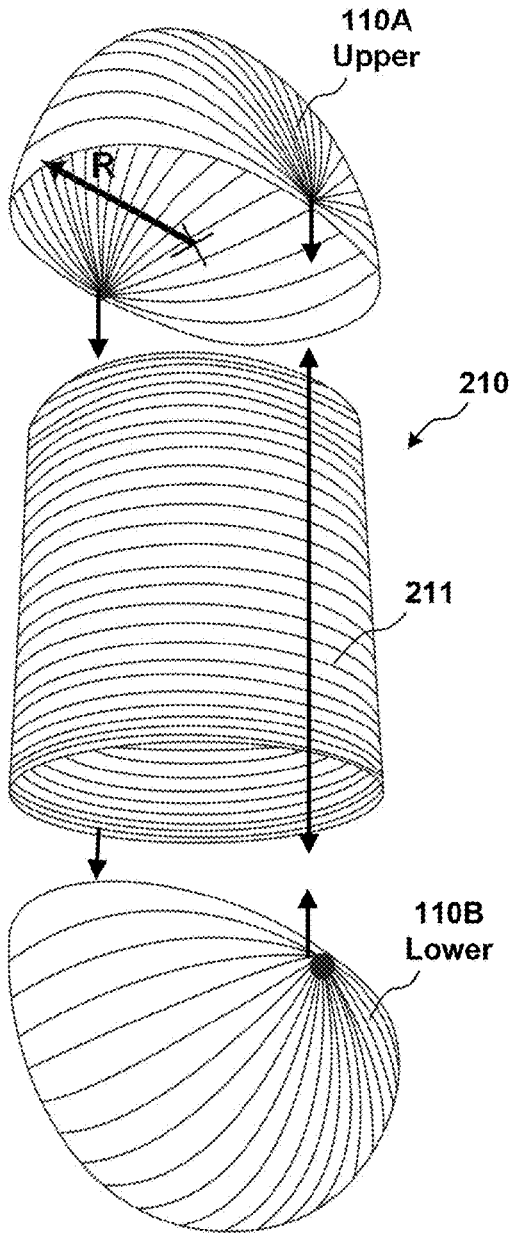
FIGS. 6A and 6B are exploded views of schematic representations of optional arrangements of an inflatable enclosure that can be used with a DAP System, which includes example elongate arrangements of an inflatable enclosure.
Figure 6B:
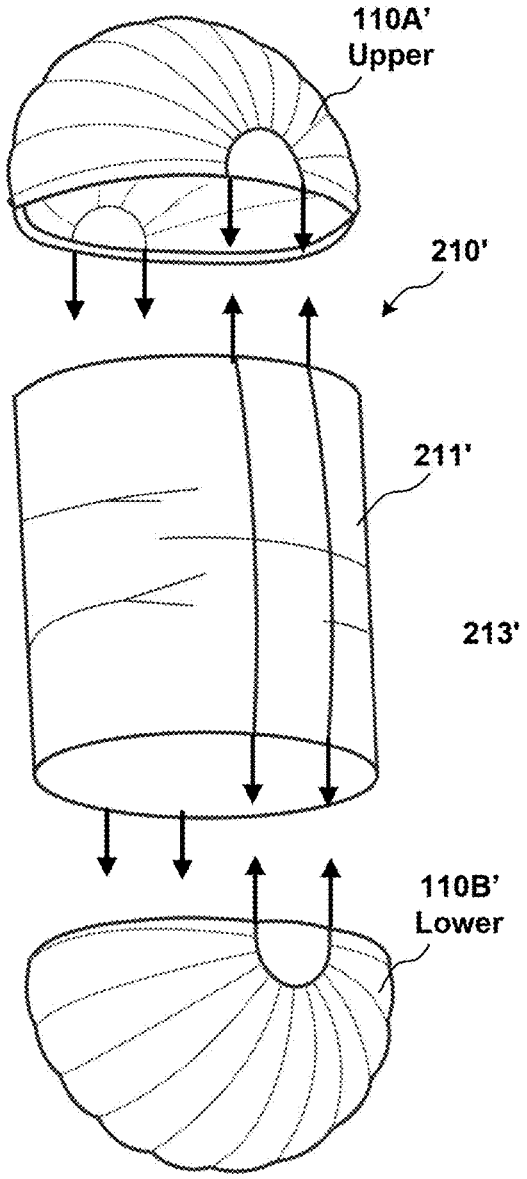

Referring now to FIGS. 6A & 6B, inflatable enclosures 210 and 210' are shown in exploded views identifying primary structural members and interconnections therebetween. Inflatable enclosures 210 & 210' illustrate, as schematic representations, two options out of numerous options for modifying zero/low hoop stress inflatable enclosures and/or creating hybrid inflatable enclosures that include zero/low hoop stress regions or sub-assemblies, if not configuring the entire inflatable enclosure as a zero/low hoop stress arrangement. As shown, inflatable enclosure 210 is generally formed as having the upper half 110A of inflatable enclosure 110 spaced apart from the lower half 110B of enclosure 110 by a cylinder 211 disposed in between. Stated differently, inflatable enclosure 210 demonstrates a design modification of inflatable enclosure 110 aimed at increasing the length of the enclosure while maintaining its zero/low hoop stress arrangement—particularly at the elongate ends of the enclosure. It is understood that the length of cylinder 211 can be very small or short, have an extensive length, or have other desired lengths according to particular design intents.

As shown in FIG. 6A, cylinder 211 has a balanced axial load/stress arrangement for providing a cylinder shape when inflated, which can be beneficial for maintaining a shape and size of an inner cavity for the inflatable enclosure in an extended length arrangement. However, in such an arrangement, the surface of cylinder 211 would be unable to carry and connect the balancing forces applied to the poles of each of upper half 110A and lower half 110B to each other when inflated, and the modified inflatable enclosure design would fail absent further modifications. FIG. 6B illustrates a potential modification for the enclosure design 210 that can maintain structural integrity for the extended arrangement of an inflatable enclosure 210' having zero/low hoop stress dome ends.

Figure 7B:
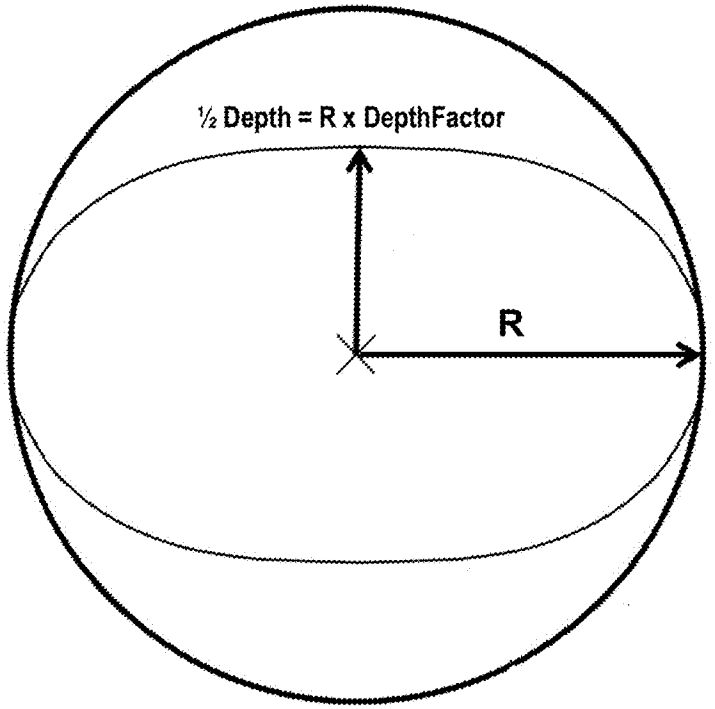
FIG. 7A shows a schematic representation of an example sphere shape that can provide a zero-hoop stress arrangement for an inflatable enclosure according to aspects and features regarding inventive subject matter described herein, and FIG. 7B comparatively illustrates a low-profile arrangement for a zero/low hoop stress inflatable enclosure vs. a spherical arrangement for a zero/low hoop stress inflatable enclosure as described along with FIGS. 3A-5B.

As shown in FIG. 7B, such a modification can include providing a set of primary load-carrying cords 213' at each side of the enclosure connecting the opposing forces applied to the poles of each half 110A' and 110B' to each other across the length of cylinder 211'. However, the use of primary load-carrying cords 213' add cost and complexity to the modified design arrangement. In addition, it can be undesirable to include such cords in an inflatable enclosure for use with a DAP System, which can impact user safety in the event of cord failure and enable drawbacks pertaining to applied force concerns that aspects and features of the inflatable enclosures described herein are directed at avoiding.

Figure 7A:
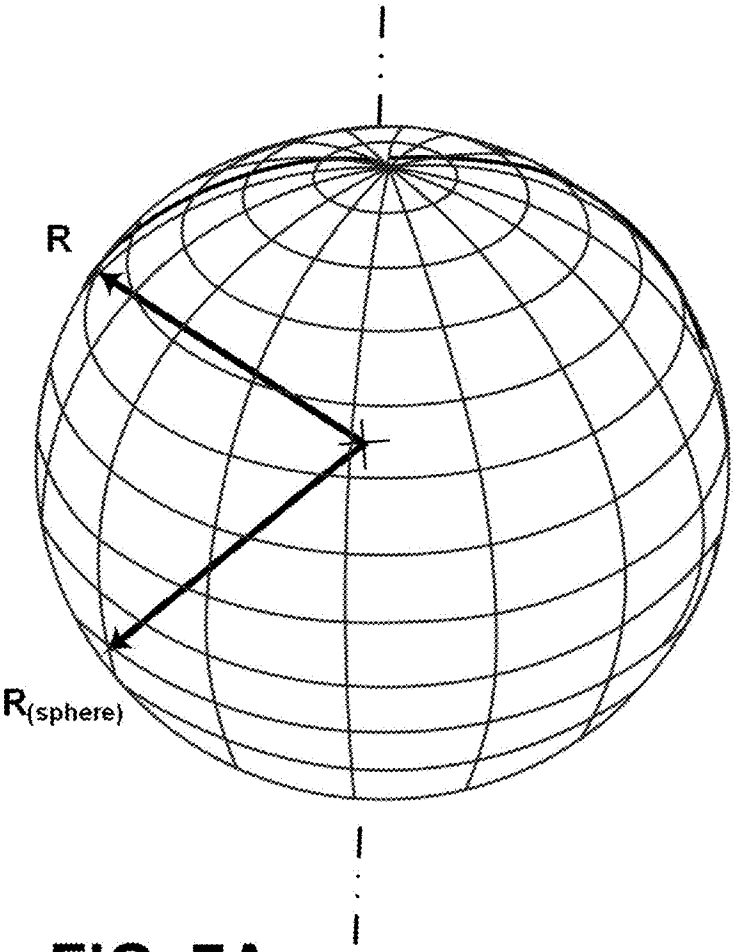

Notably, as shown in FIG. 7A, the upper and lower halves, 110A and 110B, are configured to maintain radius, R, in the end domes formed by the halves, which as discussed hereafter can provide for an operational arrangement of the extended inflatable enclosures 210, 210' along with employing low hoop stress domes within the enclosure. As discussed hereafter along with FIGS. 7A & 7B, radius/width relationships can also be maintained within integral portions of the inflatable enclosures described herein, and similar relationships generally maintained in modified arrangements of inflatable enclosures including in combinations of dissimilar subcomponents. As such, another potential option for operatively enabling modified designs of inflatable enclosures including zero/low hoop stress domes can include forming the inflatable enclosure for the desired modified design using isotropic continuous sheets in a two-sheet or similar arrangement described along with FIGS. 8A-10C.

Referring now to FIGS. 7A and 7B, a schematic example sphere is shown in FIG. 7A, which can also provide a zero/low hoop stress arrangement. The sphere shows both radius, R, which corresponds with the circular radius of inflatable enclosure 110, and a radius for the sphere, $R_{sphere}$, which is the same as radius R for the circular radius of enclosure 110. FIG. 7B shows a two-dimensional comparison of the radius of the sphere and the height or depth dimension for inflatable enclosure 110 described above, which has been identified in terms of half of the depth (½ Depth) of inflatable enclosure 110 in the inflated condition as being a function of the radius, R, for the circular radius of the inflated zero/low hoop stress dome/inflatable enclosure 110 (or of the corresponding sphere) times a Depth Factor.

The Depth factor has been evaluated as being within a range of about 0.55 to 0.65 or 55% to 65% of the circular radius, and typically about 0.6 or 60% of the radius. The relationship between the circular radius for the circular portion of inflatable enclosure 110 and related inflatable enclosures described herein can provide significant benefits with respect to use of inflatable enclosures with DAP Systems including for modified versions of inflatable enclosure 110 and aspects and features of other inflatable enclosures described herein. Further as shown along with FIGS.

8A-8D, such dimensional relationships can permit fabrication of inflatable enclosures including zero/low hoop stress arrangements or portions thereof (e.g., zero/low hoop stress dome ends) when fabricated from a pair of isotropic sheets attached to each other along their perimeters for a modified arrangement even though portions of the modified arrangement may include differing subcomponent arrangements.

Figure 8A:
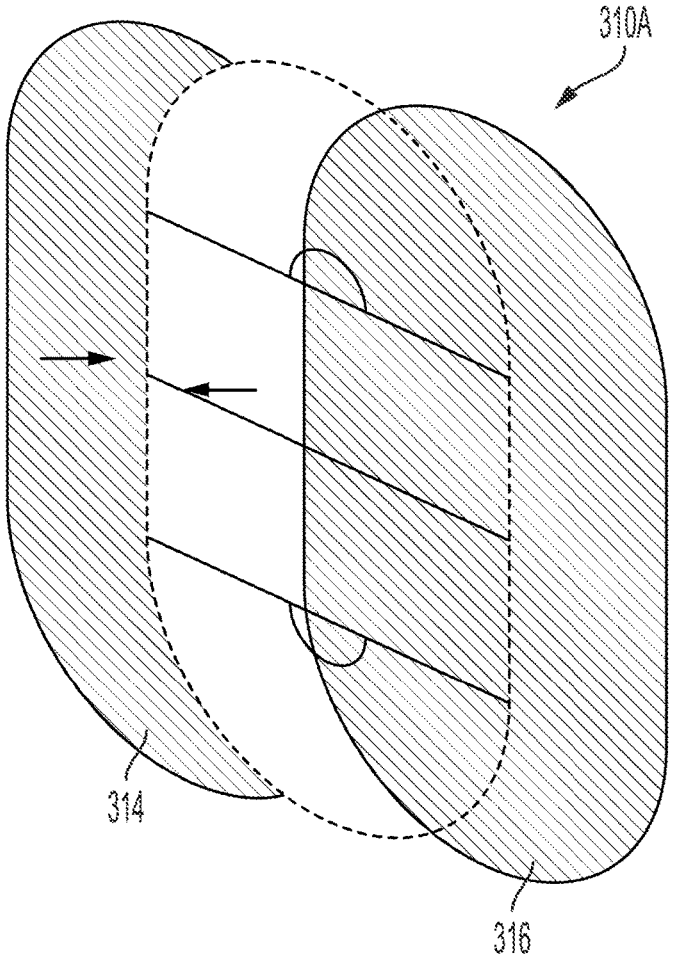
FIGS. 8A-8D are perspective views of the schematic representation for an optional elongated inflatable enclosure of FIG. 6B, which further depicts attaching opposing sheets to form an uninflated version of the enclosure (FIG. 8A) followed by illustrating inflation the optional enclosure arrangement through phases until it is fully inflated (FIG. 8D).
Figure 8B:
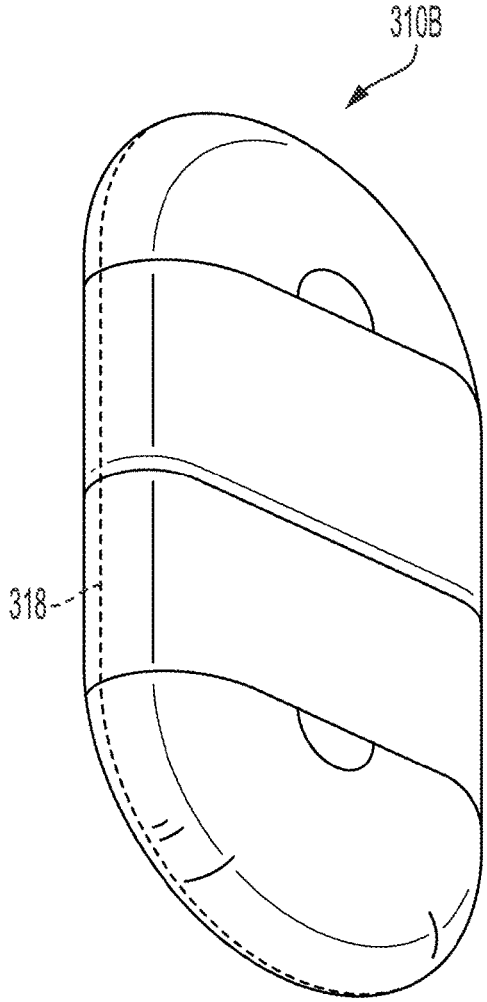
Figure 8C:
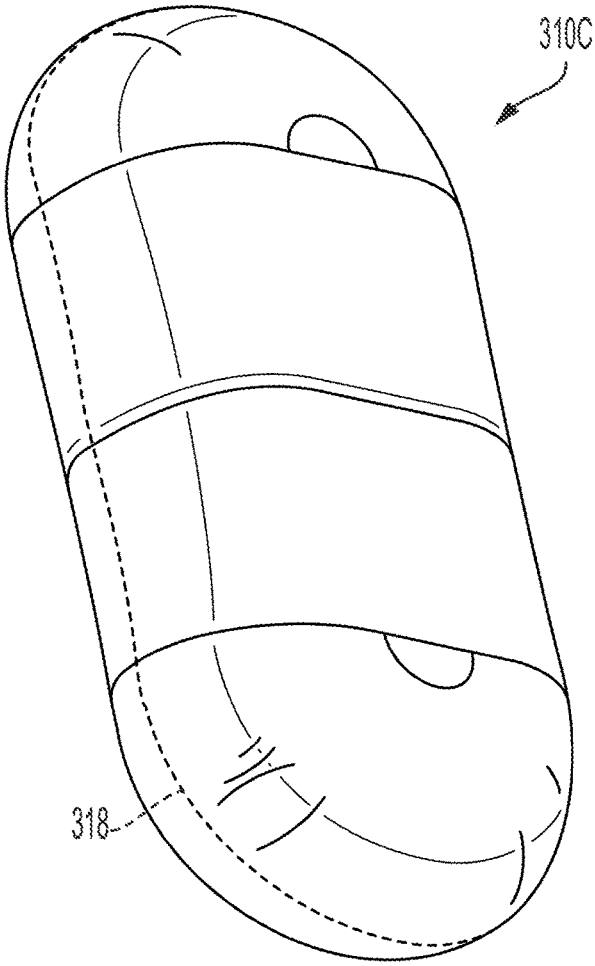
Figure 8D:
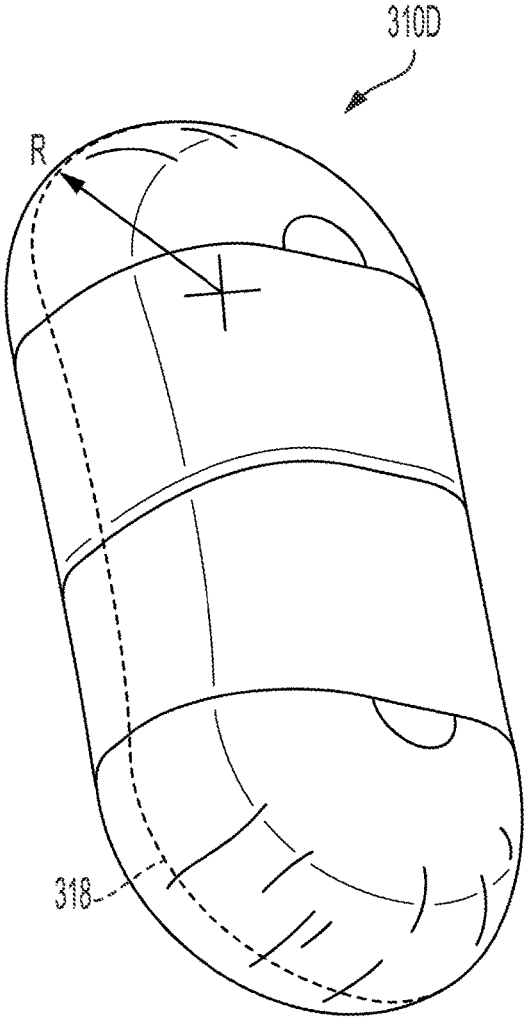

Referring now to FIGS. 8A-8D, the modified arrangement of inflatable enclosure 210 & 210' discussed above along with FIGS. 6A & 6B is generally shown as an inflatable enclosure 310A-D provided in an uninflated state (FIG. 8A; 310A), in two intermediate partially inflated states (FIGS. 8B and 8C; 310B and 310C), and in a fully inflated state (FIG. 8D; 310D). The flat, uninflated state 310A can be fabricated from a pair of opposing isotropic sheets 314, 316 attached to each other along the extent of their perimeters. Although the sheets have markings indicating the locations of the poles, the zero/low hoop stress dome ends, and the intermediate cylinder of inflatable enclosures 210 & 210' of FIGS. 6A & 6B, the markings are only for illustrative purposes. Rather, the pair of opposing sheets include continuous flexible sheets instead of assemblies of sheet members. Each of the sheets generally outline a corresponding closed shape, which as shown in FIG. 8A can be a closed shape corresponding with a pre-determined zero/low hoop stress shape in the inflated condition, and/or a closed shape corresponding with a pre-determined zero/low hoop stress sub-component shapes in combination with other, non-zero/low hoop stress shapes, such as a cylindrical or other extension shape as desired.

When modified inflatable enclosure 310D is fully inflated as shown in FIG. 8D, the bottom portion corresponding with lower half 110B as a zero/low hoop stress dome end forms 'wrinkles' along the lower curved portion of the equator 318 indicating the lower half maintains its zero/low hoop stress arrangement. As is further shown in FIG. 8D, the upper portion corresponding with upper half 110A maintains its original radius, R, for the circular dome, and the complete inflatable enclosure 310D in the inflated condition appears to have overall Width identified along with FIGS. 8A & 8B. Further, the central region corresponding with cylinder shape appears also to have the overall Depth identified along with FIGS. 7A & 7B rather than a constant radius according to a standard cylinder shape. Thus, inflatable enclosure 310D can be formed as a modified, hybrid inflatable enclosure including domed end portions with zero/no hoop stress characteristics in a custom-designed extended length arrangement.

As such, attaching a pair of isotropic flexible sheets to each other along their perimeters according to a design based on having a pair of zero/low hoop stress domes at opposite ends, and/or arrangements having one, two or several low hoop stress domes can provide an option for providing modified design arrangements for zero/low hoop stress inflatable enclosures for use with DAP Systems, which can include custom-design arrangements for meeting particular needs or special design features while maintaining beneficial options and features pertaining to zero/low hoop stress arrangements. Further, modified design inflatable enclosures having zero/low hoop stress features can be provided for use with DAP Systems via safe arrangements that avoid the high force drawbacks and challenges of convention DAP Systems through the use of a pair of isotropic sheets attached to each other along their perimeters for a desired arrangement.

Figure 9A:
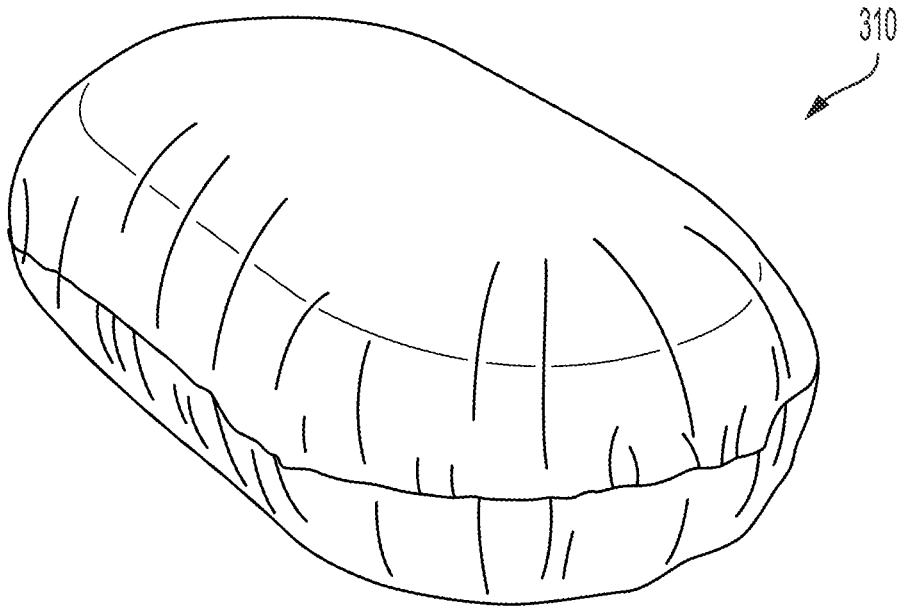
FIGS. 9A and 9B show perspective views of another example of an elongate inflatable enclosure arrangement similar to the examples shown along with FIGS. 8A-8D without schematic representations of subcomponents.
Figure 9B:
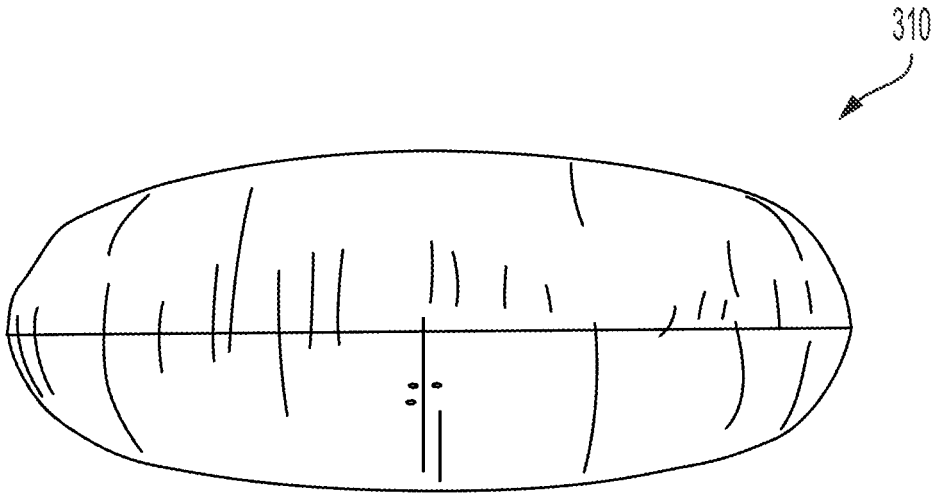

Referring now to FIGS. 9A and 9B, a perspective view (9A) and a side elevational view (9B) are shown for inflatable enclosure 310, which can be created from a pair of isotropic elastic or substantially inelastic sheets attached to each other along their perimeters via a heat seal or attached airtight attachment. Notably, wrinkles are formed at each of the opposing ends indicating that zero/low hoop stress dome end arrangements can be maintained in the inflatable enclosure while in the inflated condition. The examples shown in FIGS. 310A & 310B include the use of elastic isotropic sheets, which can be used for creating inflatable enclosures according to aspects and features described herein. However, elastic sheets and elastic enclosure arrangements in general are difficult for use with DAP Systems, in that elastic arrangements change size in response to pressure changes and thereby interfere with precise controls for providing desired unweighting, and/or interfere with desired height settings for a user of the DAP System.

Figure 10A:
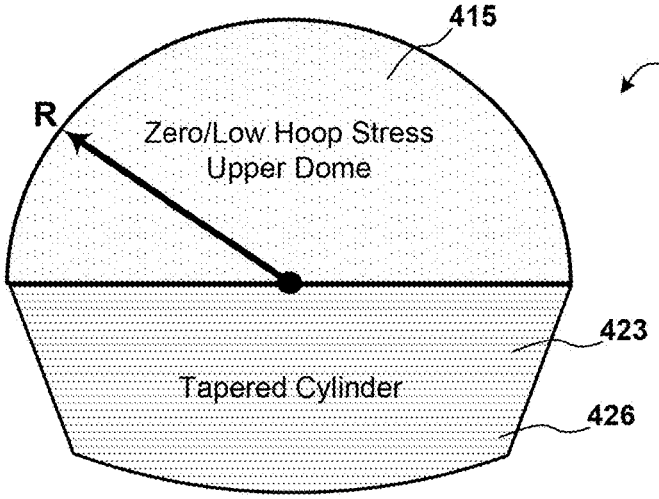
FIGS. 10A-10C are elevation views of a schematic representation of an optional arrangement for an inflatable enclosure according to aspects and features pertaining to inventive subject matter for DAP System inflatable enclosures described herein, which depicts an alternative arrangement for an inflatable enclosure and related fabrication options.
Figure 10B:
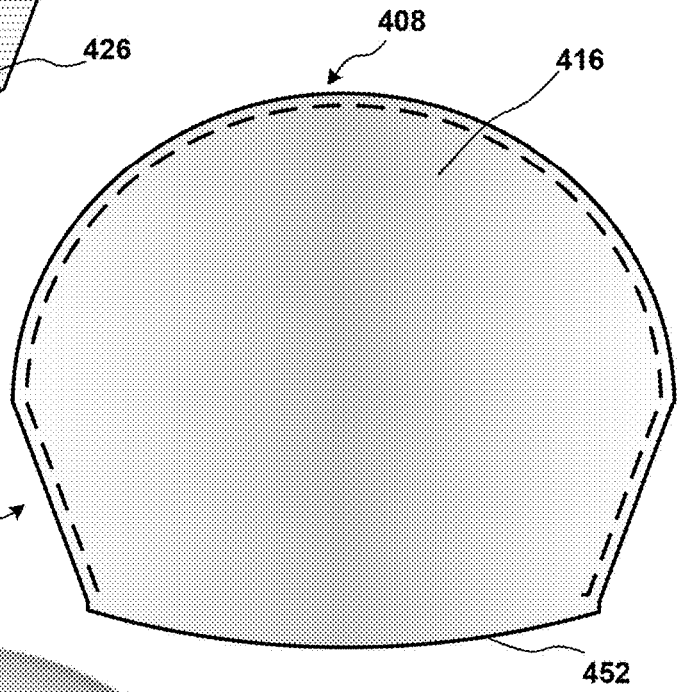
Figure 10C:
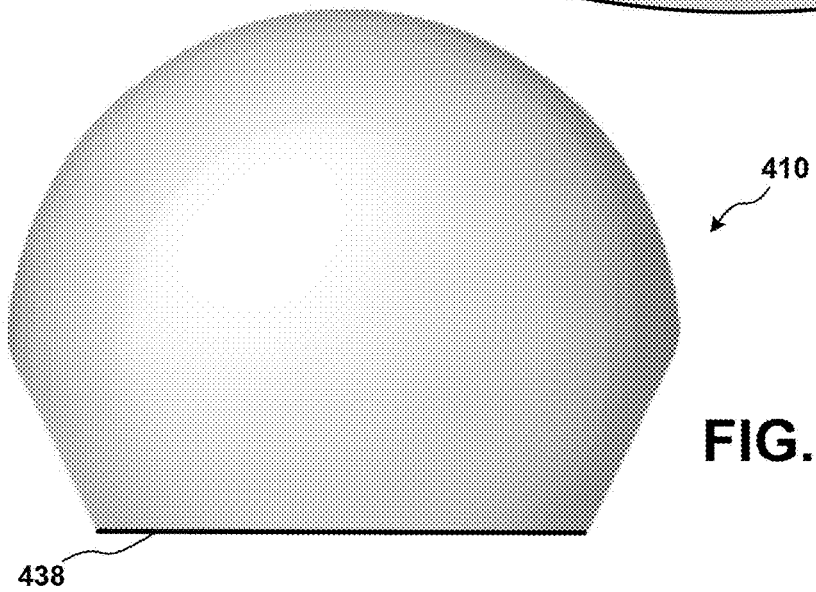

Referring now to FIGS. 10A-10C, a further inflatable enclosure for use with a DAP system in accordance with aspects and features of inventive concepts described herein, which generally include aspects and features of hybrid inflatable enclosures 310 discussed above except as described. As shown in FIG. 10A, inflatable enclosure 410 can be formed in part from a zero/low hoop stress dome end 415 (semi-circular shape) for an inflatable enclosure arrangement, such as like dome end shape 110A described along with inflatable enclosure 210 of FIGS. 6A and 6B, as well as with FIG. 3B of inflatable enclosure 110. The shape for Domed end 415 as a hybrid substructure can be combined with a shape for a tapered version of an axial cylinder 423, which can generally be similar to cylinder 211 or 211' of FIGS. 6A & 6B having a relatively short length a tapered diameter, such as for an upper portion of cone.

FIG. 10B depicts creating a flattened (uninflated) representation of the hybrid shape for the dome end 415 combined with a representation for upper cone 423 as a unitary flat closed shape for the combination of substructures, and forming a corresponding pair of panels or sheets 414, 416 having the flat closed shape from a substantially inelastic isotropic sheet material appropriate for use with a DAP System inflatable enclosure. FIG. 10B further depicts attaching perimeter portions for the unitary flat closed shape of each sheet to each other in a manner similar to the examples of FIGS. 8A-8D and 9A and 9B, except for at a base region 438 of each of the sheets.

Figure 11:
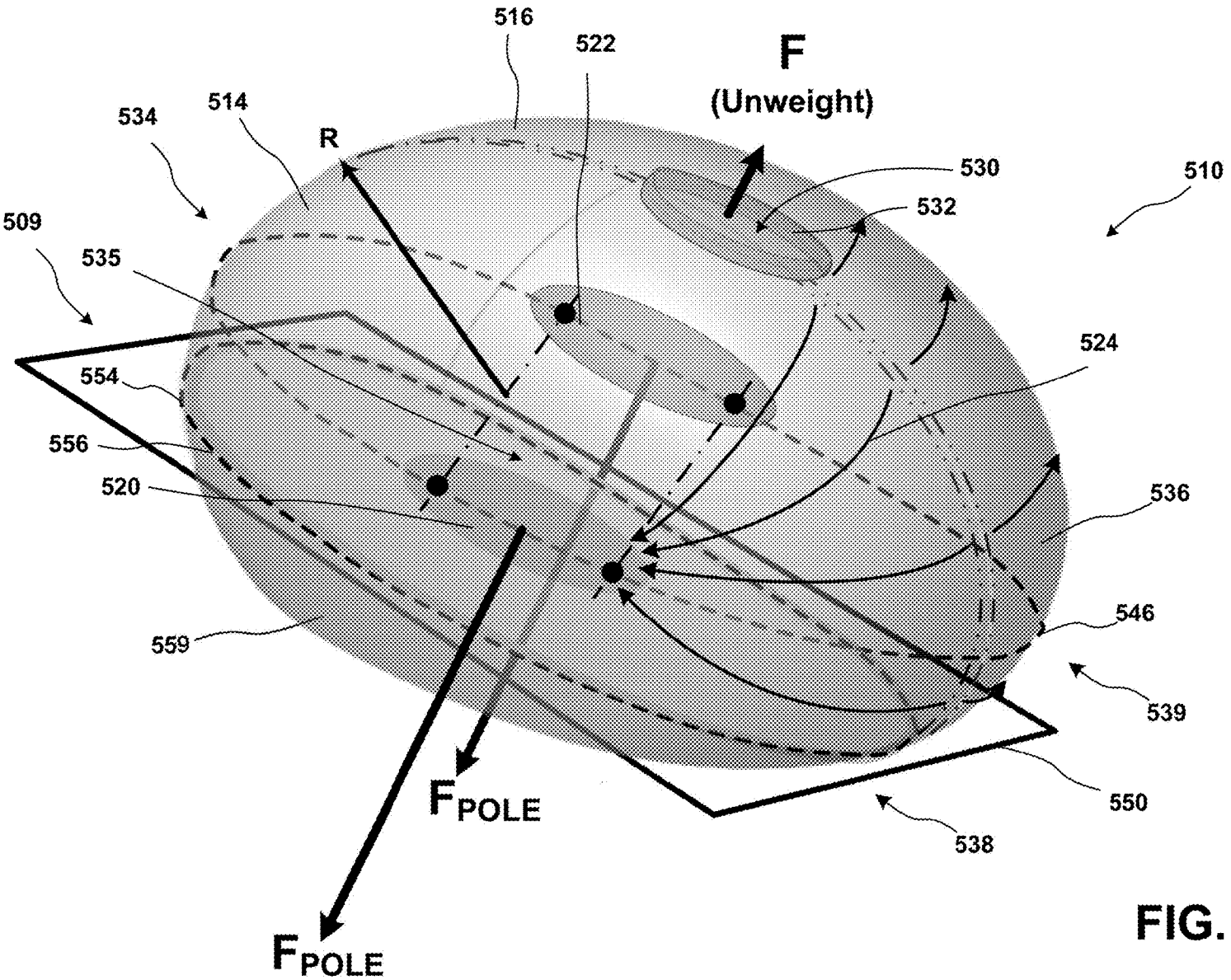
FIG. 11 is a schematic perspective view of a further example of an elongate inflatable enclosure arrangement according to aspects and features pertaining to inventive concepts described herein.

As discussed hereafter along with FIG. 11, a curved path or other curved, linear, curvilinear, or other shaped path at the base region of the flat shape for a perimeter portion 452 can provide a trim path 452 for the flat closed shape of the pair of sheets without requiring explicit trim actions or material removal. The trim path 452 of each flat closed shape can be configured to form a base opening 454 for a corresponding inflatable enclosure 410 fabricated by the pair of sheets having a flat closed shape and attached to each other along their perimeter portions as shown in FIG. 10C. Aspects and features related to concepts of a trim path and base opening are described hereafter in further detail along with FIG. 11-12C.

Figure 12B:
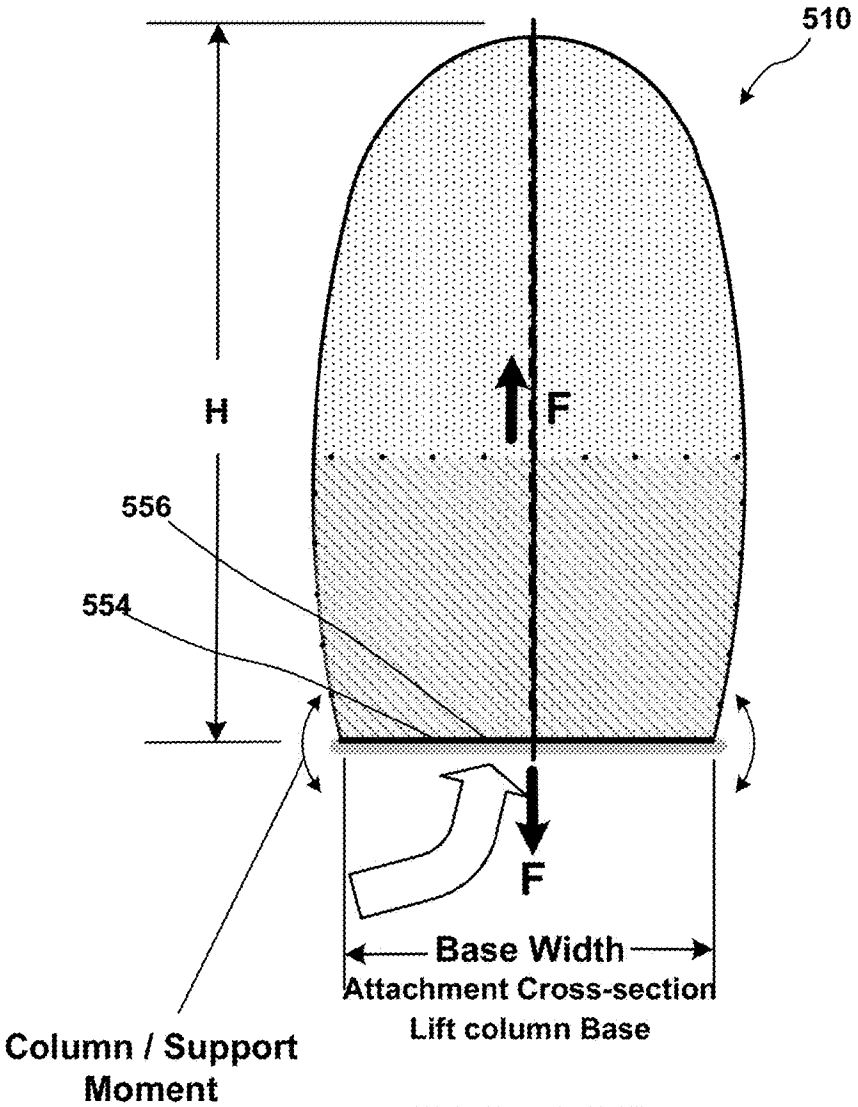
FIGS. 12A and 12B are end views of the inflatable enclosure of FIG. 11 shown with and without a bottom region.
Figure 12A:
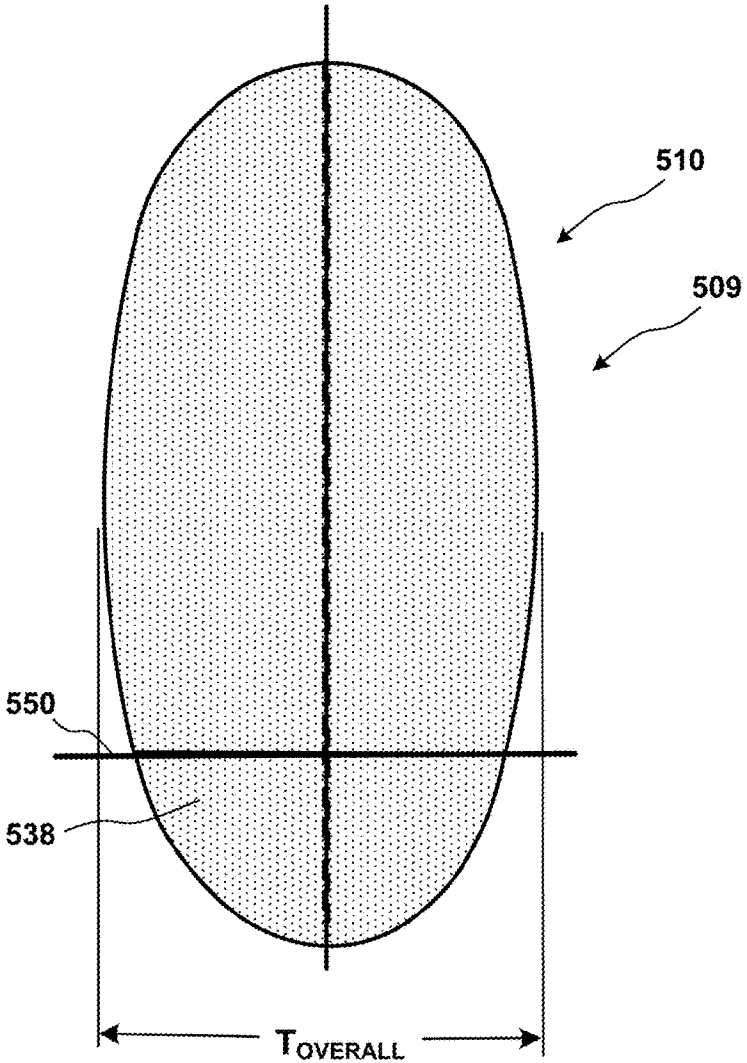
Figure 12C:
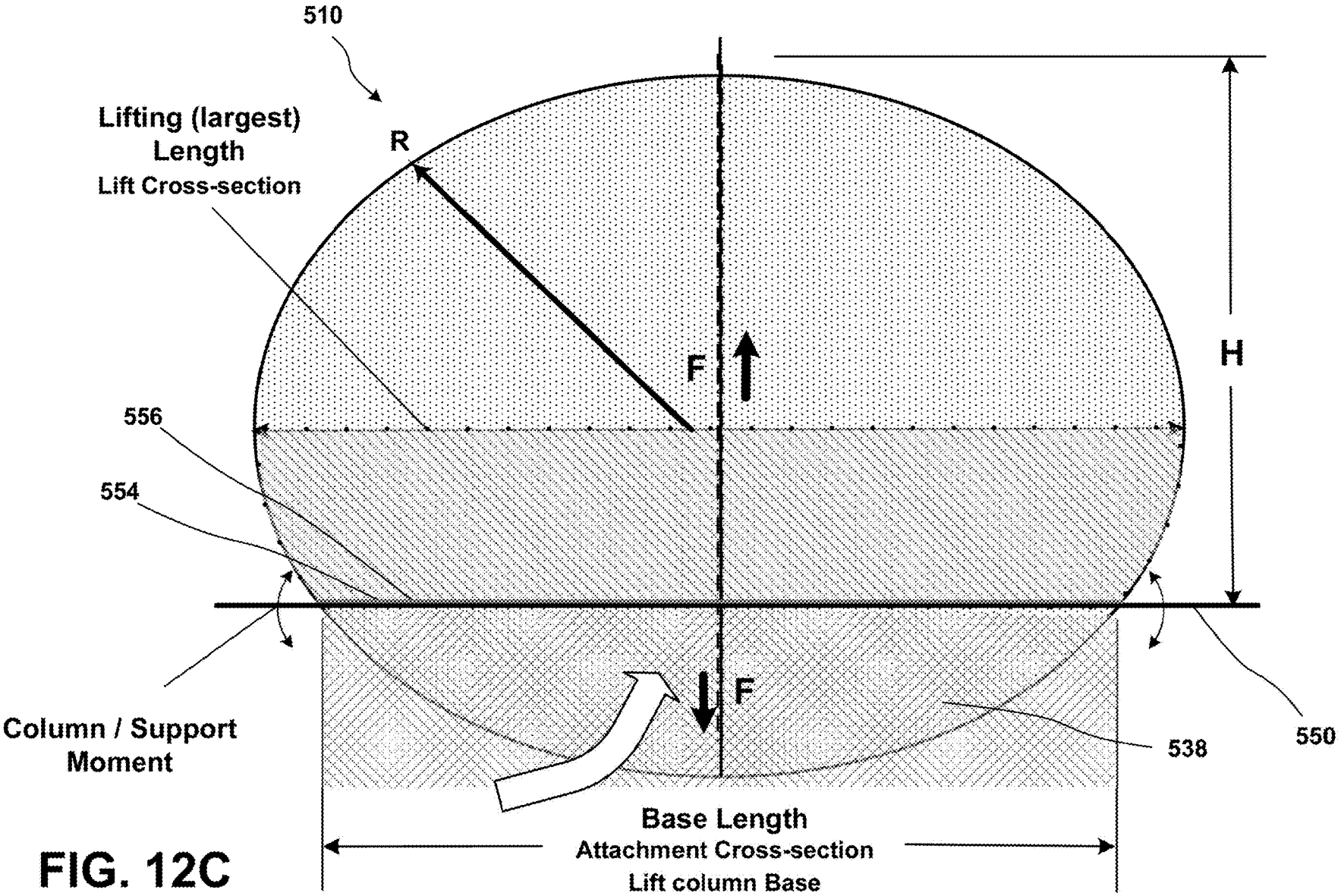
FIG. 12C is a side view of the inflatable enclosure of FIG. 11.
Figure 13:
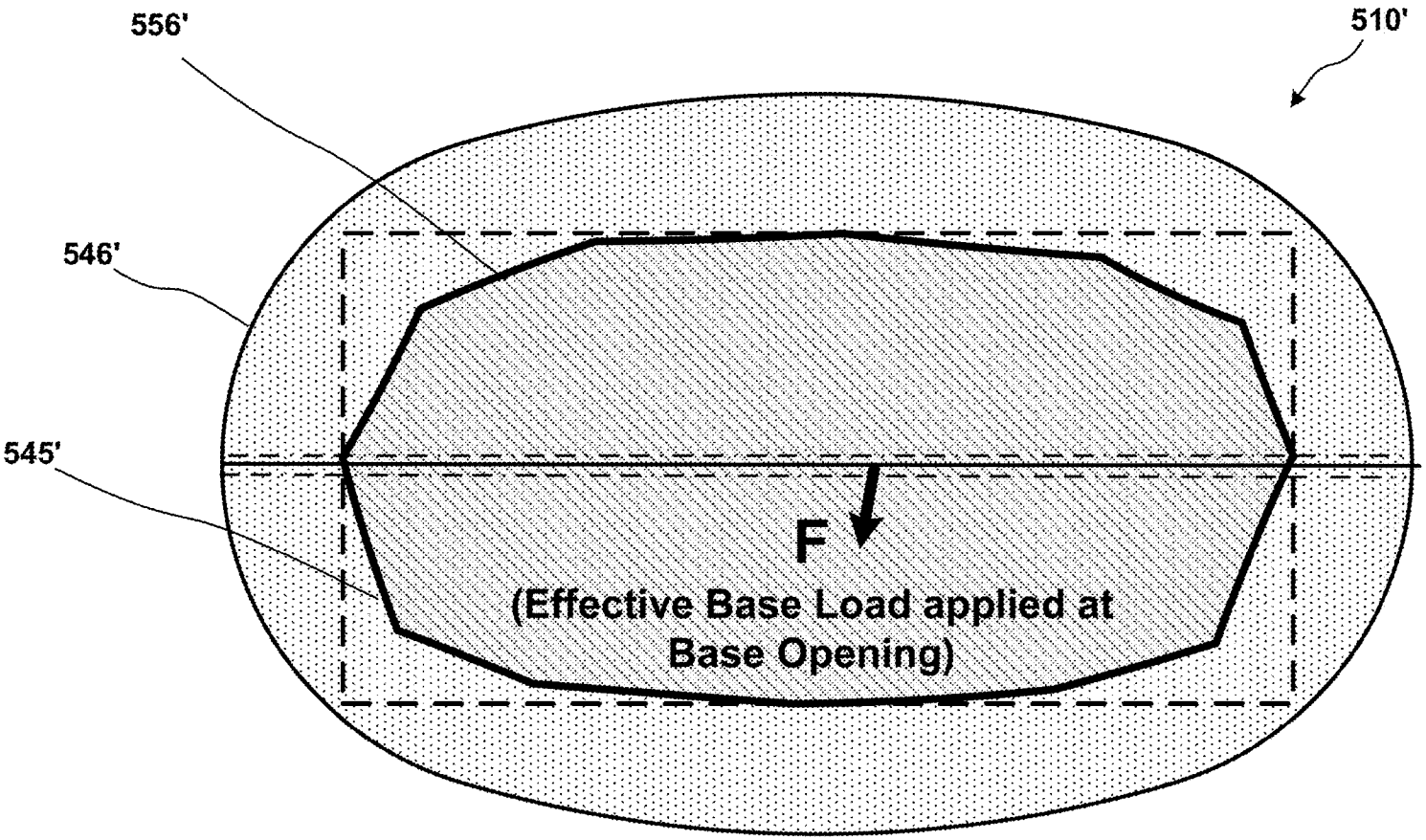
FIG. 13 is a bottom view of the inflatable enclosure of FIG. 11 shown with an example optional shape and perimeter for the bottom opening when attached to a DAP System in an inflated condition.

FIGS. 11-13—Enclosure Examples Including Trimmed Shapes; Enclosure Fabrication Referring now to FIGS. 11 to 12C along with FIG. 13, examples of inflatable enclosures fabricated from trimmed enclosure shapes are generally described in accordance with aspects and features pertaining to inventive concepts for inflatable enclosures for DAP Systems described herein. Referring in particular to FIGS. 11-12C, an inflatable enclosure 510 is generally shown as a zero/low hoop stress arrangement and/or zero/low hoop stress subcomponents for use with a DAP System. Inflatable enclosure 510 generally includes the aspects and features described above along with inflatable enclosure 110, as well as inflatable enclosures 210 and 310, except as noted hereafter. Note that like numbers refers to like features.

As shown in FIG. 11, inflatable enclosure 510 is generally configured as a slightly modified arrangement of inflatable enclosure 110 in accordance with principles discussed along with FIGS. 8A-8D and 9A and 9B, in that forward end region 534 and rearward end region 536 are each arranged as a zero/low hoop stress dome, which are spaced apart from each other by relatively short, expanded region 535. As such, forces transmitted between respective, spaced apart poles for the forward end region 534 and the rearward end region 536 effectively create an extended, elliptical shaped left pole 520 on one side of the enclosure, and a similar extended, elliptical shaped right pole 522 on the other side of the enclosure. Further, the thickness (depth) of the inflatable enclosure shown and described along with FIGS. 12A and 12B discussed hereafter are in accordance with the radius of curvature, R, for each of the two zero/low hoop stress end domes as discussed above along with FIGS. 8A and 8B. Thus, FIG. 11 illustrates yet another potential option for an inflatable enclosure arrangement for use with a DAP System having zero/low hoop stress arrangements.

Figure 14A:
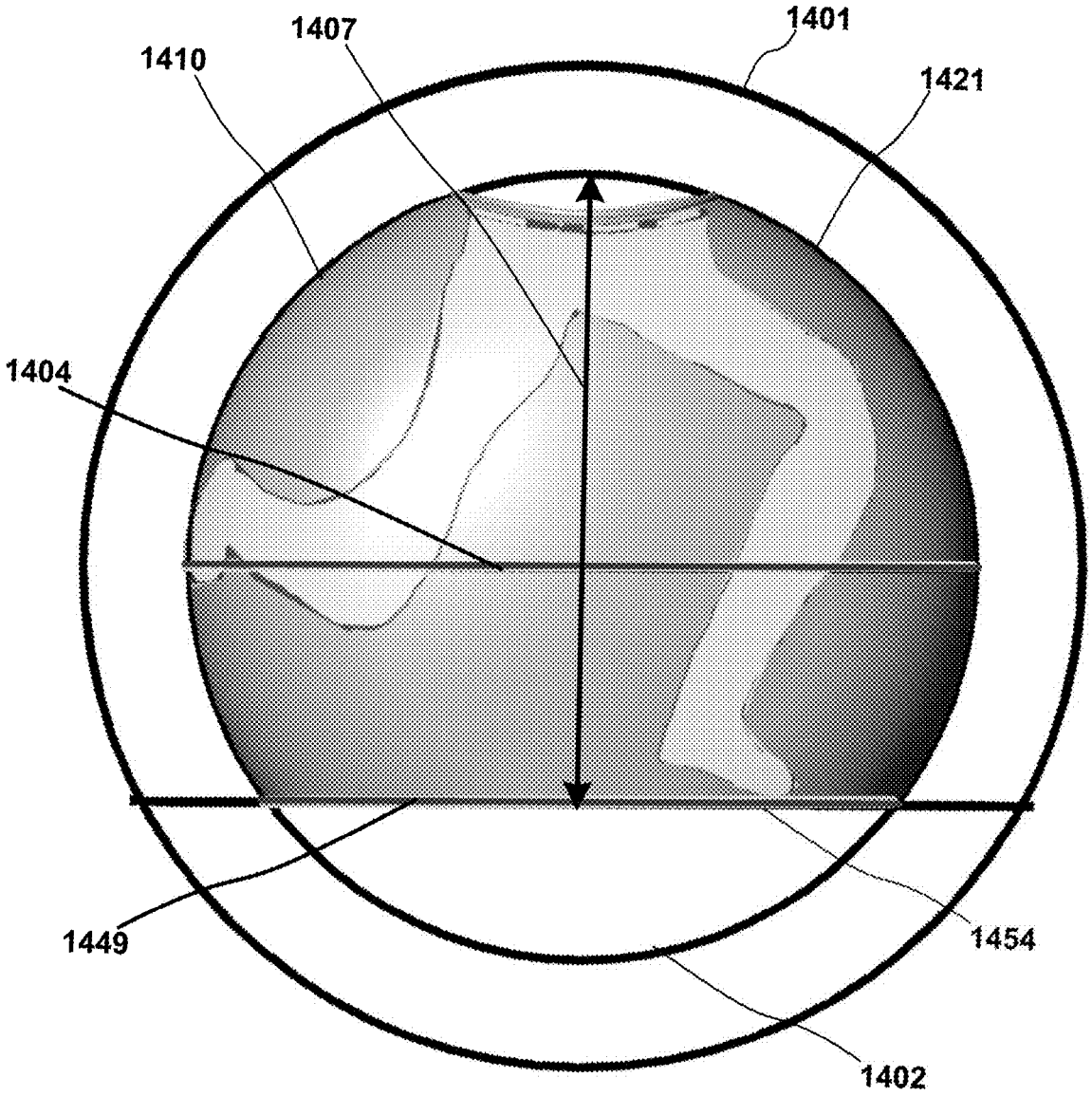
FIG. 14A is an elevation view of an example inflatable enclosure schematically showing an example user extending through the top opening of the enclosure.
Figure 14B:
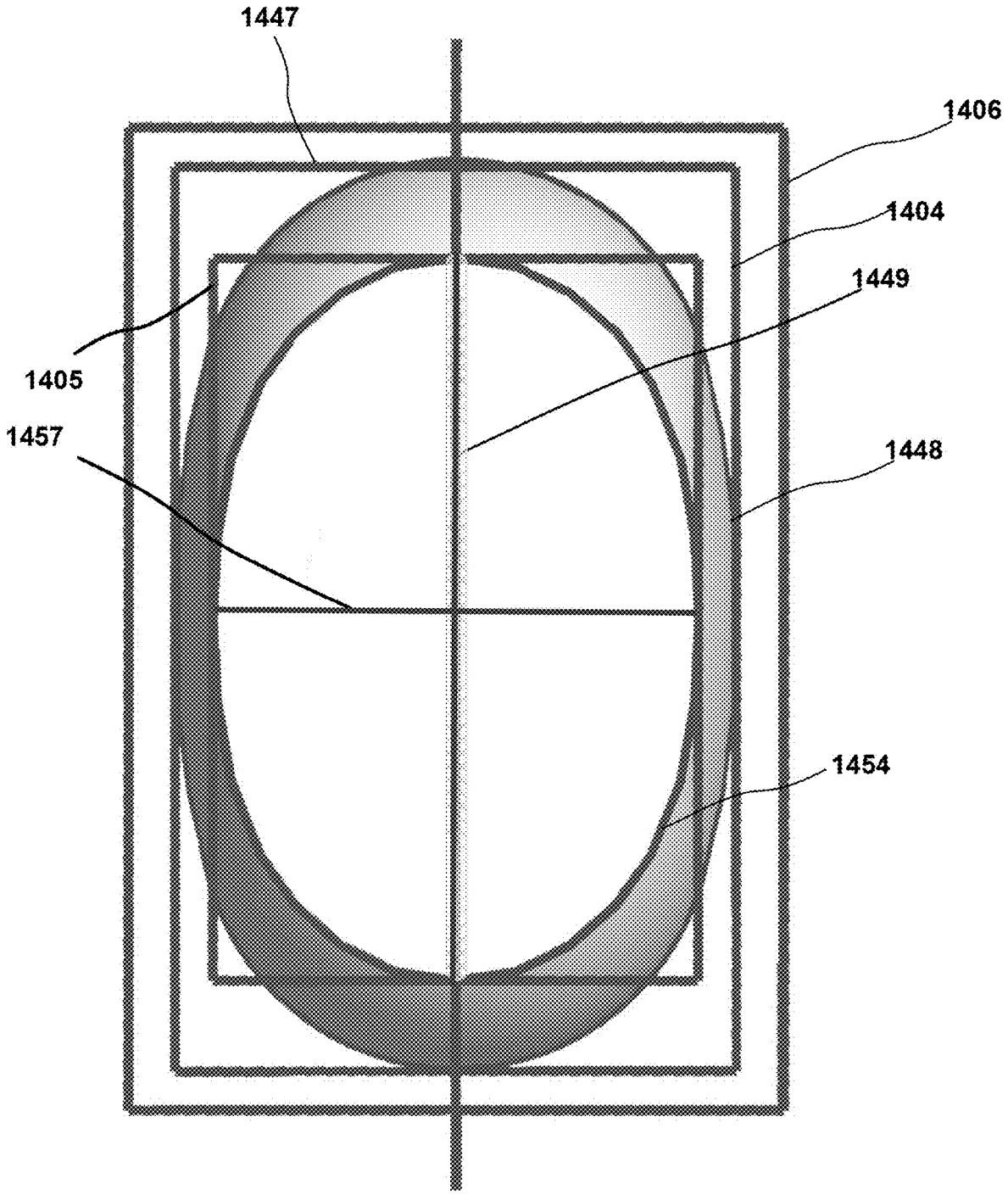
FIG. 14B is a bottom view of the inflatable enclosure of FIG. 14A.

Notably, however, inflatable enclosure 510 illustrates establishment of a beneficial base surface 550 and a corresponding trim path 552 discussed hereafter along with FIG. 14B pertaining to fabrication of an inflatable enclosure, which further relates to base regions 538 of inflatable enclosures, secure attachment and independent support for enclosures from their base regions, reduced load, low volume intake ports, and secure supportive attachment of enclosures, and other aspect and features pertaining to inventive concepts of inflatable enclosures for DAP Systems described herein. Base surface 550 represents a generally horizontal surface for secure attachment of base region 538 of the inflatable enclosure to a support within the base surface 550 for the DAP System, such as support surface 144 noted along with FIG. 2 and inflatable enclosure 110. Base surface 550 can be generally planar as shown in FIG. 11, but can also have a curved shape as shown in FIG. 4B as appropriate for the corresponding DAP System and exercise device.

The location of base surface 550 with respect to the core volume 509 of the inflatable enclosure 510 can define various aspects and features of inventive concepts pertaining to inflatable enclosures for DAP Systems described herein, including with respect to a base opening 554 and corresponding foundation shape 556 of the inflatable enclosure while in the inflated condition, as well as a related core closed shape shown in FIG. 14A for fabrication of inflatable enclosure 510. These terms are generally defined as follows:

- A "core volume" as used herein refers to the shape, size and arrangement of an inflated volume having preconfigured properties for a corresponding inflated enclosure of a DAP System absent interruptions of the inflated volume for attachment of its base region to a base surface of a DAP System and for a top port for interfacing with a user.
- A "core closed shape" as used herein refers to a two-dimensional closed shape outline or lateral perimeter of a flat, uninflated configuration corresponding with a core volume of an inflatable enclosure.
- A "base opening" as used herein refers to a shape, size (including perimeter length) and/or arrangement of an opening defined in a base region of a core volume for attaching the core volume with a base surface of a DAP System, in which the base opening is defined as an intersection of the base surface with the core volume, and the inflated enclosure is defined as the portion of core volume remaining above the base opening after removal of the base region below the base opening.
- A "foundation shape" as used herein refers to a location as well as a shape, size and/or arrangement of the base opening with respect to the core volume sufficient for independently supporting the remaining inflated enclosure during use by a DAP System user in a vertical direction extending upward from the base opening when the base opening is secured to the DAP System in a generally horizontal orientation of the base surface.

As shown in FIG. 11 and discussed hereafter along with FIGS. 12A to 12C, the intersection location for base surface 550 with respect to the core volume for creating base opening 554 and corresponding foundation shape 556 can be disposed below a generally horizontal central region 539 proximate the poles 520 and 522 and central perimeter 546, which can be the largest horizontal perimeter of the inflatable enclosure. As discussed hereafter along with FIGS. 12A to 12C, the intersection location can be selected such that foundation shape 556 can provide sufficient support for inflatable enclosure during use by a DAP System user for an attachment of the base opening 554 to the DAP System to support the vertical orientation of the inflatable enclosure independently from the attachment of the base opening. Further, as discussed below along with FIGS. 17A and 17B, the intersection location can be selected such a ratio of height of the inflatable enclosure 510 with respect to a perimeter of the base opening 538 can provide beneficial freedom of movement for the user within inflatable enclosure 510, such as with respect to leg kick.

Referring now to FIGS. 12A and 12B, end views of core volume 509 and inflatable enclosure 510 are generally shown. FIG. 12A shows an end view of core volume 509 along with the intersection of base surface 550 and a portion of base region 538 to be removed, which defines base opening 554 and foundation shape 556 indicated in FIG. 12B. Note that the lateral depth or thickness dimension, $T_{OVERALL}$, can generally be established by the radius, R, for each of the forward end region 534 and rearward end region 536 zero/low hoop stress substructures, which according to FIG. 8B can be about 1.2×R. In comparison, the length of the inflatable enclosure 510 shown in FIG. 12C that is parallel with the largest perimeter 546 shown in FIG. 11 can be greater than 2×R. Note that FIGS. 12A and 12B are not shown to scale or proportional with FIG. 11 or 12C, such that $T_{OVERALL}$ should be depicted about twice as wide as shown.

As indicated on each of FIGS. 12B and 12C, foundation shape 556 can be determined to have a sufficient size and shape for independently supporting the inflatable enclosure 510 during use by a DAP System user, such that the foundation shape can provide sufficient column support and counteracting moments to prevent the inflatable enclosure from leaning away from its vertical orientation. As discussed previously, for example, along with FIGS. 2, 3A and 3B, inflatable enclosure 110, 410 and other arrangements discussed herein direct loads and stresses along meridional paths 524, such that loads & stresses are concentrated at poles 520 and 522 along with corresponding reactive loads emanating along meridional paths from the poles. Such an arrangement can permit stable, independent support and retention of the inflatable enclosure 510 via foundation shape 556 despite the low profile and comparatively thin width of the inflatable enclosure compared with the length. This can occur based on high loads and corresponding reactive forces being applied along the widthwise interfaces of the foundation shape proximate the poles via relatively short meridional links, which can provide sufficient supportive moment for stable support in the widthwise direction despite shorter moment arms, whereas much greater moment arms in the lengthwise directions can provide support moments while receiving comparatively low loads/reaction forces.

Referring now to FIG. 13, a bottom view of the inflatable enclosure 510' of FIG. 11 is generally shown, but as an optional or modified version of enclosure 510 with respect to the shape, size and arrangement of base opening 554' and foundation shape 556'. Base opening 554'/foundation shape 556' as shown includes contact, and secure attachment, with the DAP System in both the lengthwise and widthwise directions and generally all directions around a central portion of the openings, and at sufficient distances from center to establish supportive moment arms for retaining and supporting the inflatable enclosure during use. However, as shown, base opening 554' and foundation shape 556' are shaped as a multi-segmented polygon that may appear to have a somewhat random-shaped appearance. Nonetheless, the polygonal shape can be arranged to provide requisite support and other needs for the base opening and foundation shape for the inflatable enclosure and corresponding DAP System. As such, the unique shape depicted in FIG. 13 illustrates as a schematic example that a particular shape for the base opening and/or foundation shape can be refined and particularly defined in accordance with design considerations and related factors for inflatable enclosure and/or DAP System that can meet appropriate performance requirements along with custom-design functionality or for other purposes.

FIGS. 14A to 14E: Optimization-Related Features

Referring to FIGS. 14A-E, advantageous aspects and features pertaining to additional inventive concepts of DAP System inflatable enclosures described herein are generally depicted along with schematic representations of inflatable enclosure 1410. An advantageous feature pertaining to inflatable enclosures described herein relates to efforts for creating a minimal required volume around the user with a minimal amount of fabric used. This not only reduces material costs, but the stresses seen by the fabric structure scale proportionally with the radius of curvature, so a larger enclosure has a proportionally higher strength burden requiring stronger materials or external members to shape and contain the fabric.

FIG. 14A shows a side view of an inflated enclosure 1410 that is formed from two substantially inelastic sheets that are joined together along a single seam line 1421. The reader shall note that the shape shown is a circle but other profiles such as a multi-sided polygon, on oval, etc. that approximate the shape shown can be used and create similar desired effects as described herein. As shown, a cut line profile 1401 of the sheets forming enclosure 1410 in the uninflated condition extends about the enclosure, which is shown as the outermost line of FIG. 14A. As enclosure 1410 inflates, cut line 1401 moves radially inward as the sides of the enclosure bulge out to form an inflated enclosure outline 1402 in the inflated condition.

FIG. 14A further shows base length 1449 and enclosure length 1404 extending in a horizontal direction of the inflatable enclosure 1410 in an inflated condition configured for use by a DAP System user. The enclosure length extends across inflatable enclosure 1410 at its greatest horizontal extent in the inflated condition, which as shown is maximum approximately at the level in which a runner's maximum leg kick occurs as shown in FIG. 14A. This maximum enclosure length 1404 occurs at a point around the midline or below the midline of the enclosure height 1407. The base length 1449 represents the extent of the base opening 1456 in the lengthwise direction parallel with the enclosure length 1404, which can be less than the enclosure length 1404.

Comparative lengths of the maximum enclosure length 1404 with the base length 1449 can provide advantages for the user during use, since the user's foot contacts on the surface below the enclosure is less than the length required by the user's leg kick. However, pertaining to the above, simply dropping the enclosure profile vertically downward such as in prior art FIGS. 1A and 1B would increase the amount of fabric and surface area of the enclosure and proportionally increase the forces carried by the enclosure and surrounding support structures. By creating a minimal base opening perimeter, the required exposure to the access region below the enclosure is maintained while simultaneously minimizing the enclosure stresses. By forming a shape similar to FIG. 14A, length and open volume in the inner space inside the enclosure is provided strategically only where it is necessary, thus further keeping the stress in the enclosure low and providing for a low-hoop stress enclosure.

Figure 14D:
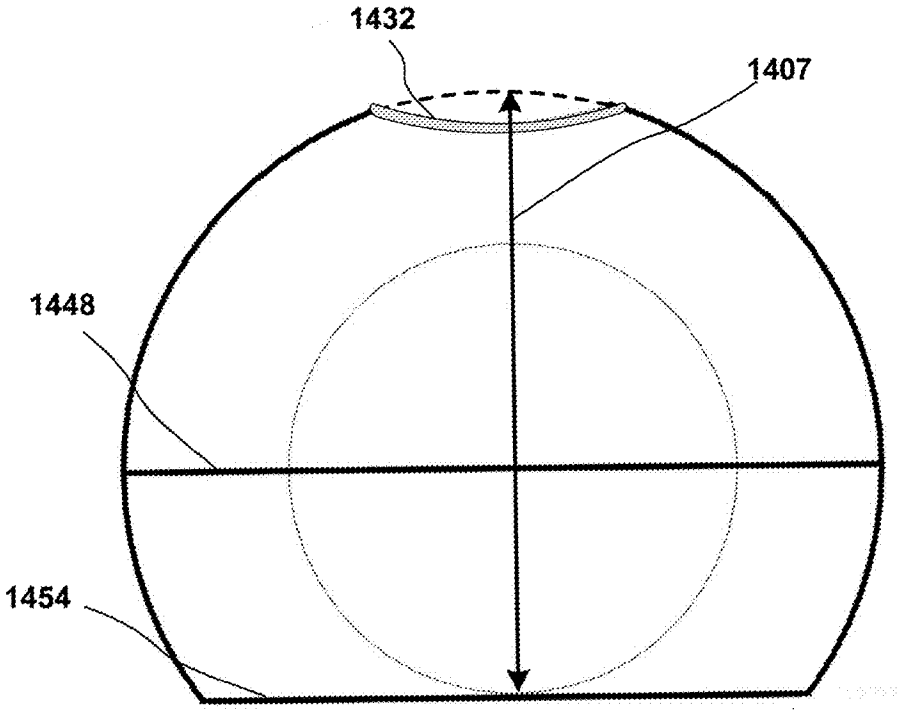
FIG. 14D is an elevational view of the same.
Figure 14C:
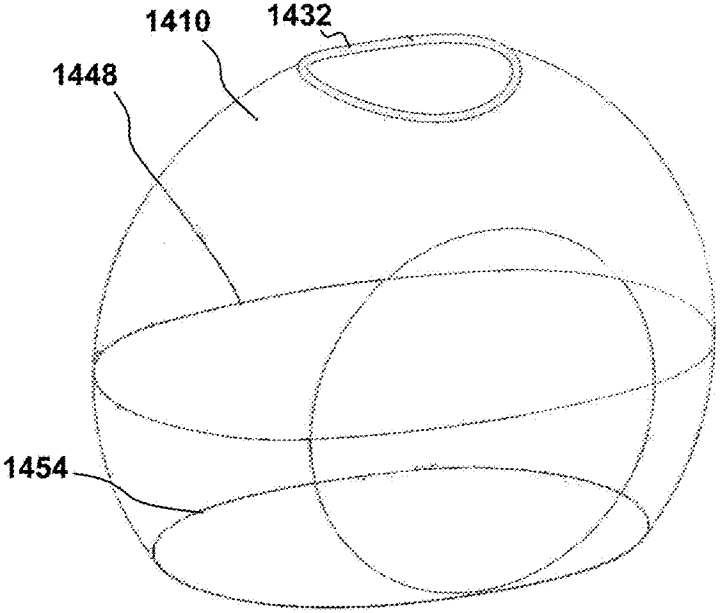
FIG. 14C is a perspective view of the example inflatable enclosure of FIG. 14A.

FIGS. 14B and 14C further illustrates advantageous example minimalistic arrangement features of enclosure 1410. Historically the enclosures of DAP machines have bulged out beyond the exercise device perimeter depicted as outline 1406 shown in FIG. 14B. This is disadvantageous because it creates more volume in a facility taken up by the DAP system, prevents pushing the DAP system up against walls to save space, and overall makes the systems look big and intimidating. On the contrary, minimalistic design aspects and features pertaining to inventive concepts for DAP System enclosures described herein can keep the maximum enclosure depth within the overall width of the exercise device and may also maintain the maximum enclosure length within the length of the exercise device.

Historically, base opening perimeters for DAP System inflatable enclosures have included rectangular shapes. As shown in FIG. 14B, base opening 1454 of inflatable enclosure 1410 has a curvilinear closed shape, which is similar to a closed shape of base opening 554 shown in FIG. 11. Similarly, base opening 556' shown in FIG. 13 as an alternative shape and arrangement for the base opening of inflatable enclosure 510 of FIG. 11, includes a multi-segmented closed polygonal shape, which substantially approximates a curvilinear closed shape as depicted in FIG. 11 via an arrangement of line segments. In accordance with aspects and features pertaining to inventive concepts of DAP System enclosures described herein, whether curvilinear, formed as a segmented polygon or having another closed shape, base openings depicted for inflatable enclosures described herein can be shaped such that the corresponding perimeter length is less than a potential rectangular perimeter length for the DAP System and enclosure.

Stated differently, a base opening perimeter length for base opening 556 of FIG. 11, 556' of FIG. 13, base opening 1456 of FIG. 14B, and other base openings shown and described herein can be shaped and arranged to have a perimeter length that is less than twice the maximum length of the corresponding base opening (e.g., max. base length 1449 shown in FIG. 14B) plus twice a maximum depth of the corresponding base opening (e.g., base opening depth 1457 shown in FIG. 14B), which otherwise equates with a length for a perimeter rectangle 1405 within which base opening is circumscribed.

Figure 18A:
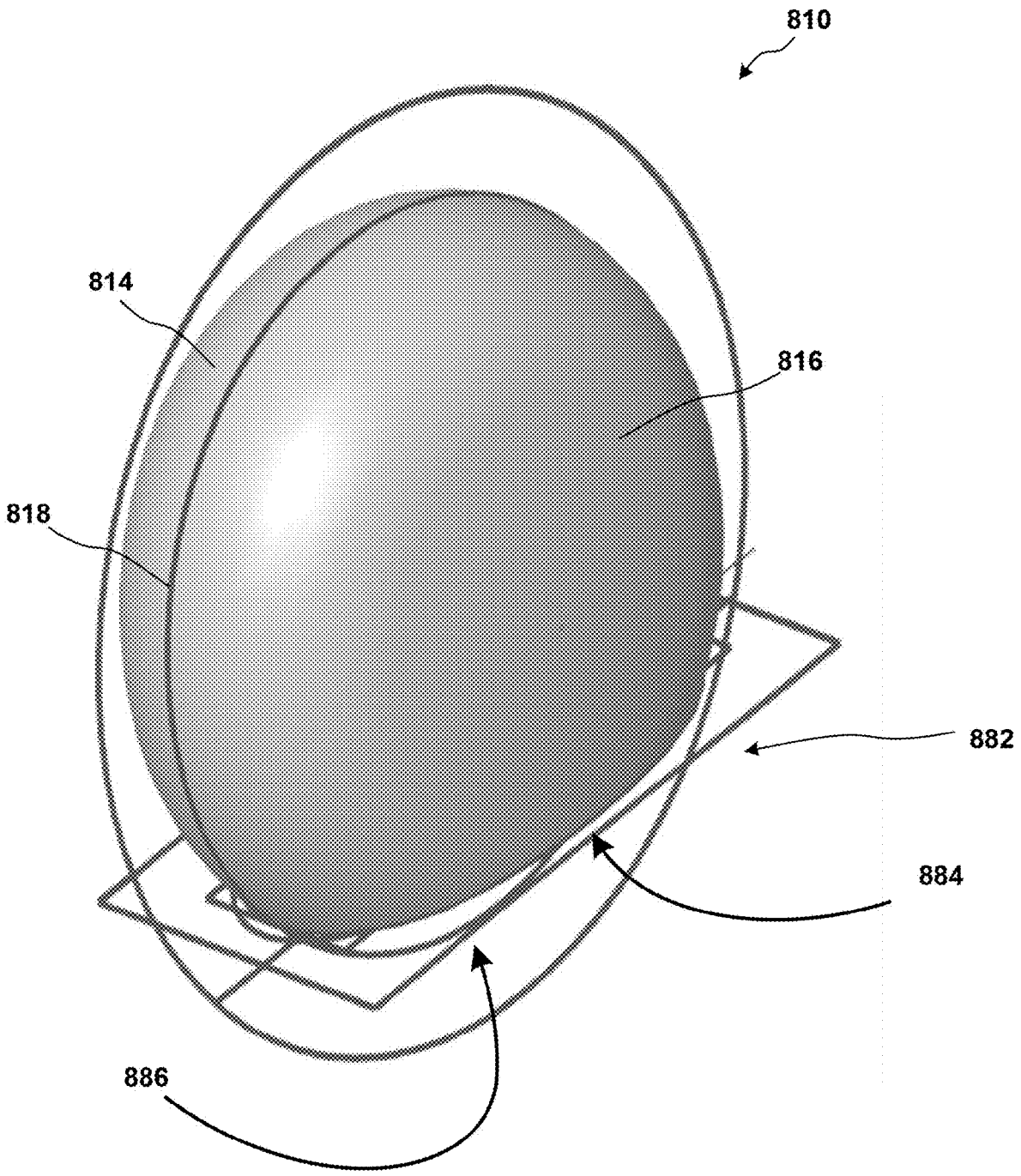
FIGS. 18A and 18B are example perspective views of a further inflatable enclosure according to aspect and features described herein.
Figure 18B:
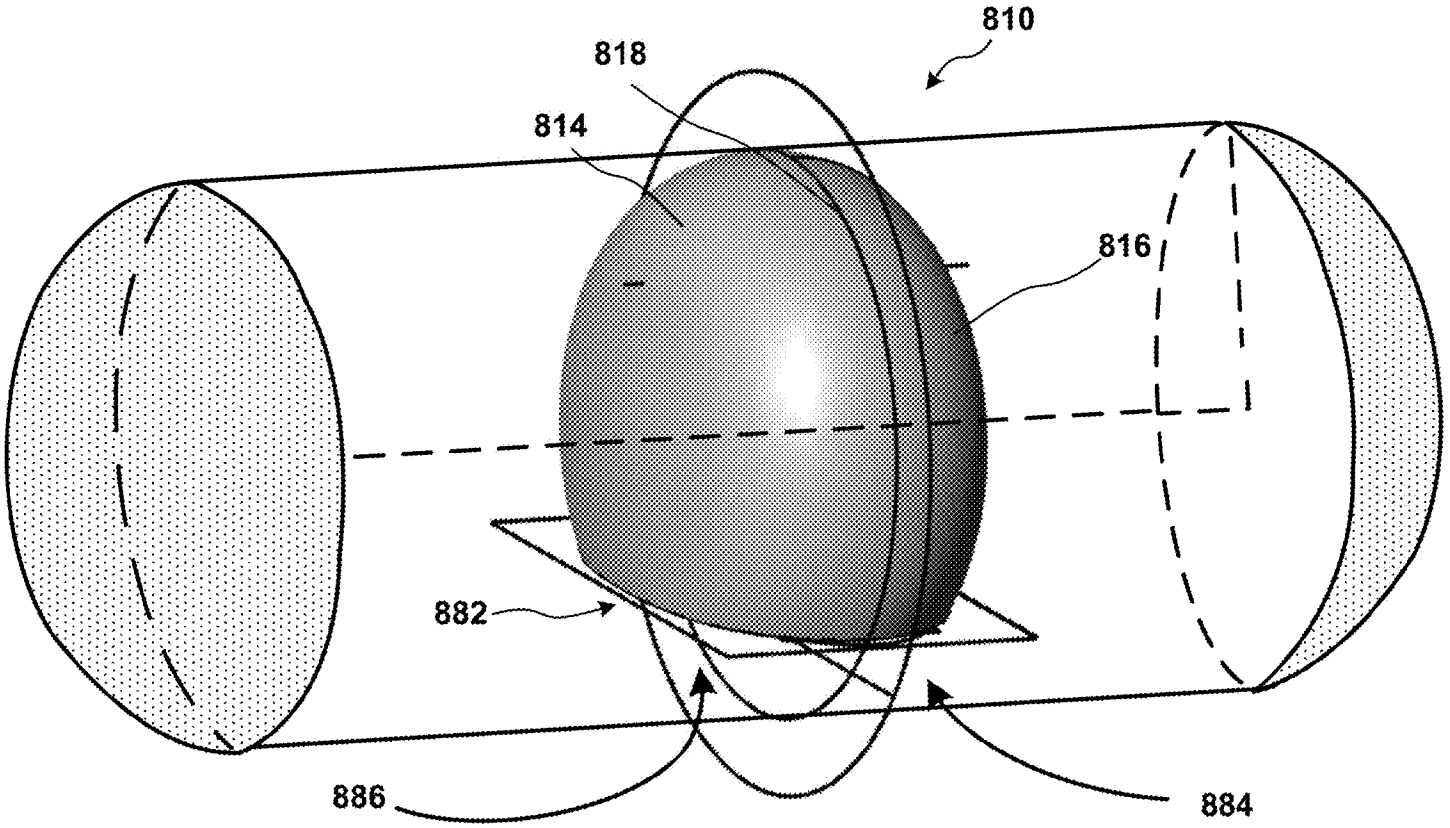
Figure 19B:
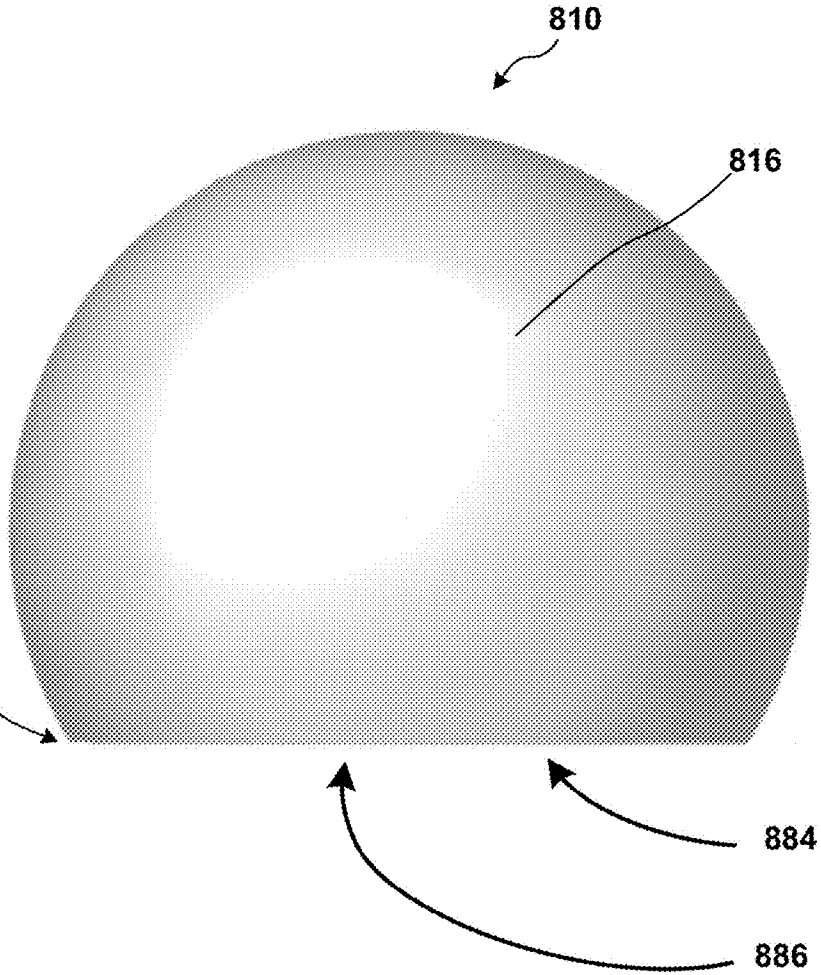
FIGS. 19A and 19B are end and side views of the inflatable enclosure of FIGS. 18A and 18B.
Figure 19A:
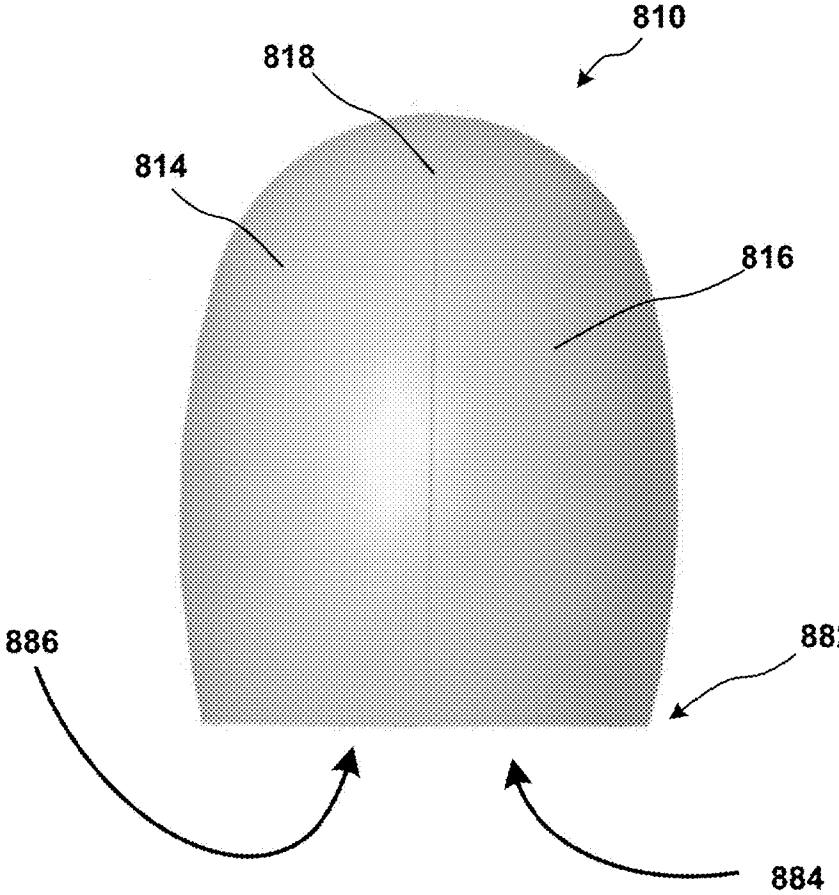

As discussed above along with FIG. 11 and further shown along with FIG. 18B discussed below, base opening 1456 can be created by a trim path, such as trim path 880 shown in FIG. 20A, which when expanded in the inflated shape, pulls the corners in, and forms a shape similar to base opening 1454 of FIG. 14B. Base opening 1454 and its corresponding perimeter 1455 can thus be configured to approximate the natural shape of a plane cutting through an expanded enclosure as if the enclosure were a full circle as in FIG. 2. However, in some configurations, it can be advantageous to elongate base opening 1454 in the front and rear portions in order to allow for greater heel kick, and may be advantageous to simultaneously narrow the base opening depth 1457 in order to minimize the enclosure depth. Such variations fall within the spirit and scope of aspects and features pertaining to inventive concepts discussed herein for DAP System enclosures, such as beneficial lengths, widths, depths, and other relationships discussed further below.

FIG. 14B further depicts advantageous aspects and features pertaining to inventive concepts discussed herein and noted above at least along with the inflatable enclosure 110 of FIG. 2 including arranging and maintaining an enclosure perimeter 1448 of inflatable enclosure 1410 to fall within the exercise device perimeter 1406, along with FIG. 14B further illustrating how the enclosure perimeter 1448 can be larger than the base perimeter 1455. As used herein, the "enclosure perimeter" refers to the largest cross-sectional perimeter of the enclosure taken on a horizontal plane parallel with the base opening and at or slightly below the midline of the enclosure height 1407. In order to minimize the enclosure size, and therefore the stresses, it was found through experimentation that ratios of base perimeter length to maximum enclosure perimeter length should be generally between 80% and 98% for chambers where the inflated enclosure height 1407 accommodates a distance off the surface the user stands on of about 40-47 inches maximum.

In the case of enclosures similar to FIG. 14A, the ratio of base perimeter length to enclosure perimeter length may be between 90% and 96% with enclosure height maximums being about between 40-47 inches. It was determined that for such a user height, where the enclosure height 1407 is about between 40-47 inches off the contact surface where the user stands, having a lower ratio than 80% would not accommodate adequate volume for both walking and running and having ratios higher than 98%, or even higher than 100%, as in prior art FIG. 1A, are unnecessary and detrimental to the structural integrity of the enclosure due to high stresses. It was further determined based on a theoretical required ambulating ground length of 36 inches and forward kick requirement of 12 inches (FIG. 14F), that an adult walking only machine would benefit from a ratio of at least approximately 70-75% between base perimeter length and enclosure perimeter length. It is understood that these ratios are examples, and the ratio may be modified by adding unnecessary volume created by increasing the enclosure perimeter without increasing the base perimeter, and that such manipulations further reduce the ratios as described. As such, the lower limits described herein shall not limit the scope of the claims and merely serve as best practice design guidelines.

In accordance with additional aspects and features described herein pertaining to beneficial and inventive concepts for DAP System enclosures, further beneficial enclosure dimensions and relationships described herein includes a comparison of enclosure height 1407 as shown in FIG. 14A with a perimeter length of base opening 1454 shown in FIG. 14B, wherein the shape of FIG. 14A has a ratio of base perimeter length to enclosure height of 3.75 with the height being 45 in. and the base perimeter length being 120 in. In another configuration where the length is increased and the width shortened, a working sample was made with the base perimeter of 148 in and the height being 45 in for a ratio of 3.28. The reader shall note that a walking machine for an adult may have a base perimeter of approximately 90 inches for a height of 45 inches giving a theoretical usable limit on the ratio of base perimeter to height of about 2. Due to the desirable effects of minimizing the volume enclosed, it is therefore desirable to keep a base perimeter to height ratio of less than approximately 3.75 to 4 for running applications and greater than approximately 2-2.5 for walking applications. Going above a ratio of 3.75-4 and below a ratio of 2-2.5 either provides unnecessary volume in the inner space or not enough volume in the case of walking.

Further, it may be useful to describe other ratios of the base length and base depth to the maximum enclosure length and enclosure depth to illustrate how the base opening pulls the enclosure inward at the bottom and limits the depth-wise expansion of the enclosure thickness to its minimal required shape. The base opening length 1449 may be for example 60-100% of the enclosure length 1404, or it may be 85% to 100% of the enclosure length as in FIG. 14A, or it may be 90 to 95% of the enclosure length in the case of an elongated base open suited for faster running. Similarly, the base opening width 1457 may be 70-100% of the enclosure depth or thickness, or may be 85 to 100% of the enclosure depth or thickness, or even 90-95% of the enclosure depth thickness. The reader shall understand that different ratios may be created based on desired characteristics of foot placement on the sides of a running belt for example, a minimal running belt width, a minimal running belt length, a maximum desired speed of the running belt, etc.

FIGS. 14C and 14D help to illustrate further how the maximum enclosure length and depth, or otherwise the maximum enclosure perimeter 1448, reside below the midline of the enclosure height 1407. By placing the trim line below the midline, the required enclosure height 1407 is allowed without unnecessarily expanding the enclosure length. For example, as the trim line is moved toward the midline of the enclosure height, the enclosure becomes closer to a semicircular shape. This means that the base opening length 1449 moves toward 2× the enclosure height and the desired ratios described above are not maintained. Again, the reader shall understand the figures show a circular profile of the enclosure, but other similar profiles may be created and maintain inventive concepts described herein.

Similarly, it may be advantageous to describe the relationship of the maximum enclosure depth or thickness 1447 to the enclosure height 1407 in the inflated condition. In the applicant's testing it was determined that generally this ratio should be between 0.55 and 0.875. In the case of FIG. 14B the ratio is about 0.77 for example or 35 inches in depth compared with 45 inches in inflated height off the surface where the user stands. The reader shall note that one could build a support structure above the surface where the user stands and place the enclosure higher, but such modification would be taken into account with regards to the ratios and guidelines described herein. These measurements were taken in the self-supported condition and the narrowness of the enclosure contrasts significantly with the prior art where, when left unsupported the enclosures balloon out significantly in the depth-wise direction.

FIGS. 14C and D further illustrate a non-planar top port frame 1432. The top port frame can dip down to conform to the natural shape of the curved sides and rise up in the front and rear to conform to the natural shape of the disc. The saddle shaped top port frame may be advantageous in reducing stresses in the fabric at the point of connection and maintain a sloped shape on the side of the user to promote freedom of motion of the arms.

Figure 14F:
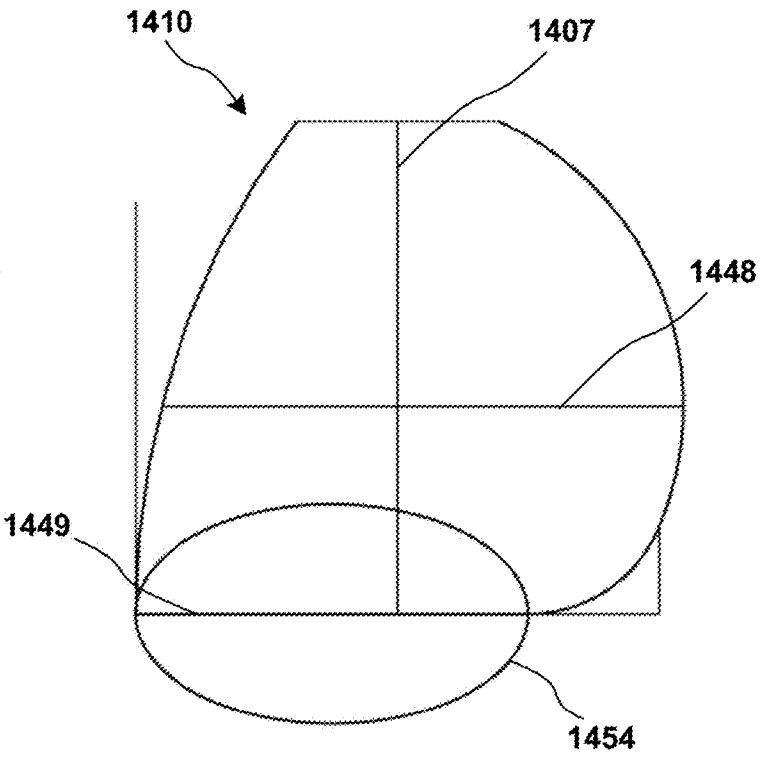
FIG. 14F is a side profile illustration of a walking only enclosure illustrating the base opening design and relative locations of the enclosure perimeter, the base perimeter.
Figure 14E:
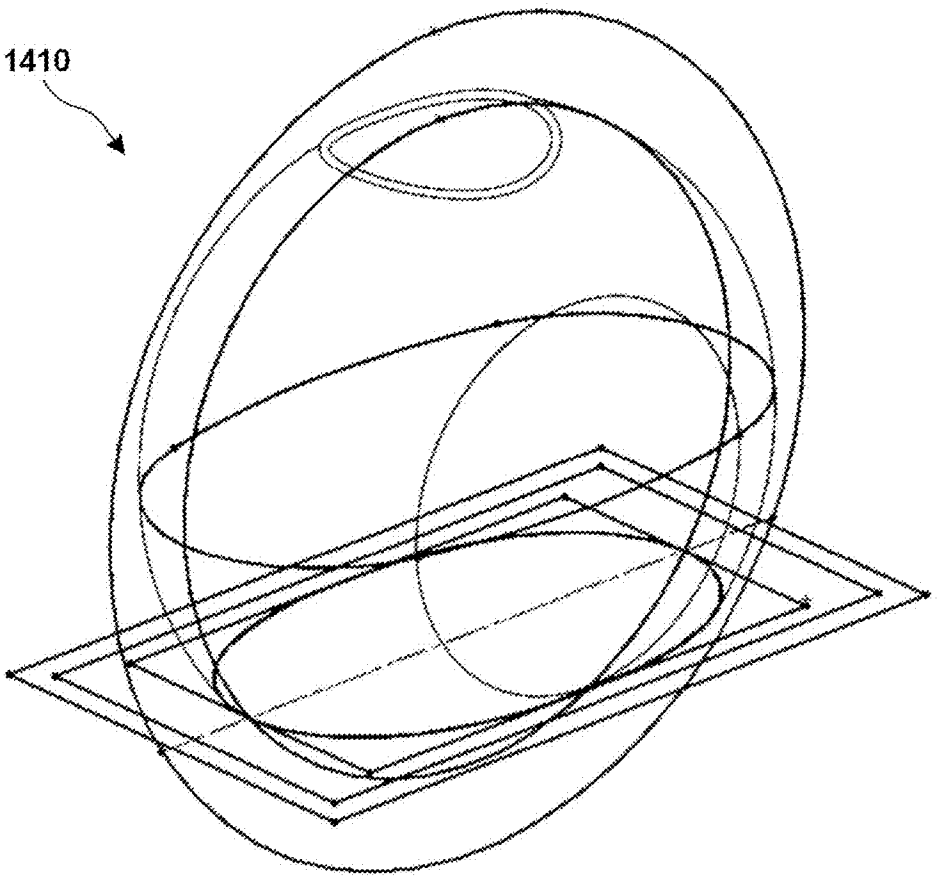
FIG. 14E is another perspective of the example inflatable enclosure of FIG. 14A.

FIG. 14E, an isometric view of FIG. 14B illustrates the shrinkage of the two-sheet enclosure as it expands to form the inflated enclosure, along with the projected outlines of the maximum enclosure perimeter, the base perimeter, and how the enclosure stays within the outer perimeter of the exercise devices.

FIG. 14F is a side profile illustration of a walking only enclosure illustrating the base opening design and relative locations of the enclosure perimeter, the base perimeter, and ratios of each as discussed above.

In reference to FIG. 7B, the enclosure, when formed from two flat sheets, shrinks in perimeter profile length as it expands in the depth-wise direction. The inflated enclosure length as shown in 14B by 1404 generally has a ratio to the inflated enclosure depth 1410 of between 50% and 75%, or specifically about 62.5% in the case of FIG. 14B.

Prior art FIG. 1A shows external rigid framing members which are used to conform and shape the enclosure. On the other hand, aspects and features of inventive concepts described herein can employ external framing member such as handrails, and such members may minimally contact the enclosure as in FIG. 30, however according to beneficial features of inflatable enclosures described herein, the inflatable enclosure can be configured as self-supported without materially relying on external members for shaping or rigidity. As rigid members come into contact with the enclosure to shape it, the enclosure imparts forces on those members and those forces must be carried by the framing of the exercise device or otherwise by additional framing members, thus adding bulk, weight, size, and cost. The applicant's hand rails, in prototypes built may contact the framing however they do not deform or move a contact point on the enclosure from its natural position, which is the location in space as if no members were present, by more than between 1-5 inches in all cases and generally less than even 3, 2, or 1 inch if any contact exists at all. This minimal pressure exerted by the enclosure on any such framing members maintains low stresses in the frame and ensures that substantially all of the load is carried to the base opening connection between the enclosure and the base support.

Expanding on this idea, the applicant has similarly limited the vertical loading imparted by the enclosure on the base support or otherwise transferred to the exercise device framing, and this carries true for all height settings of the top opening. Indeed, prior art systems carry the bulk of the vertical load between a base that surrounds the exercise device, and an upper frame, through rigid frame members that connect the upper frame with the base support. These are very high forces, and can be in the 1000s of pounds and require significant safety precautions and testing as has been previously discussed. Contrary to the prior art, by channeling the tensile loads and subsequent vertical forces down primarily to the base connection, the applicant has simplified the areas of concern to a single line of contact and avoided expensive design, testing, and fabrication of elaborate and complex support structures. While some incidental load may be introduced should the enclosure contact a portion of a handrail in the applicant's invention, a small amount of vertical load may be transmitted due to friction, however the majority, for example 80-100%, and commonly between 95-100% of the vertical load is carried purely through the base connection between the enclosure and the base support. The reader shall note that while the application generally discusses a base support connected to the exercise device, the base support may be independent of the exercise device as in the prior art and concepts such as vertical load carrying as previously discussed still hold true and simplify any framing or support structure designs.

When discussing the access region, note that the access region can be made smaller or larger, but such modifications simply for avoiding recommended limitations in this spec shall still be considered as part of the applications invention. Now, as reference to FIG. 24, a portion of the access region includes at least 3.5 in., and preferably up to 6 inches per side for foot placement on either side of the running belt. The length of the base opening may extend over the access region in the front due to the fact that the foot is furthest out in front of the body while above the ground (refer as well to the space above the foot which has just struck the ground in FIG. 14A) during walking. Therefore, the inner space of the enclosure may extend over the access opening, but in keeping with the spirit of minimizing the enclosure size, the applicant still desires to make the base opening length and width small for the given application. Therefore, as previously discussed, the base opening may cut inward and cover a portion of the access region and, while the base opening may extend past the access region, at least in the front, the cross-sectional area of the base opening is generally less than the cross-sectional area of the access region of the exercise device, and in some cases less than 90% of the access region cross sectional area.

Cutting out unused portions of the access region in the applications invention allows the base opening to be as small as possible and therefore pull in the enclosure fabric as tight as possible while maintaining adequate inner space volume for the user to have full range of motion. Similarly, the base opening cross sectional area is generally less than the maximum enclosure cross sectional area as sliced in the horizontal plane along the enclosure height and at about the midpoint of the height or below (FIG. 14C). The base opening cross sectional area as compared with the maximum enclosure cross sectional area may be between 90-98%, or even between 80-90% in the case of a machine designed for running, or may be lower in the case of a walking machine and between 50%-75%.

Figure 17:
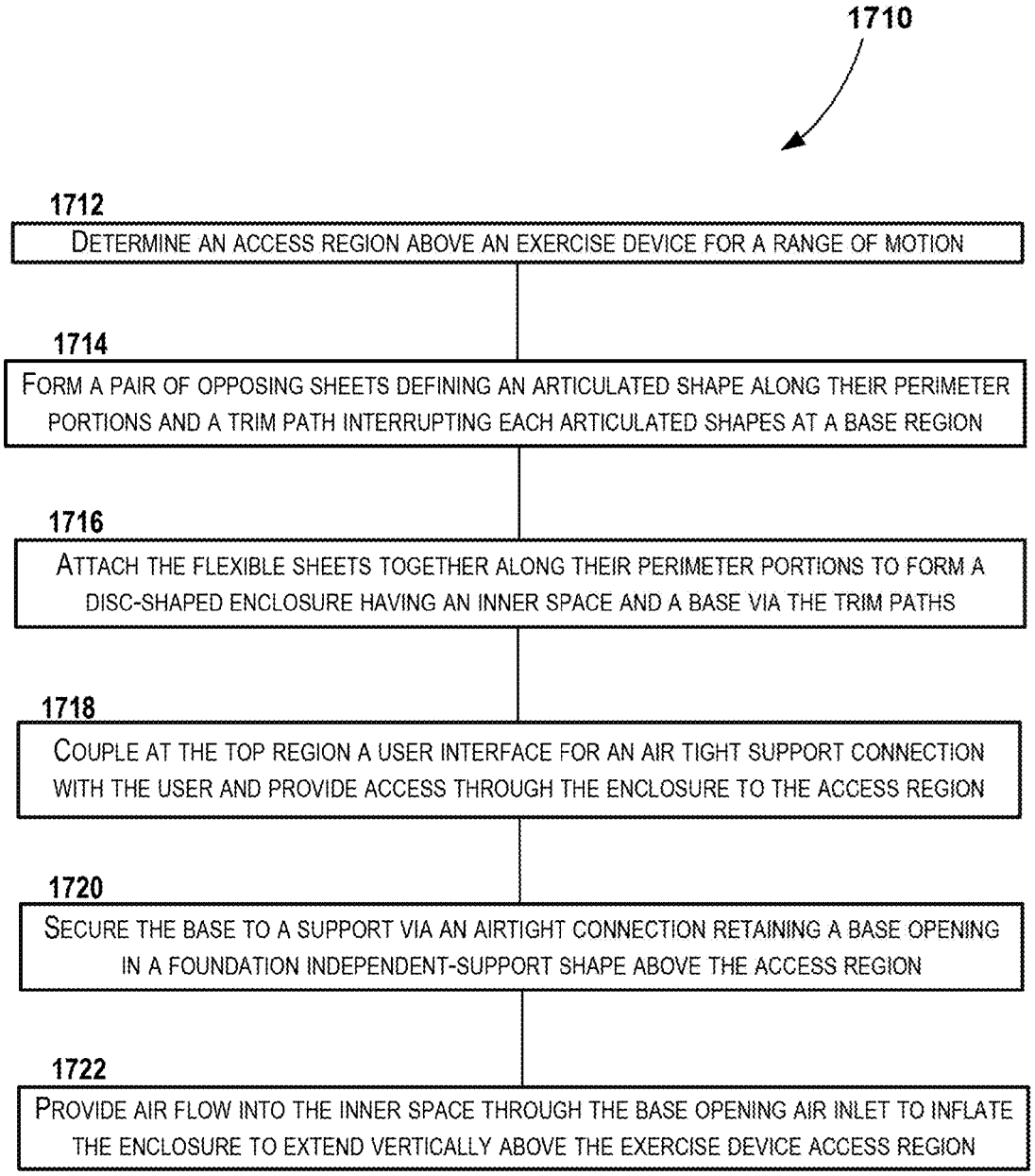
FIG. 17 schematically depicts a method for providing an inflatable enclosure with a DAP System in accordance with aspects and features of inventive concepts described herein pertaining to inflatable enclosures for DAP Systems.

Referring now to FIGS. 15A to 15D along with FIG. 17, a method 1710 for providing a structurally independent DAP System to an exercise device for unweighting a user while exercising is generally described along with FIGS. 15A to 15D schematically depicting related actions in accordance with aspects and features pertaining to inventive concepts described herein. Method 1710 includes determining 1712 an access region above the exercise device for a range of motion for performing an exercise on the exercise device. As illustrated and discussed along with FIG. 2 and inflatable enclosure 110, and discussed in greater detail along with FIG. 14A to 14F, many different advantageous benefits and features can be provided in accordance with inventive concepts described herein pertaining to inflatable enclosures for use with a DAP System, many of which directly pertain to parameters for an interface between inflatable enclosure concepts described herein established according to an access region above an exercise device, and a range of motion. These include, for example, size and shape parameter that can directly impact a base opening 145, 454 of the inflatable enclosure, as well as a corresponding foundation shape 156, 456 within available space proximate the access region. Further, what may appear to be basic information pertaining to a range of motion along with the access region can identify beneficial performance information along with shape and size information for inflatable enclosure options.

As discussed along with FIGS. 14A to 14F, various advantageous performance relationships and size, shape and other features and enclosure parameters can be evaluated based on the access region, exercise device and range of motion information provided. Shape, size, performance, and other features can be determined for inflatable enclosure options in accordance with inventive concepts described herein. Based on determination of inflatable enclosure options, at least a core volume for the inflatable enclosure, a core closed shape for the two-dimensional uninflated shape corresponding with the core volume, and a corresponding trim shape for defining the base and base opening of the inflatable enclosure can be determined.

Figures 15A, 15B:
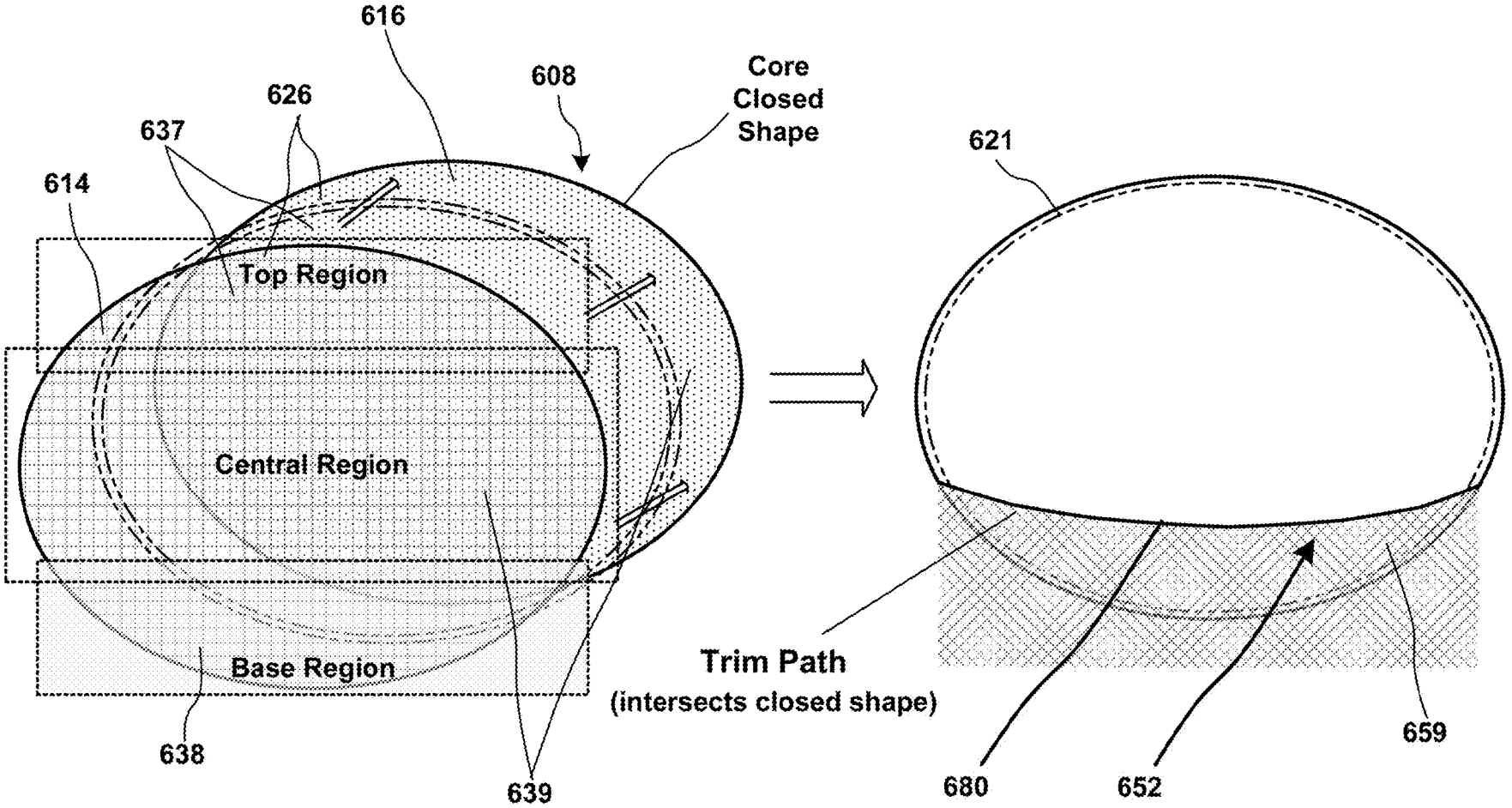
FIGS. 15A-15D are schematic elevation views depicting aspects and features pertaining to fabrication of an inflatable enclosure according to concepts described herein, which are illustrated using the example inflatable enclosure arrangement of FIG. 11.

As illustrated in FIG. 15A, Method 1710 proceeds with forming 1714 a pair of opposing substantially inelastic flexible sheets 614, 616 each defining a core closed shape 608 having a perimeter portion 626 including a top region 637, a central region 639, a base region 638 at an opposite side of the central region from the top region, and a base 652 defined by a trim path 680 interrupting the core closed shape at the base region. Although FIGS. 15A & 15B show the pair of opposing sheets 614, 616 being attached to each other via a seam 621 prior to the trim path intersecting the core closed shape, it is understood that the particular order of operations can be flexible provided the sheets are attached to each other along their perimeter portions for the core closed shape, and the trim path intersects the core closed shape and, in effect, creates a boundary along perimeter portions of the core closed path. In other words, the transected portion of the base region 659 shown in FIG. 15B can be removed with or without the seam 621 being formed in the transected base; the final pattern could be cut from the beginning without ever removing anything.

Note further that FIGS. 10A-10C also illustrate actions pertaining to Method 1710, except that the core closed shape for FIGS. 10A-10C is formed from the corresponding flat/uninflated shape of a Zero/Low Hoop Stress Upper Dome 415 combined with a flat/uninflated shape of substructure for a tapered cylinder 423 to define the shape for each of the sheets 414, 416. In addition, FIGS. 10A-10C show the trim path as 'preformed' at a base region of the core closed shape, which also meets the actions of Method 1710. It is understood that the 'trim path' can represent a conceptual intersection for defining the cut shape of the flat/uninflated shapes for attaching to each other to form the enclosure. It is understood that in the inflated condition the secure attachment of the base opening to the DAP System base support will be arranged to retain the transected base of the inflatable enclosure in a functional arrangement that transfers loads/stresses and maintains the core volume arrangement of the inflatable enclosure, such that performance and functionality of the core volume arrangement are maintained. As such, whether the base and base opening are defined by actual transection along the trim path, or via theoretical determination of the 'cut' path and shape for the two sheets that accommodates the corresponding cut shape, curvature, etc. to form the base and base opening, should have little impact for fabrication and installation of the inflatable enclosure.

Continuing with Method 1710, the method further includes attaching 1716 the flexible sheets together along their perimeter portions to form a disc-shaped enclosure having an inner space and a base via the trim path. As illustrated in FIGS. 15A-15B, as well as along with FIGS. 10A-10B, the sheets can be attached to each other via a seam along the entire perimeter portion, and transection along the trim path can form the base, or the sheets can initially be defined to include the trim path, and the seam can end proximate each end of the trim path. Further, seam 621 can also attach the sheets to each other along the entire perimeter portion except for along the trim path portion followed by trimming along the trim path. Further, it is understood that actions depicted in these figures do not include a notch or corresponding accommodations for a top port, which can be included as part of the method. The term "seam" as used herein refers to methods, devices, mechanisms, systems, interconnections, and other means for attaching the panels to each other for retaining the inflatable enclosure arrangement or structure, which can include without limitation: stitches, clamps, ultrasonic welds, bolted retainers, a zipper, a shaped channel mated with a corresponding shape, and the like. Further, the term "seam" is not limited to means for providing an air-tight attachment between the panels, because it is understood that non-airtight attachment arrangements can be sealed separate from establishing the connection, such as via coatings, sealants, liners, and the like.

Method 1710 continues with coupling 1718 at the top region a user interface for an airtight support connection with the user and provide access through the enclosure to the access region, which implies at least forming a top port 630 if not formed along with creating the disc-shaped enclosure, as well as installing a top port frame 632 proximate the top port as described earlier along with FIGS. 5A and 5B. In addition, it is understood that coupling an airtight support connection with the user includes additional actions beyond installation of the top port frame 632 to the extent such installation fails to provide for the user be able to interface with the top port frame in an airtight support connection. In accordance with the description for top port bracket 132 discussed along with FIG. 5A, one or more additional interface and/or sealing members can be applied to top port bracket 632 for providing for the user interface and airtight connection of the method.

Figures 15C, 15D:
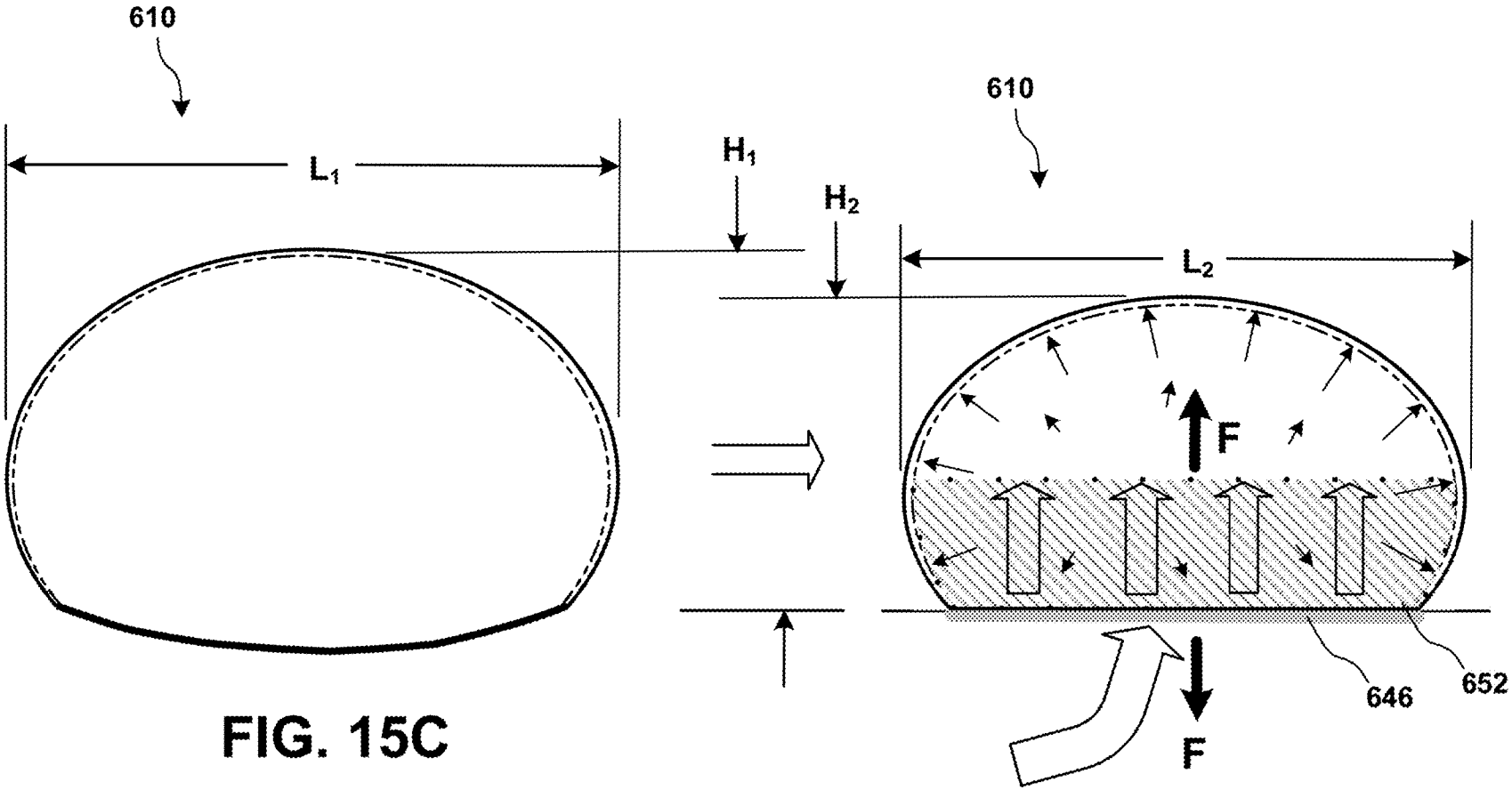

The Method 1710 further includes securing 1720 the base 652 to a support 646 via an airtight connection disposing the base opening above the access region, the support retaining the base opening in a foundation shape corresponding with the access region and configured for independently supporting the inflated enclosure from the base in a vertical orientation. FIGS. 15C and 15D schematically illustrate attaching the base to a base support 646 of a DAP System as well as related discussion along with FIGS. 2, 11-13, and 14A-E, as well as hereafter along with FIGS. 28-30. Method 1710 further includes providing 1722 an air flow into the inner space through the air inlet to inflate the enclosure, which is further depicted in FIGS. 15C-15D along with corresponding height and length reductions for enclosure 610 while changing from the uninflated to the inflated condition.

Figure 16B:
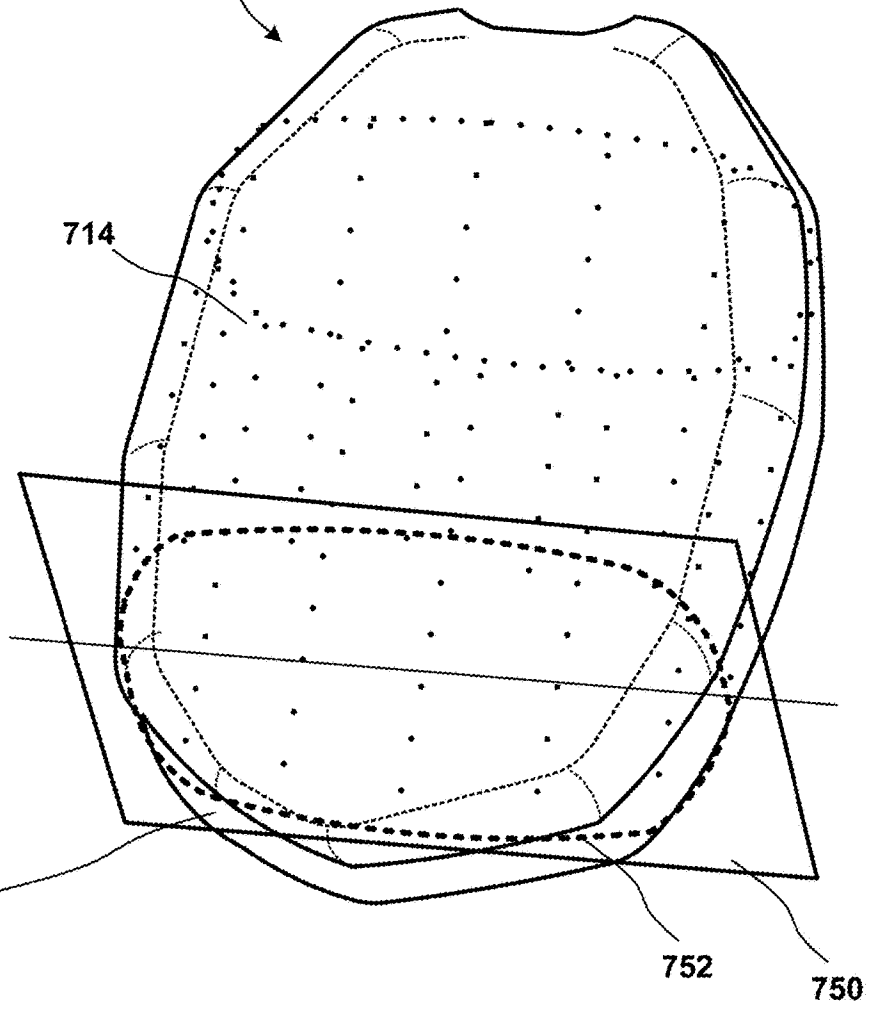
FIGS. 16A and 16B are schematic perspective views for yet another inflatable enclosure arrangement illustrating further inflatable enclosure options according to aspects and features of concepts described herein.
Figure 16A:
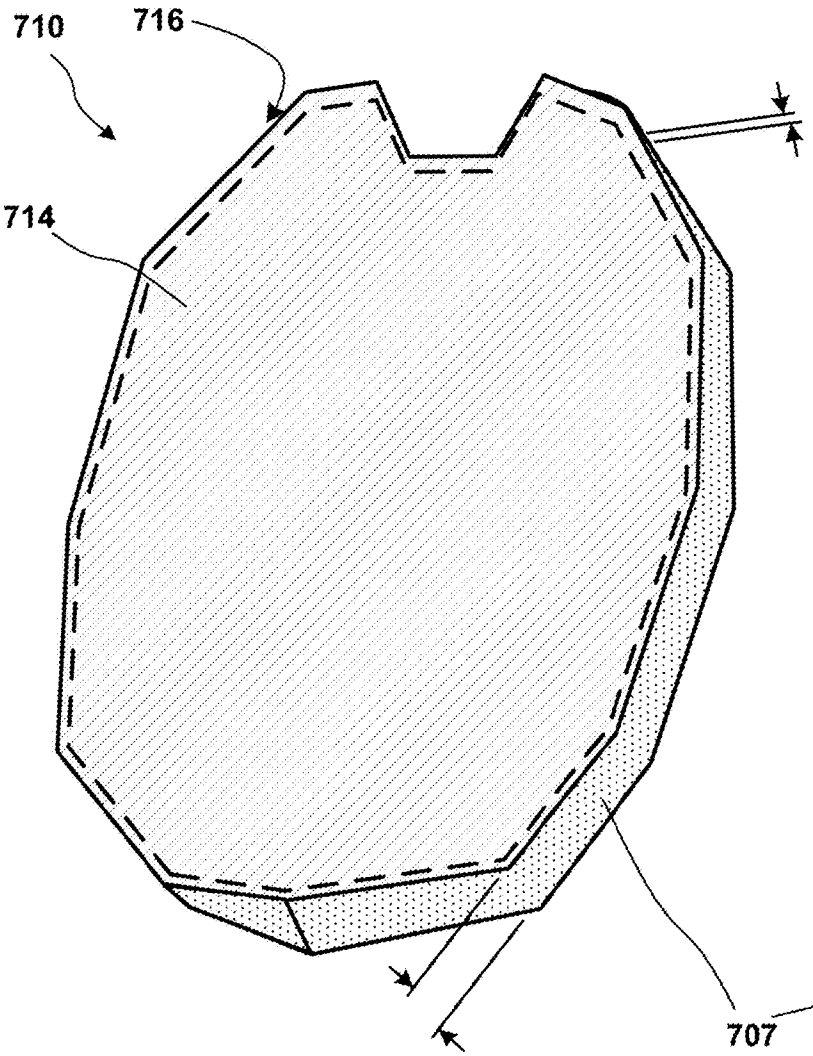

Referring now to FIGS. 16A and 16B, yet another schematic example inflatable enclosure 710 is generally shown in accordance with aspects and features pertaining to inventive concepts of inflatable enclosures for use with DAP Systems as discussed herein. Enclosure 710 generally includes the same aspects and features pertaining to inflatable enclosures discussed above, except as noted below. As shown, inflatable enclosure 710 can be formed from a pair of opposing sheets 714 and 716 in a manner similar to other enclosures described herein, as well from as a relative thin intermediate sheet 707. The intermediate sheet can be attached to each of the opposing sheets 714 and 716 along one of its edge portions, such as a first edge portion attached to sheet 714 and a second, opposite edge portion attached to second sheet 716, such that the intermediate sheet forms an intervening connection between each of the primary sheets.

Further, intermediate sheet 707 has been configured to include a 'tapered' shape such that a width of the intermediate sheet is largest at a base end or region of the inflatable enclosure, and tapers down as it extends to a top end of the enclosure a smallest or thinnest width across the intermediate sheet. Although such an arrangement can increase overall depth or thickness of the inflatable enclosure when in the inflated condition as a result of the intermediate sheet, and/or may adversely influence a balanced mechanical equilibrium arrangement or similar performance of the inflatable enclosure, custom-designed arrangements such as the example tapered example for enclosure 710 can many times provide benefits and optional performance features for particular circumstances. For instance, a unique exercise device and need can often present itself, such as perhaps the need for a specialty rehabilitative, commercial, or Olympic or other specialty training circumstance for an extended height exercise device, gymnastic or other raised arrangement, and/or hospital/rehabilitation device.

Example inflatable enclosure 710 illustrates the applicability of aspects and features pertaining to inventive concepts for DAP System enclosures described herein for a wide variety of inflatable enclosure arrangements including inflatable enclosures including additional sheet members and/or intervening connection sheets or devices included therein.

Referring now to FIGS. 18A-19B, a further example inflatable enclosure 810 is shown in accordance with aspects and features of inventive DAP System inflatable enclosures described herein. Inflatable enclosure 810 generally includes aspects and features discussed above along with other inflatable enclosure examples, except as noted herein. Similar to inflatable enclosure 110, inflatable enclosure 810 is generally arranged as a circular, zero/low hoop stress, enclosure having an equator 818 extending about its radial perimeter. As can be seen in FIG. 18B, inflatable enclosure 810 is arranged as low-pressure version of a cylindrical pressure vessel have a zero-length or near zero cylinder, such that inflatable enclosure 810 is arranged like a pair of cylindrical pressure vessel end caps attached to each other at their perimeters with their concave faces toward each other, such that inflatable enclosure 810 is generally disc-shaped. Inflatable enclosure 810 primarily differs from inflatable enclosure 110 in that a base region of inflatable enclosure 810 has been intersected with respect to its circular profile shape along a trim path 880 (FIG. 20A), and flexible sheet material forming the enclosure removed at the base region below the trim path to define a base 882 of the inflatable enclosure.

A base opening 884 is defined at base 882 between opposing flexible sheets forming the enclosure, which also defines an inlet port 886 through the base opening into an inner space of enclosure 10 for receiving inflation air flow therethrough. The dual use arrangement of the inlet port 886 with base opening 884 is identified as a potential option or as a matter of convenience. However, it is understood that inflation can be provided into the enclosure at other locations or specific port created for providing inflation air supply. The base opening 884 is configured to form a foundation or support shape when secured to a base support (FIGS. 24, 26, 28, 29), which can support inflatable enclosure 810 to extend upward from base 882 when in the inflated condition. The base 882 and base opening 884 defined by the trim path 880 are configured to be generally planar when attached to the base support and generally horizontally oriented, but are not necessarily planar and not necessarily horizontal.

Figure 20B:
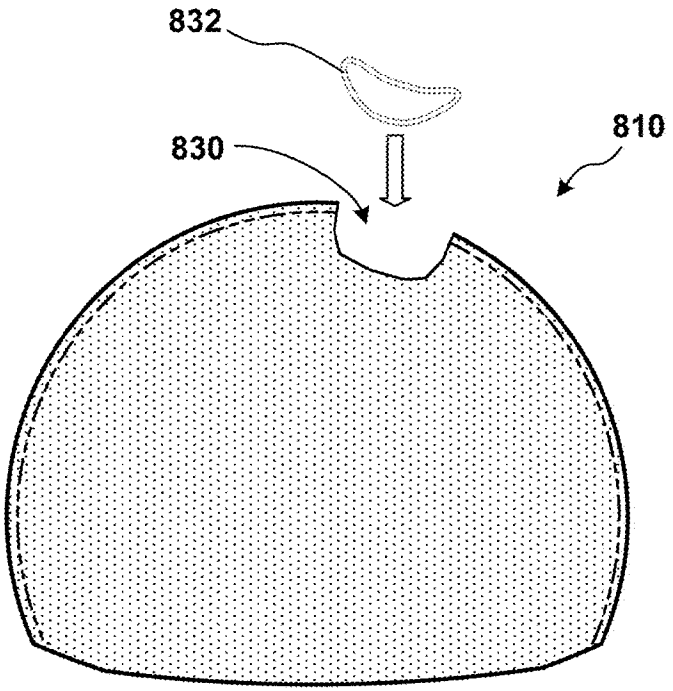
FIGS. 20A and 20B show actions pertaining to fabricating the inflatable enclosure of FIGS. 18A and 18B.
Figure 20A:
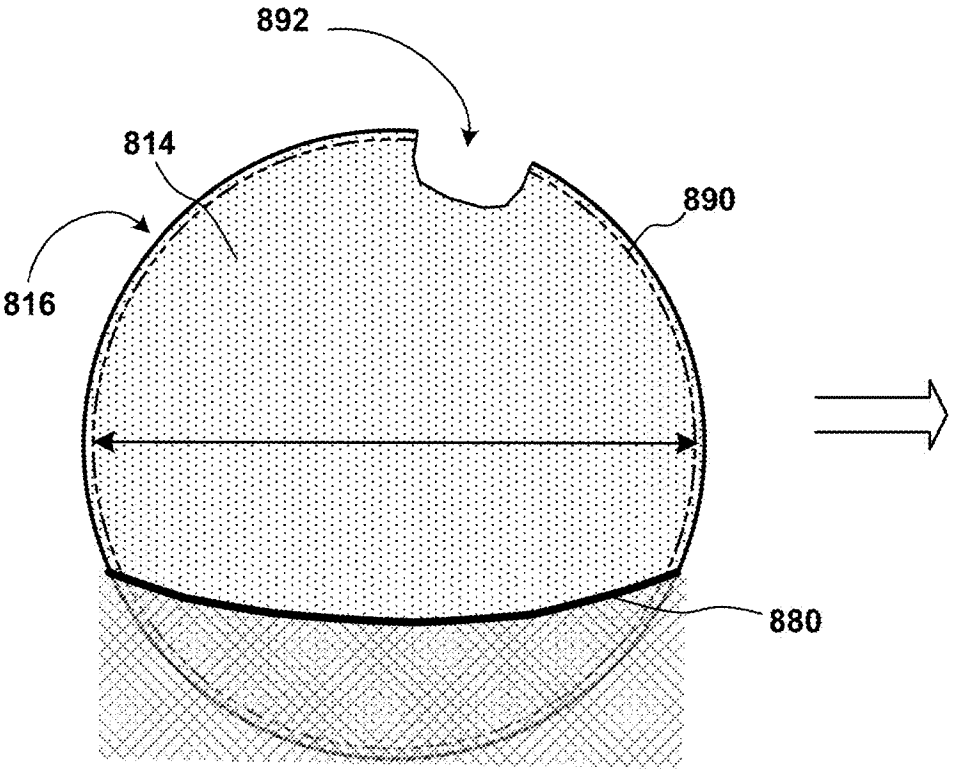

Referring now to FIGS. 20A to 20B, inflatable enclosure 810 is generally shown through actions related to fabricating and assembling the enclosure. As shown in FIG. 20A, a pair of opposing flexible sheets 814, 816 are formed defining a circular shape and having a notch 892. A trim path 880 can intersect the flexible sheets 814, 818 at a bottom region of the sheets to define the base 882. A top opening frame 832 can be is installed in a top opening 830 defined by the notch 892. In some arrangements, trim path 880 can include a curved trim path that is configured to form a generally planar arrangement for the corresponding base and base opening when the enclosure is in the inflated condition. In other arrangements, the trim path 880 can be configured to form a base and base opening configured to fit within a base surface, such as a curved base surface. It is further understood that the trim path can be a conceptual trim path, such that each material sheet is formed to have a shape corresponding with the shape shown in FIG. 20B after intersection with the trim path 880.

Figure 22:
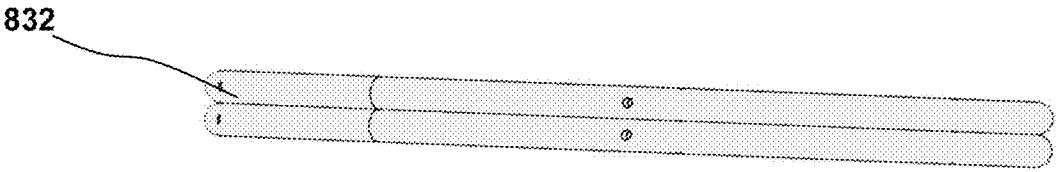
Figure 23:
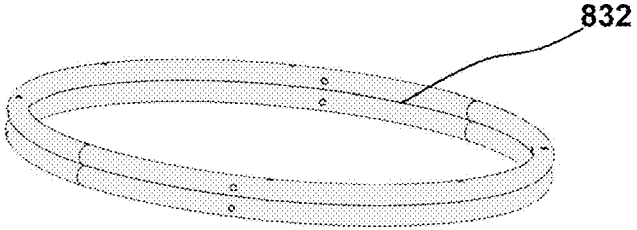
Figure 21:
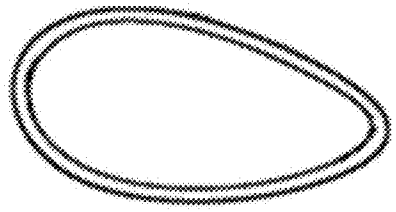
FIG. 21 shows a side perspective view of the inflatable enclosure of FIGS. 18A and 18B, and FIGS. 22 and 23 show a side view and a top perspective view of a top port frame that can be installed in the inflatable enclosure of FIG. 21.
Figure 21:
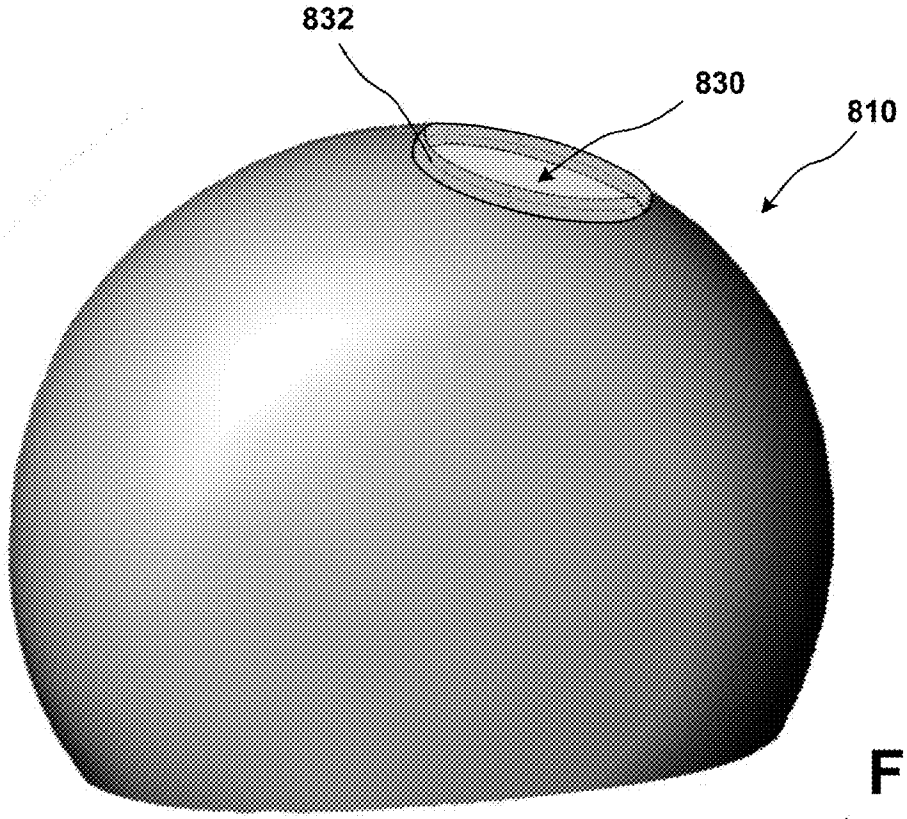

Referring now to FIGS. 21-23, a close view of the top port frame 832 shown in FIG. 20B is shown in the elevation view in FIG. 22 and in a perspective view in FIG. 23. As shown, top port frame 832 differs from top port frame 132 shown in FIG. 5A along with inflatable enclosure 110 of FIG. 2, in that example top port frame 832 is formed from a stacked pair of matching hoops or rings. Similar to the arrangement of top port frame 132, the hoops of the top port frame can be formed as rigid reinforcement members for installation in the inflatable enclosure within top port 830. The top port frame can be configured for secure attachment to the seam attaching the two sheets to each other at each side of the frame for maintaining mechanical equilibrium of the enclosure about top port 830. Further, the top port frame 832 can be arranged in its attachment to the inflatable enclosure to resist tensile and compressive stresses and forces encountered with respect to the enclosure, and transmit the same through the top port frame 832 as if top port 830 had not interrupted the inflatable enclosure shape and arrangement.

Referring now to FIGS. 24 to 29, a DAP System 540 is shown similar to DAP System 140 described along with FIG. 2. DAP system 540 generally includes a support platform 542 to which the base 882 of inflatable enclosure 810 is securely attached in a sealed or airtight connection with an inflation device (not shown), as well as an exercise device 560. The arrangement of DAP system 540 enables various beneficial features, such as arranging the base 882 and base opening 884 of the inflatable enclosure 10 in a position disposed vertically over exercise device 560, along with aligning base 482 with an access region 562 for the exercise device that allows a user to access the exercise device and perform exercises via the exercise device.

Figure 24:
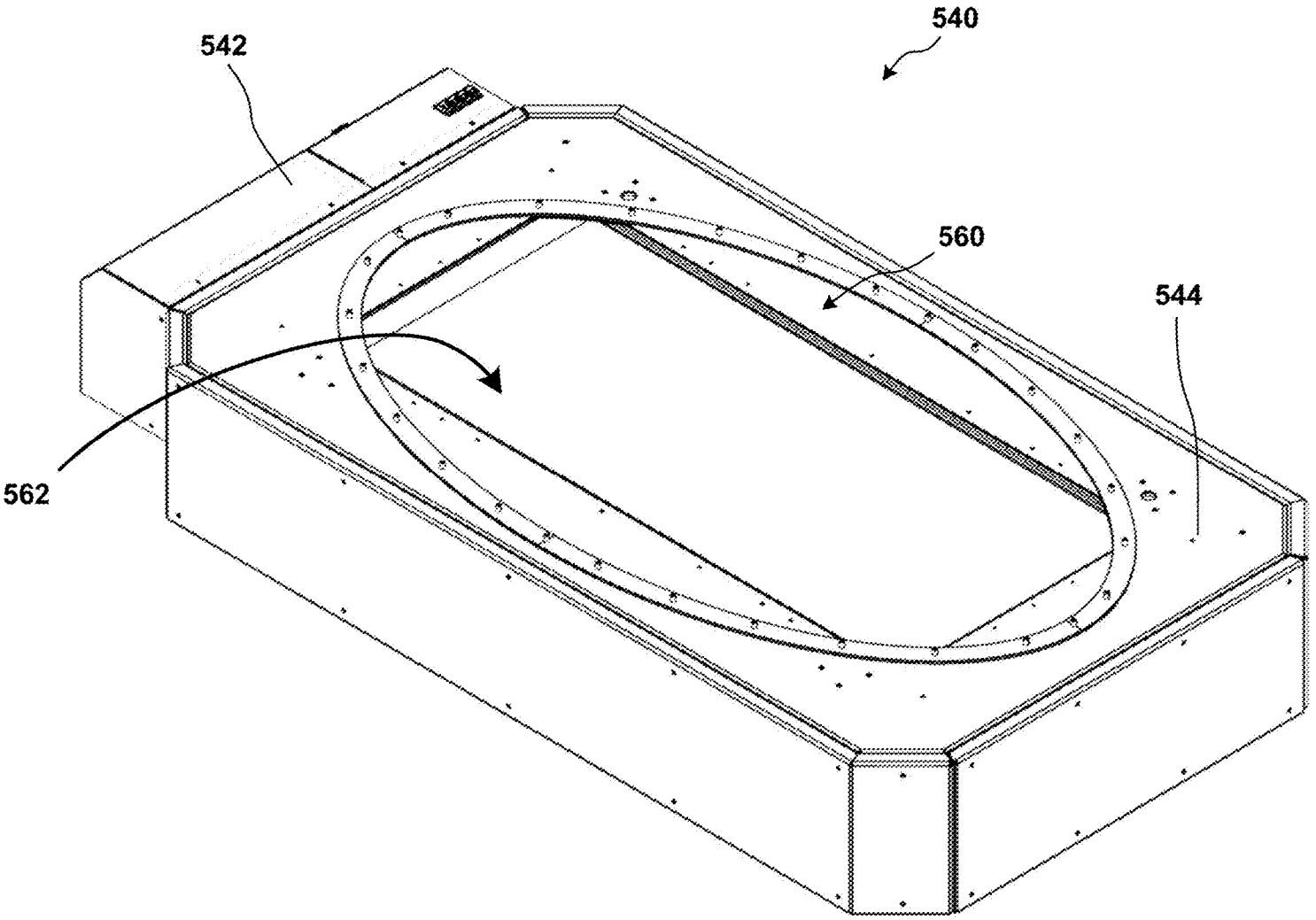
FIG. 24 shows a top perspective view of an exercise device that can be used with an inflatable enclosure according to aspects and features described herein.
Figure 25:
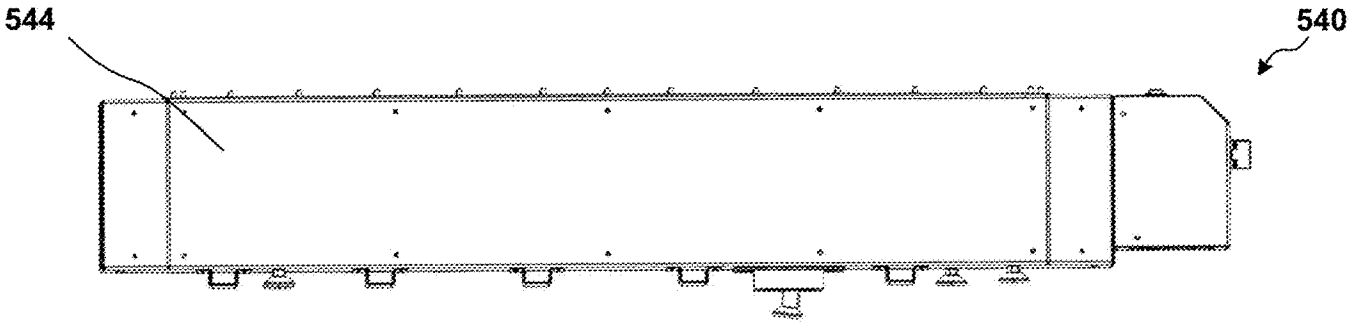
FIG. 25 is a side view.
Figure 27:
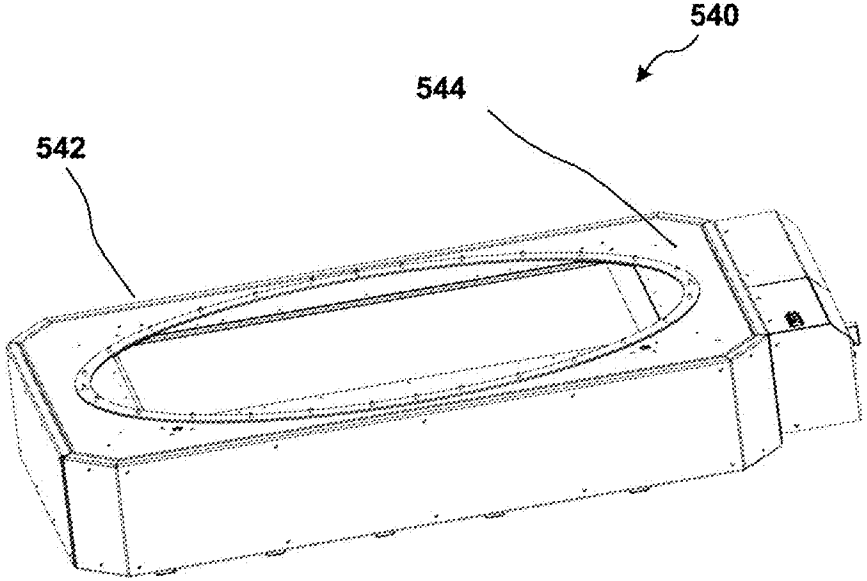
FIG. 27 is a side perspective view of the exercise device of FIG. 24.
Figure 26:
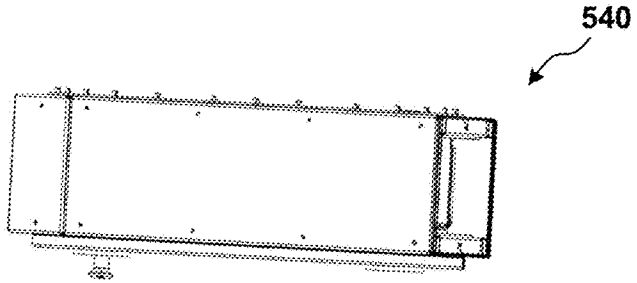
FIG. 26 is an end view.
Figure 28:
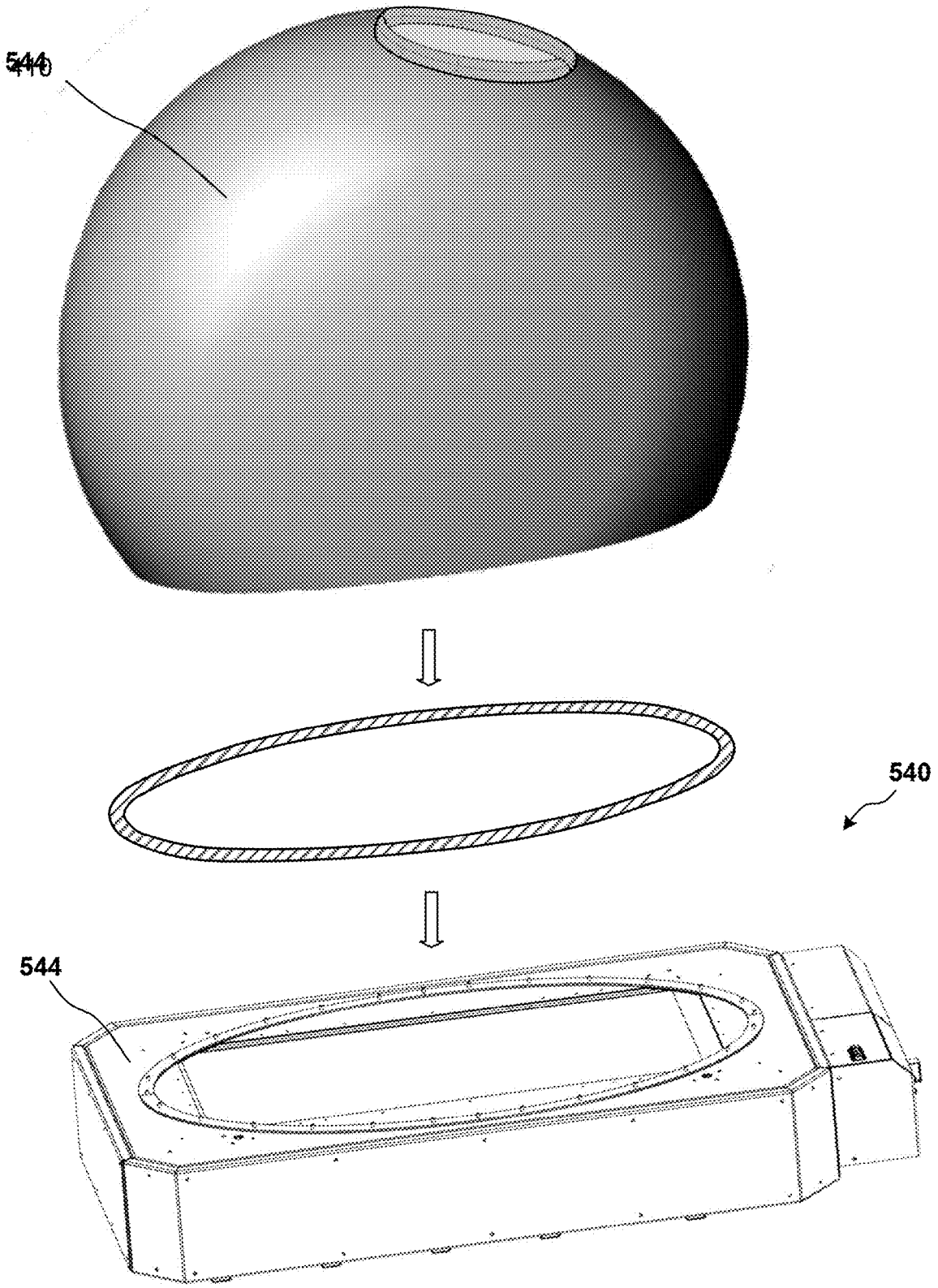
FIGS. 28 and 29 show perspective views pertaining to an example inflatable enclosure according to aspects and features of innovative subject matter described herein, shown in combination with the exercise device of FIG. 24.
Figure 29:
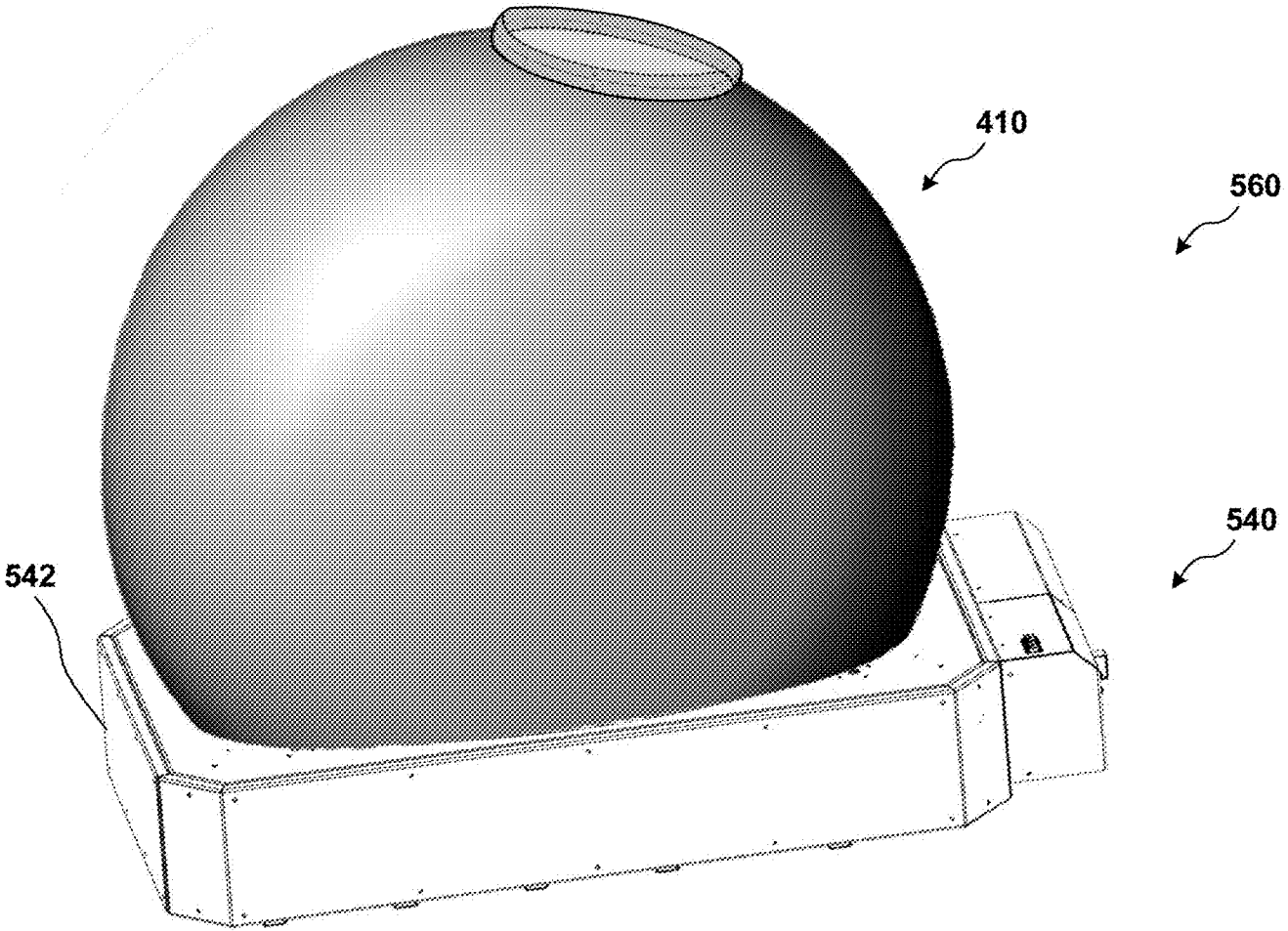

In addition, as depicted in FIG. 24, the support platform 542 provides a secure support surface 544 closely arranged about the base of the inflatable enclosure 810, which can firmly attach the base 882 of the inflatable enclosure in an airtight connection permitting independent support of the enclosure when inflated to extend from its base upward in a vertical direction for supporting a user above the access region of the exercise device. Further, the inflatable enclosure 810 in such an orientation and arrangement operatively supports itself and the user within in a low-profile, space-saving environment about the same size as the profile and environment as for using the exercise device apart from the DAP system 560.

Figure 30:
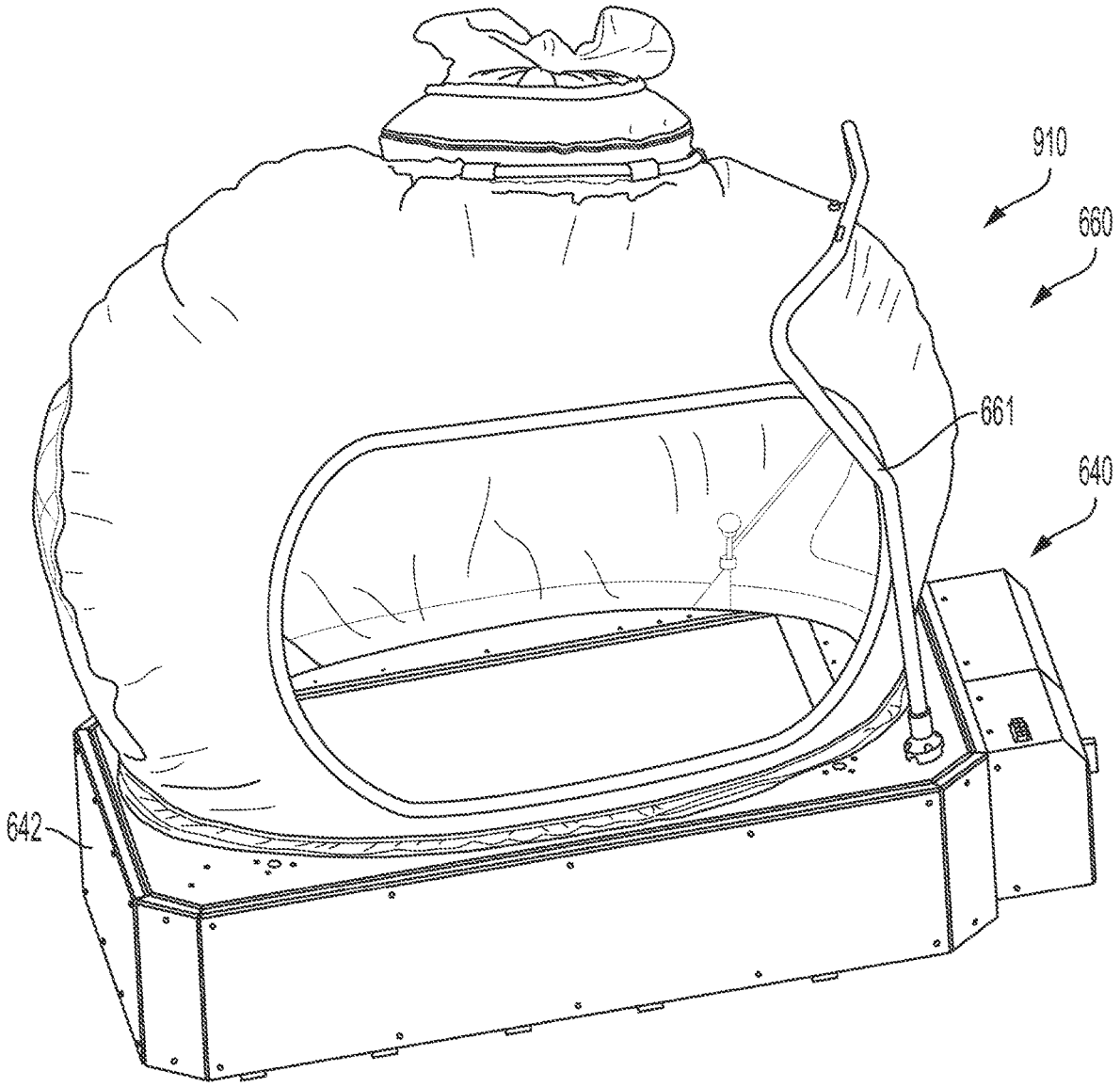
FIG. 30 is a perspective view of yet another example inflatable enclosure arrangement according to aspects and features pertaining to inventive subject matter for inflatable enclosures of DAP Systems described herein, which is shown installed on an additional example arrangement of DAP System.

Referring now to FIG. 30, yet another DAP System 660 including an exercise device 640 and an inflatable enclosure 910 is generally shown according to aspect and features of inventive concepts described herein pertaining to DAP System inflatable enclosures. DAP System 660, exercise device 640, and inflatable enclosure 910 generally include the aspects and features described above along with other DAP Systems and inflatable enclosures including, in particular, DAP System 560, exercise device 540, and inflatable enclosure 810. Accordingly, like nos. refer to like features.

DAP System 660 and exercise device 640 differ from DAP System 560 and exercise device 540 only in minor respects pertaining to design options. As shown in FIG. 30, DAP System 560 includes a grab handle 661 provided as a convenience for the user to grab while exercising without grab handle 661 exerting any meaningful support or influence of inflatable enclosure 910. As further shown, grab handle 661 is attached at a proximal, base end to a support surface of the exercise device, which can allow the grab handle to be place close to the user while within the inflatable enclosure without interfering with exercise activities or operations of the DAP System.

Figure 31A:
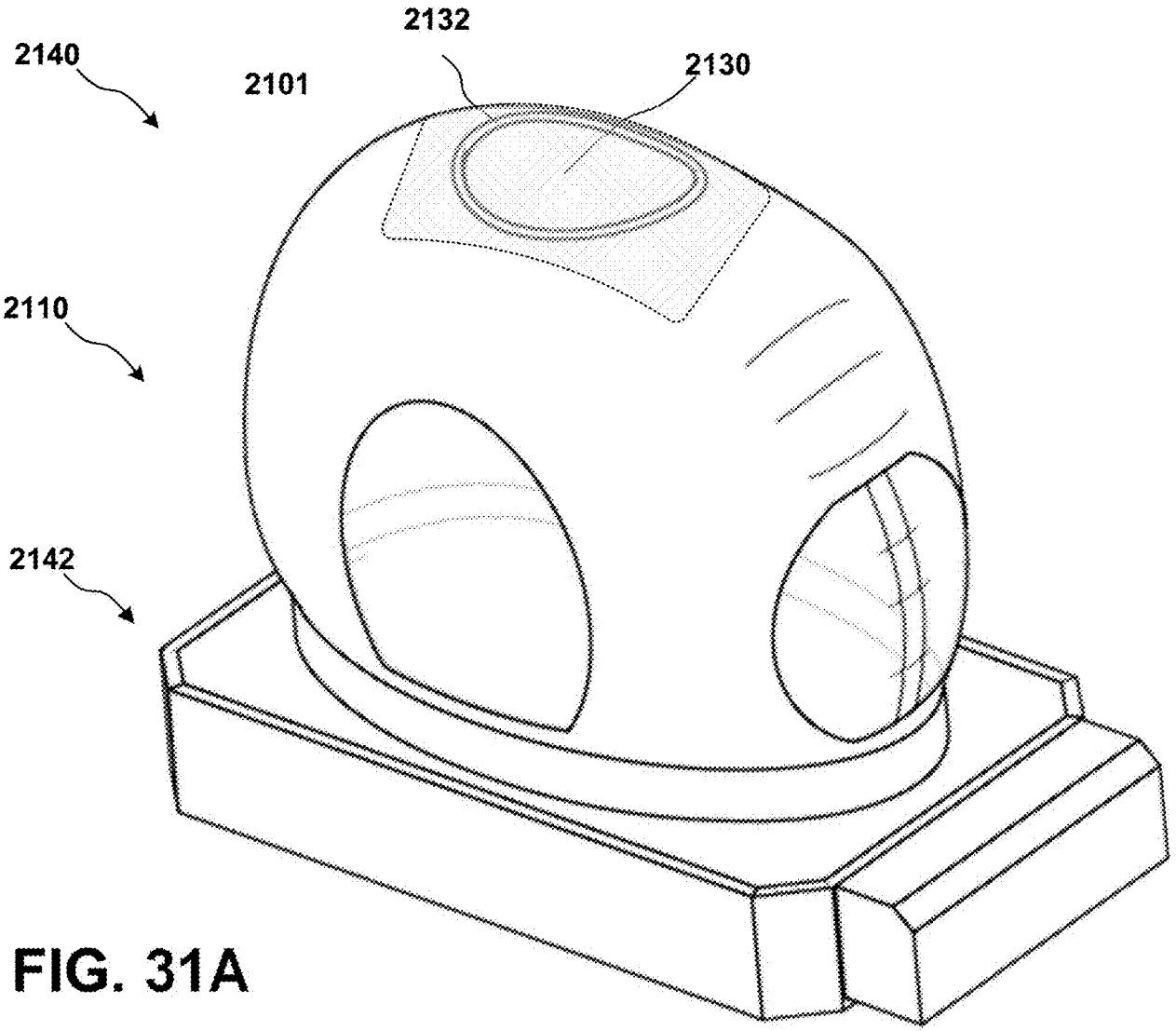
FIG. 31A is a top perspective view of a schematic representation of an independently-supportable inflatable enclosure as part of an example DAP System.

Self-Supporting Enclosure Arrangements and Customizations for Expanded Movement Freedoms & Optionally Usable with Hybrid Frameworks Referring now to FIG. 31A, a DAP System 2140 is generally shown having a similar platform and enclosure arrangement as other DAP Systems described herein. As such, DAP System 2140 generally includes the aspects, features and preferences of other example DAP Systems and enclosures discussed along with related applications except as discussed hereafter. Thus, like numbers refer to like features.

As shown in FIG. 31A, DAP System 2140 includes a two-panel enclosure having a generally circular shape when inflated, which can be formed from a pair of flexible circular shaped sheets. Two-panel enclosure 2110, as well as other two-panel enclosures shown and described herein, provide upward, unweighting lift forces when inflated in accordance with a pressure differential between air inside the enclosure and current atmospheric pressure conditions.

As has been discussed in greater detail previously, such an inventive arrangement for similar two-panel enclosure arrangements can provide many advantages and benefits for use with DAP Systems and, in particular, for DAP enclosures. Among other benefits, such a DAP enclosure arrangement can provide enhanced balance and control over the application of forces through the enclosure, which can significantly reduce the need for reinforcement and support structures along with minimizing the likelihood and extend of risk related to high force applications. The inventive two-panel arrangement of enclosure 2110 can orient and control the application of forces such that side, vertical wall portions of the enclosure can carry high stresses from the applied outboard forces through the skin or sheets of the panels, which effectively forms a pair of vertical support columns along the vertical, side wall regions of the enclosure while also providing effectively zero or low hoop stresses therebetween including along the top region of the enclosure in which a top opening is formed. A seal frame 2132 can be installed for structurally supporting the opening and connecting with user support interface mechanisms, such harness devices and clothing.

Thus, the user can be located within the zero or low hoop stress region of the inventive two-panel enclosure 2110, such that user risks can be significantly reduced and unweighting support can readily be provided for the user without the user encountering rigid restraints or significant movement limitations when exercising. In particular, the seal frame 2132 connections can generally cooperate to provide 'floating' lift support for the user by allowing high levels of movement freedoms and flexibility compared with conventional DAP Systems that maintain fixed seal frame locations and user interface positions. Optional enclosure arrangements including customized enclosure designs for supporting particular exercise movements and types can be provided based on the inventive aspects, features, and concepts discussed herein and described in previous related provisional patent applications for two-panel enclosure arrangements.

Figure 31C:
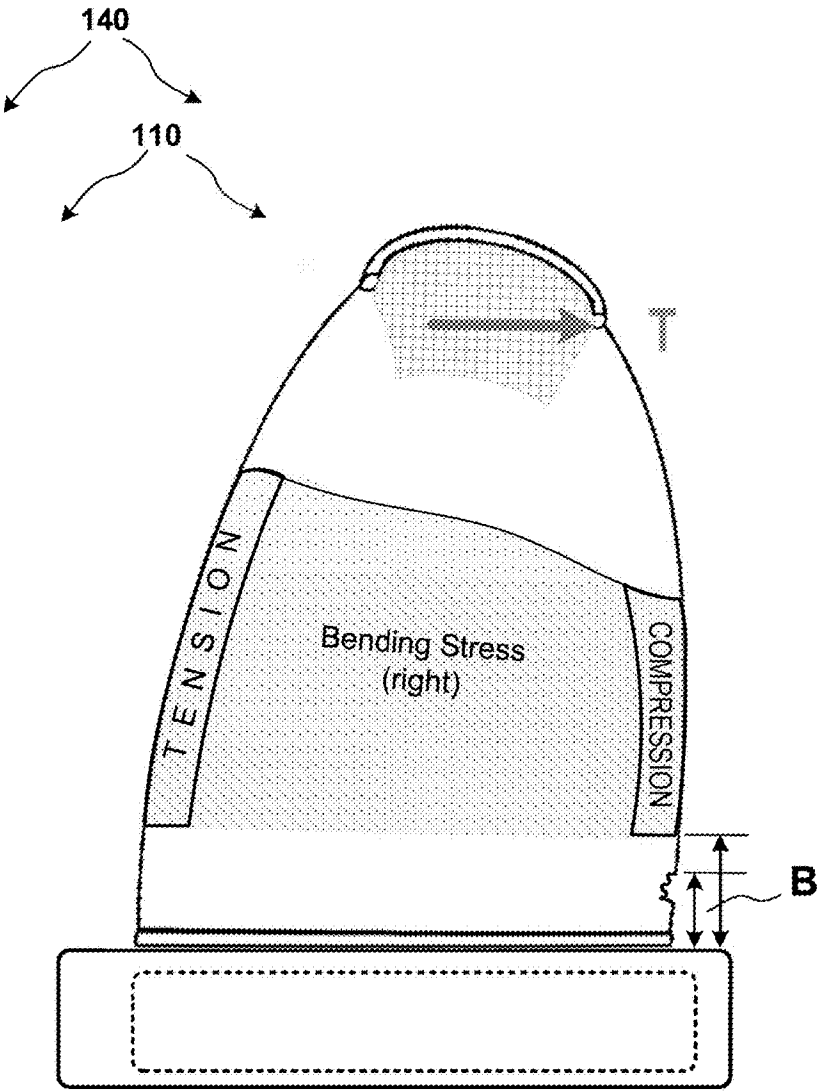
FIG. 31C is a schematic representation of an example buckling failure mode based on modeling data for an inflatable column (right bend direction).
Figure 31B:
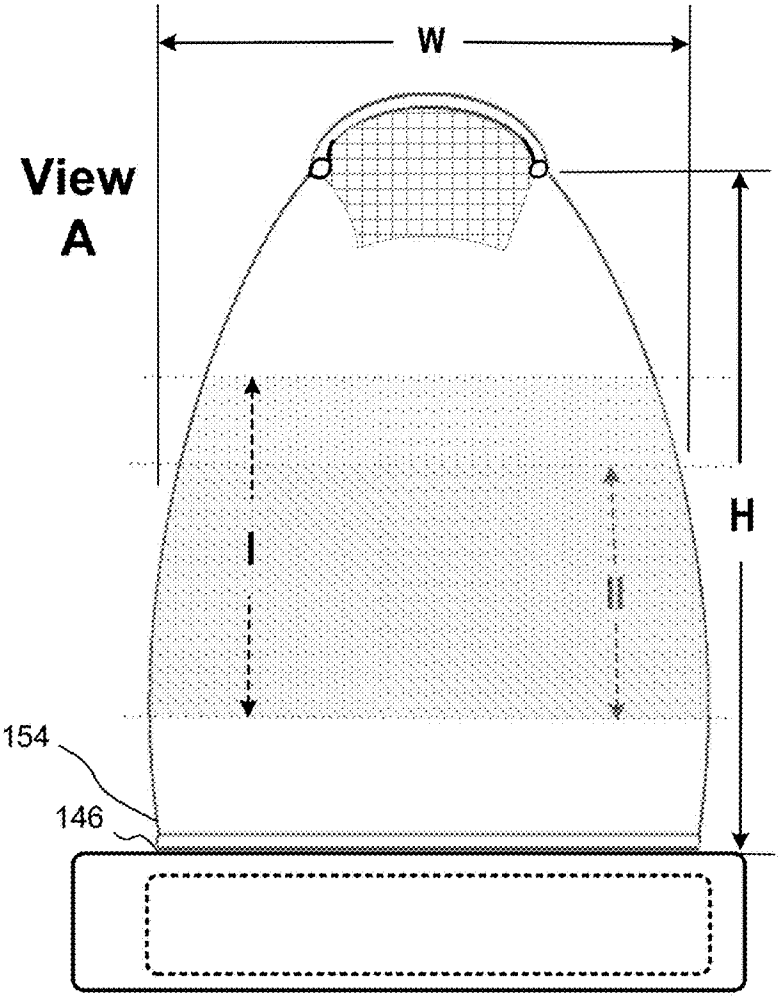
FIG. 31B is a cross-sectional view of the inflatable enclosure and DAP System of FIG. 31A taken along line A-A shown in FIG. 31A.
Figure 31E:
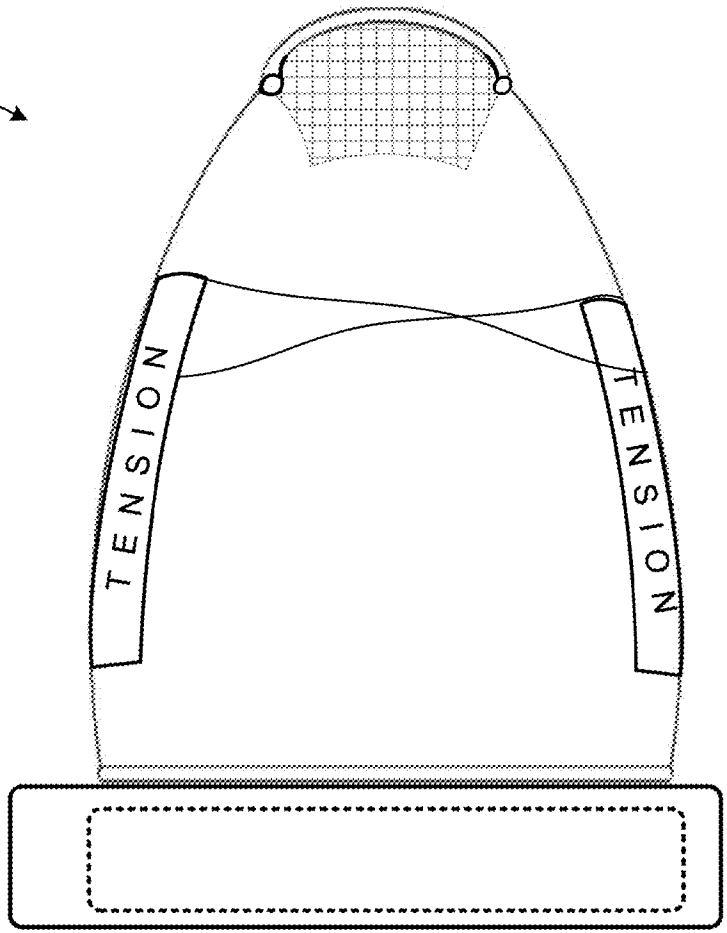
FIG. 31E illustrates bending stress profiles across opposite sides of enclosure 110 with respect to tensile stress components of bending, which can be mitigated and reinforced to resist via attachment of tensile members along portions of the enclosure.
Figure 31D:
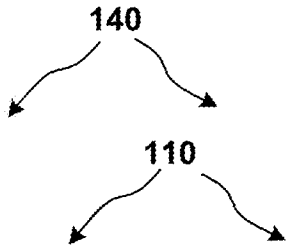
FIG. 31D is a cross-sectional view of the inflatable enclosure and DAP System of FIG. 31A similar to FIGS. 31B & 31C illustrating modeling data for left bending data.
Figure 31D:
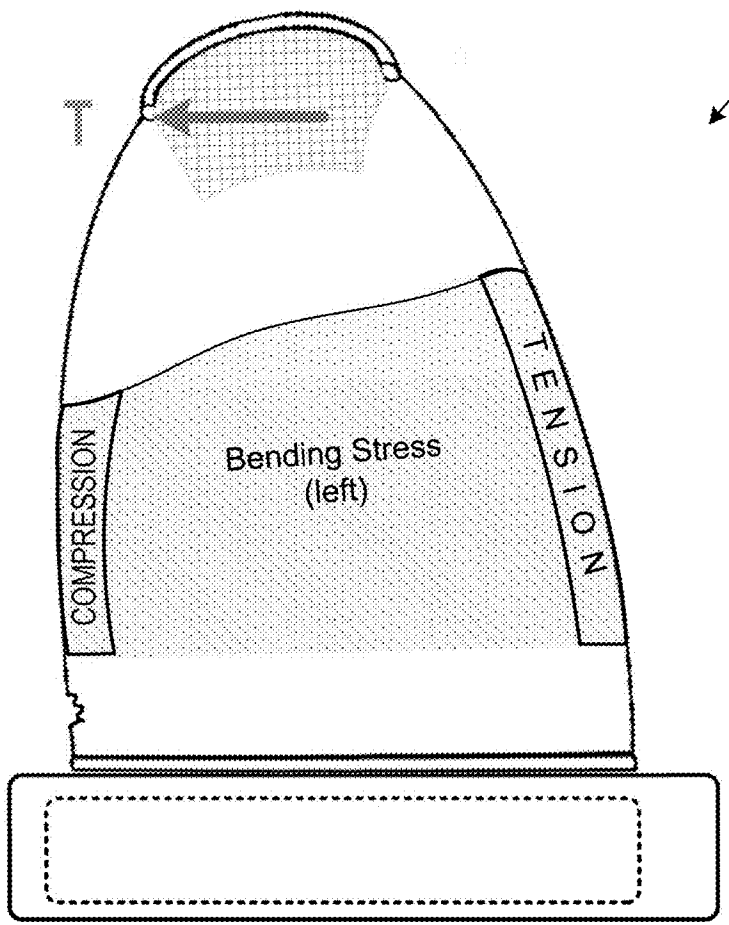

Referring now to FIG. 31B along with FIGS. 31C to 31E, cross-sectional view representations of DAP System 2140 and inflatable enclosure 2110 of FIG. 31A are shown in FIGS. 31B to 31E are illustrated and described for use with an elongated exercise device (primarily a treadmill) that extends a greater distance in a fore-aft direction of the user during use than it does in the widthwise (Left-Right) direction across the user during use of the exercise device. As such, vertical cross-sectional views through the top port 130 can generally represent a vertical cross-section having the largest ratios of height to column width for the inflatable enclosure 2110, which can be a worst-case scenario of the enclosure regarding column strength. Evaluation of enclosure 2110 according to the corresponding cross-sectional depiction, ratios and other parameters regarding column strength and bending features can provide objective insights, guidance and information regarding potential reinforcement and stabilization of DAP System enclosures, which can improve enclosure performance and encourage, if not enable, the enclosure to be independently supportable.

With continued reference to FIGS. 31B to 31E, enclosure 2110 and other example enclosures described herein can be considered as thin-shelled inflatable columns for computer modeling considerations and corresponding evaluations of stresses and potential failure modes of the inflatable columns. Enclosure 2110 and other example enclosures described herein each have a bottom opening 2154 secured to a substantially horizontal bottom support 2146, which can be considered a boundary condition constraint of the respective inflatable column. Bending and buckling analysis when extended to the point of failure for such thin-shelled inflatable columns can be considered by assuming a surface Traction, T, applied in a perpendicular direction at the top of the column (e.g., applied normal to the top port 130 in the widthwise (Left-Right) direction), such as can be, for example, imparted by a user during use such as via Left-Right sway type movements.

FIGS. 31B to 31E depict within lower portions of the inflatable enclosure 2110 representations of mathematical functions for bending stresses within left and right lateral walls of the enclosure, which are essentially mirror images of each other if applied in an opposite manner (e.g., left bend vs. right bend). The curves show that high stress functions can approximate profiles of stresses carried within enclosure wall 2113 during use of the DAP System 2140. Approximate stress profiles for lateral wall portions of enclosure 110 are shown based on characteristics of enclosure 2110 (e.g., height and shape profile of the enclosure), which are generally applicable for use of DAP System 2140 by persons walking or running at for a wide range of skills and sway variations. The alternating nature of a person walking, and the chiral nature of each person's legs for interacting with the ground and/or for interacting with DAP Systems, as well as the shape and arrangement of enclosure 2110 in a longitudinal direction aligned with the user's orientation during use, support evaluations of bending stresses encountered withing the enclosure, such as via FEA or FEM studies, established engineering models, and the like. FIGS. 31A to 31E shown general representations of bending stress profiles for enclosure 2110 during user movements such as walking and running movements based on evaluations of thin-shelled inflatable columns having similar boundary condition constraints as enclosure 2110 and related arrangements.

With particular reference to FIGS. 31B & 312C, in accordance with bending stress evaluations for enclosure 2110, the Applicant determined that potential buckling can occur at a buckling distance, B, above base opening 2154, which was found to be 10% to 20% of a height, H, of the enclosure. More particularly, the Applicant determined that a buckling distance, B, can be about 15% to 17% of the height, which can be rounded to a distance of about 20% of the enclosure height, H. Further, that Range I indicates high tensile stress regions along the height, H, extending from a location just above (excluding) buckling distance, B, upward along the height to a location about 65%-70% of the column height bending in one lateral direction, whereas Range II identified high compression stress along the height, H, of the inflatable enclosure 110 that can occur that can generally occur for matched bending stresses in the opposite lateral direction.

Enclosure 2110, and other example enclosures discussed herein, as well as most conventional DAP System inflatable enclosures are arranged to form balanced, force-offsetting enclosures having matching performing characteristics and other parameters on each side of centerline of the enclosure when oriented for use, such as a left vs. right side of the enclosure 110 on each side of the enclosure seam. As such, each of Range I and Range II apply along each of the Left and Right sides of the cross-sectional shape of FIG. 31A depending on whether bending forces are applied for bending/buckling in the Left vs. Right direction.

Properties of thin-shelled inflatable columns with respect to column strength and bending/buckling analysis noted above can apply to example inflatable enclosure 110 and related enclosures discussed herein. Further, these properties can differ for different enclosure arrangements according to factors such as enclosure geometry, air flow properties and static/dynamic characteristics, air pressure, and enclosure material properties such as flexibility, rigidity, permeability, and the like. Further, such principles can differ in accordance with boundary conditions such as venting options, number and/or arrangement of openings, and constraints such as pinned and/or partially pinned parameters such as can be incurred via connections with framework members and/or discrete rigid supports. In addition, properties for range I and range II discussed above can likewise differ for similar reasons.

That said, general principles applicable to thin-shelled inflatable columns can nonetheless apply to inflatable enclosures for DAP Systems having a wide variety of arrangements and properties including both independently-supportable and supported/partially supported inflatable enclosures having one or more connections with rigid support members. Further, such general principles can impact arrangements for reinforcement, height-adjustment, safety and/or other types of devices configured for use with DAP System inflatable enclosures including enhancing functionality and structural integrity. For instance, with respect to column strength and bending/buckling considerations of inflatable enclosures for use with DAP Systems, it is understood that column strength can be enhanced, and resistance for bending and buckling can be improved by improving tensile strength along a vertical portion of the enclosure opposite a bend force and/or by improving compressive strength along a vertical portion of the enclosure aligned with the bend force. However, basic properties of inflatable thin-walled columnar arrangements can limit options for improving compressive strengths, which can degrade structural integrity of the enclosure. Solutions and improvements for stabilizing and reinforcing enclosures based, at least, on evaluations of bending stresses can include geometric, pressure and/or material (enclosure wall) modifications for example.

With continued reference to FIGS. 31C to 31E, analysis of static and dynamic properties of enclosure 2110 under varying loads, pressures, and boundary conditions indicates enclosure 2110 is generally configured to experience minimal compression and/or tensile forces proximate top bracket 2132 that are significantly related to structural integrity of the enclosure. This appears to be the case even though relatively high tensile stresses can be incurred within the enclosure skin at a distance below the top bracket that it is about 30% of the overall enclosure height (i.e., within upper portions of Range I).

Figure 32:
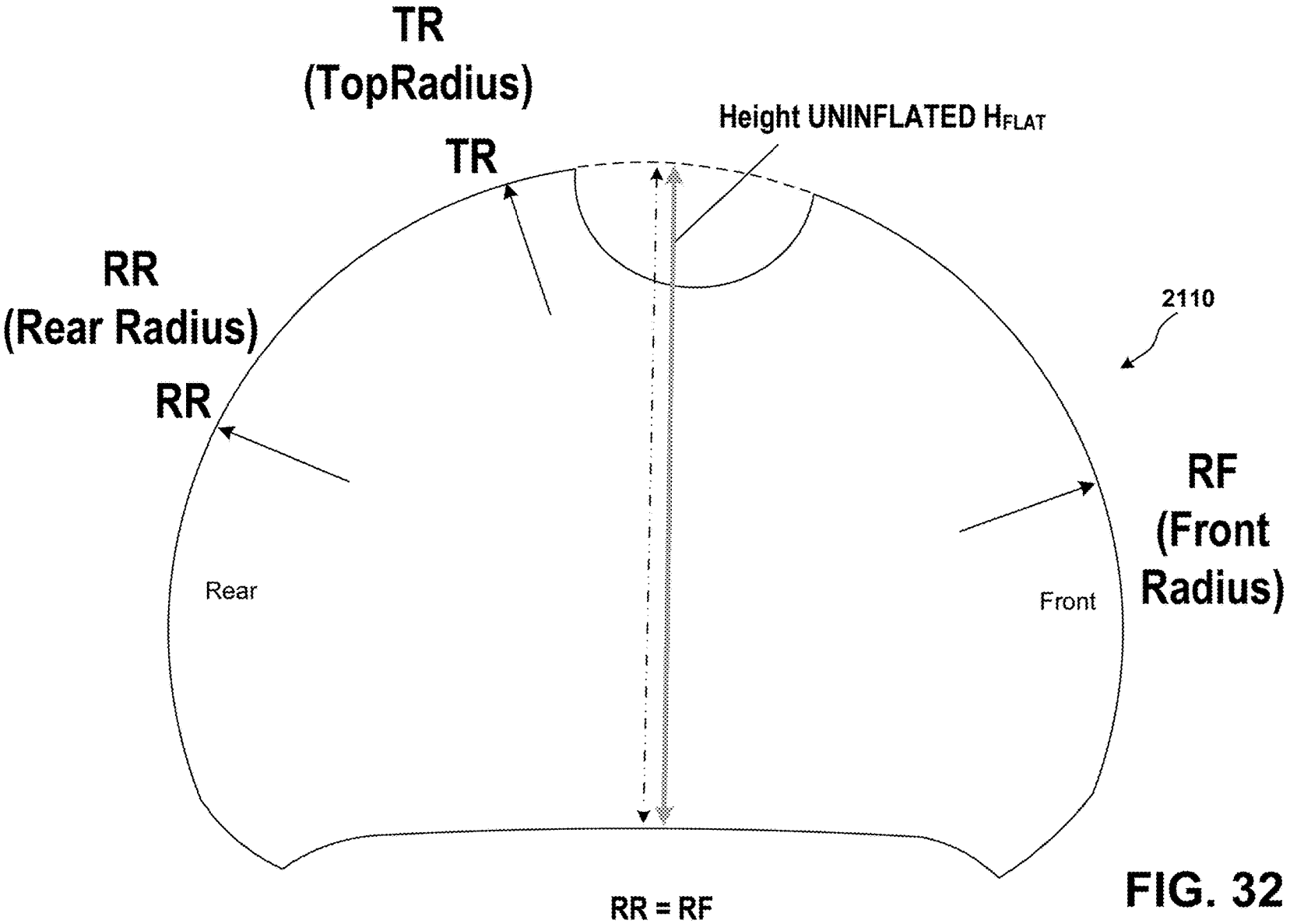
FIG. 32 shows a schematic representation of a flat material sheet cut pattern for the pair of flexible sheets of the enclosure of FIG. 31A.
Figure 33A:
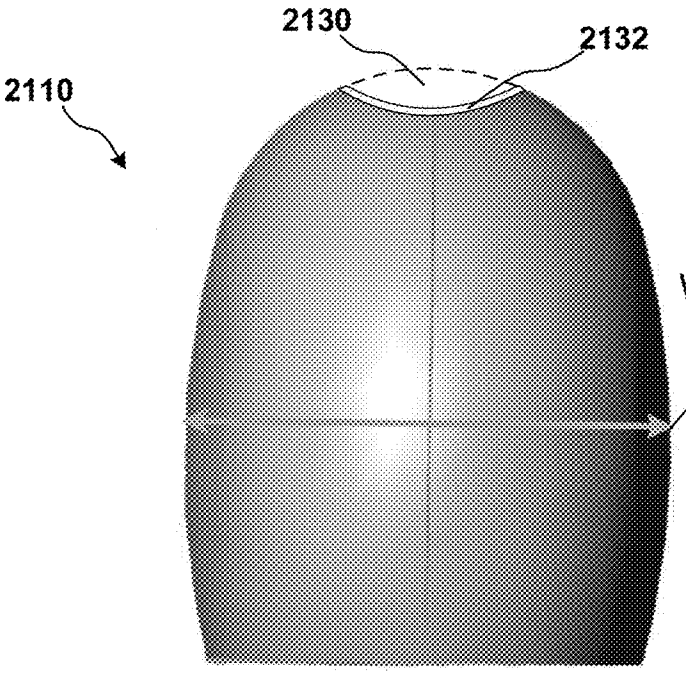
FIGS. 33A and 33B show front and side views representative of the enclosure arrangement of FIG. 31A.
Figure 33B:
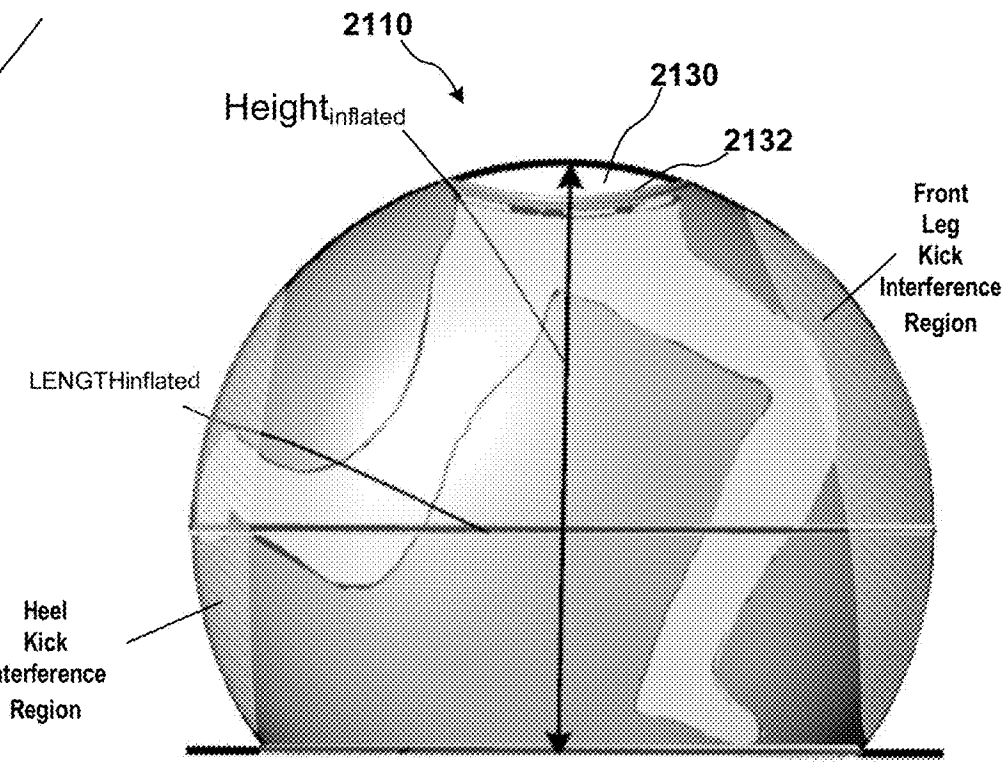
Figure 34:
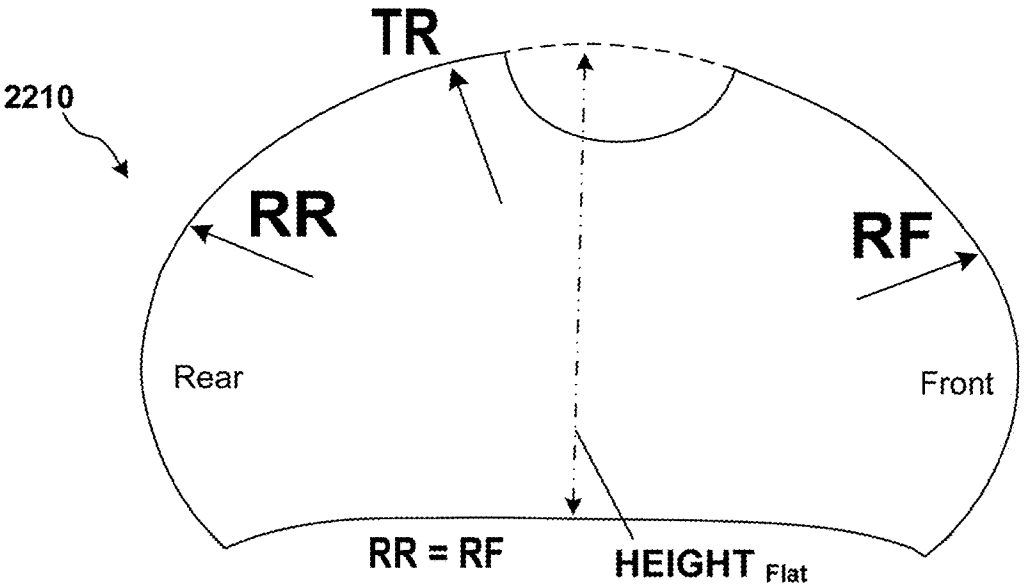
FIG. 34 shows a schematic representation of a flat material sheet cut pattern for a pair of flexible sheets of a fore-aft symmetrical ovoid-shaped enclosure similar to the DAP System depicted in FIG. 31A and other example DAP Systems discussed herein, which includes a symmetrical egg-shaped or ovoid-shaped enclosure formed by joining a pair of opposing, generally identical, flexible sheets according to the cut pattern to each other along a seam (not shown) extending about perimeter portions of the flexible sheets except along a bottom portion that defines a bottom opening of the enclosure according to aspects, features, inventive concepts and example configurations discussed or shown herein.
Figure 36:
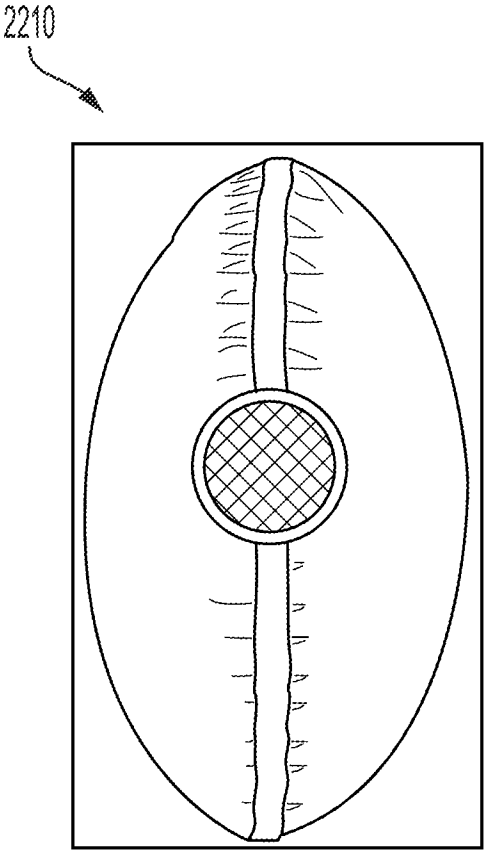
FIGS. 35 and 36 show front and top views of an example enclosure for an example DAP System according to the flat material sheets of FIG. 34.
Figure 35:
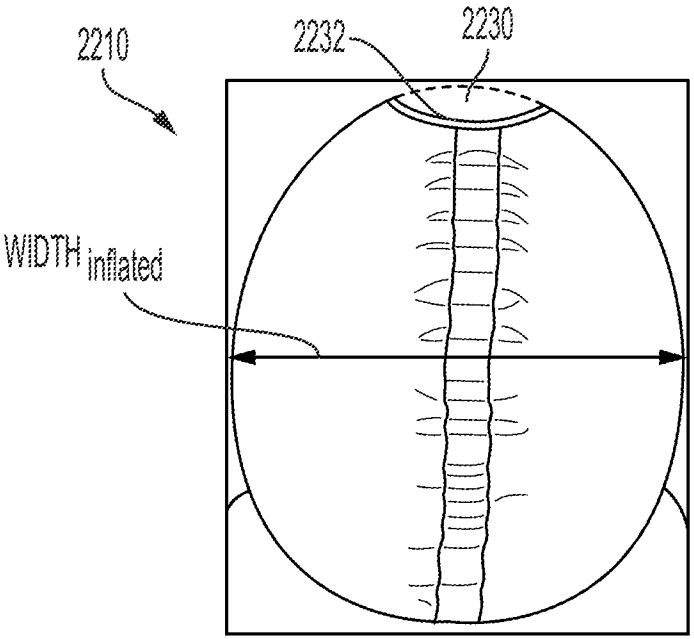

Referring now to FIGS. 32 to 33B, example characteristics are shown and described for circular-shaped enclosure 2110. As best shown in FIG. 32, each sheet of the pair of flexible sheets that form enclosure 2110 can have a circular shape, such that a front radius, RF, a top radius, TR, and a rear radius, RR, along perimeter portions of each sheet and enclosure 2110 can generally be the same. Such an arrangement can include modifications for the benefit of particular exercises and movements, such as the location and orientation of the base opening along with placement of the top opening cooperating to bias the seal interface and user location use closer to the front of the DAP System than the rear.

Nonetheless, as shown in FIG. 33B, a circular shaped enclosure arrangement can limit particular motions and movements for many users, such as limiting front and rear leg kick movements. As noted along with FIG. 33A, circular shaped enclosure 2110 formed from a pair of mated flexible sheets can maintain ratios for the inflated Height and Width of the enclosure versus the uninflated Height of the flexible sheets at about 80% meaning the overall inflated height of the enclosure is effectively about 80% of its uninflated height dimension. Further, each of the pair of flexible sheets can expand apart from each other at a width or depth that is about 40% of the uninflated height of the flexible sheets, or about 80% of the height overall for combined spaced apart distance of the flexible sheets from each other. Such ratios can indicate a balanced arrangement of forces being applied to the enclosure along both vertical and transverse directions for the enclosure and maintaining equilibrium conditions for the inflated enclosure arrangement in accordance with aspects, features and concepts described herein for two panel enclosure arrangements.

Referring now to FIGS. 34 to 37, an additional enclosure arrangement 2210 is generally shown that can provide enhanced freedom of movement and indeed naturally forming a shape maximally efficient for movement that is sloping down on the sides faster than in the front or back, thus avoiding impacting arms during running will allowing leg and knee movement during running, for the user during use of the DAP System and, in particular, increased ranges of motion for running and types of exercise with the system including allowing greater leg kick motions and ranges of movements provided in front of and behind the user without experiencing interfering contact with enclosure walls. Enclosure 2210 generally includes the same aspects, preferences and features as enclosure 2110 and other example enclosure arrangements described herein and in related patent applications excepted as described hereafter for providing enhanced leg kick and related movements.

Figure 37:
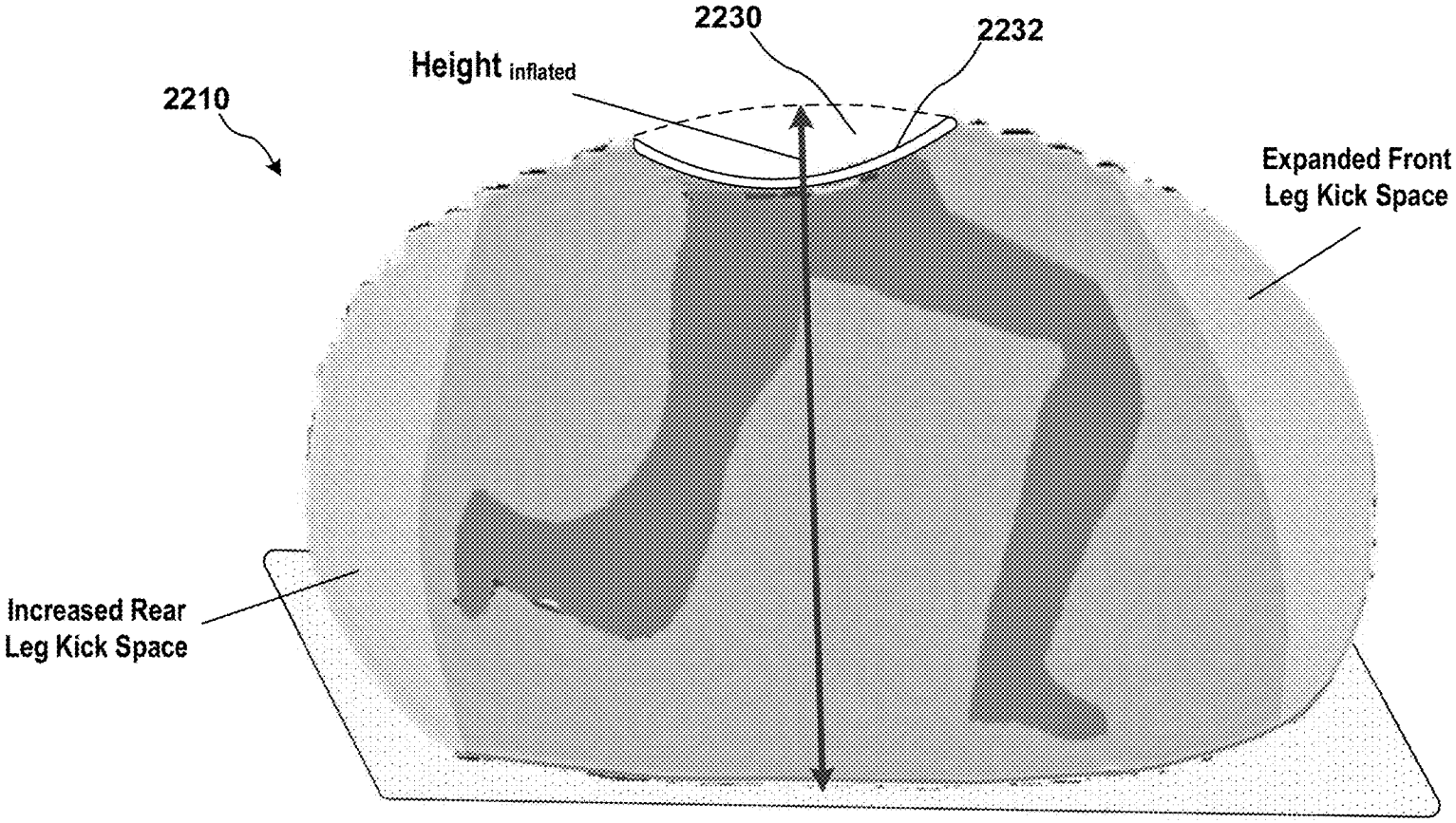
FIG. 37 shows a schematic representation of a fore-aft asymmetric ovoid-shaped enclosure similar to the DAP System depicted in FIG. 31A and other example DAP Systems discussed herein shown with a platform top surface, which includes an asymmetric egg-shaped or ovoid-shaped enclosure formed by joining a pair of opposing, generally identical, flexible sheets to each other along a seam (not shown) that extends about perimeter portions of the flexible sheets except along a bottom portion that defines a bottom opening of the enclosure according to aspects, features, inventive concepts and example configurations discussed or shown herein, which is depicted without windows or a corresponding platform.

As best shown in FIG. 37 according to the flexible sheet pattern for the enclosure, each pair of the flexible sheets and the resultant enclosure 2210 when inflated can have an optional ovoid or egg-shaped geometry, such as a symmetrical ovoid shape. Thus, as shown in FIG. 7, each flexible sheet of the enclosure can have a matching radius of curvature along its front perimeter portion (Radius-Front, RF) and along its rear perimeter portion (Radius-Rear, RR). In addition, each sheet can have a radius of curvature along its top perimeter portion (Radius-Top, TR) that is greater (less curved) than the radii of curvature for the front and rear regions (RF, RR). As such, enclosure 2210 can provide an extended length for the enclosure compared with circular shaped enclosure 2110 along with maintaining the same or similar height characteristics for the enclosure as for circular shaped enclosure 2110.

Figure 40:
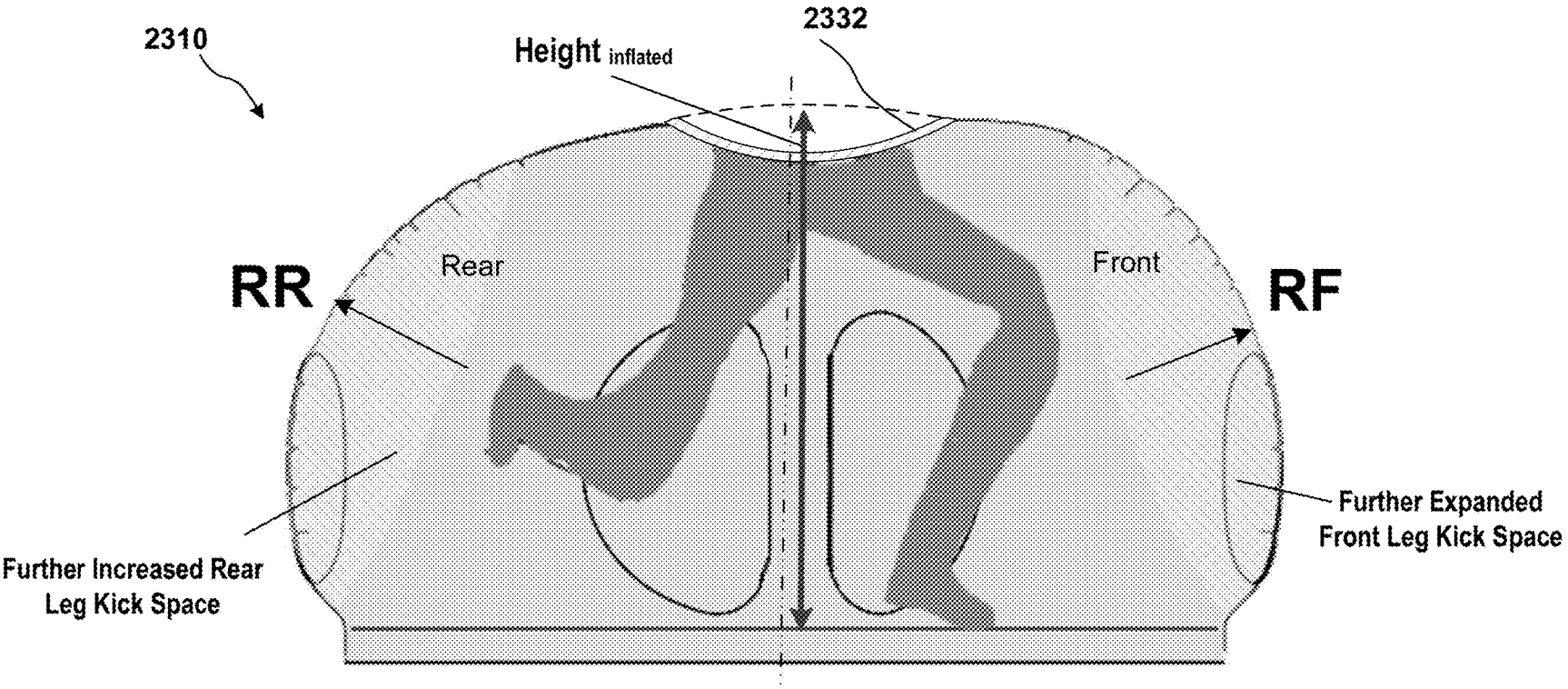
FIG. 40 shows a schematic side view of the enclosure of the DAP System of FIG. 39 without a platform thereof.
Figure 41:
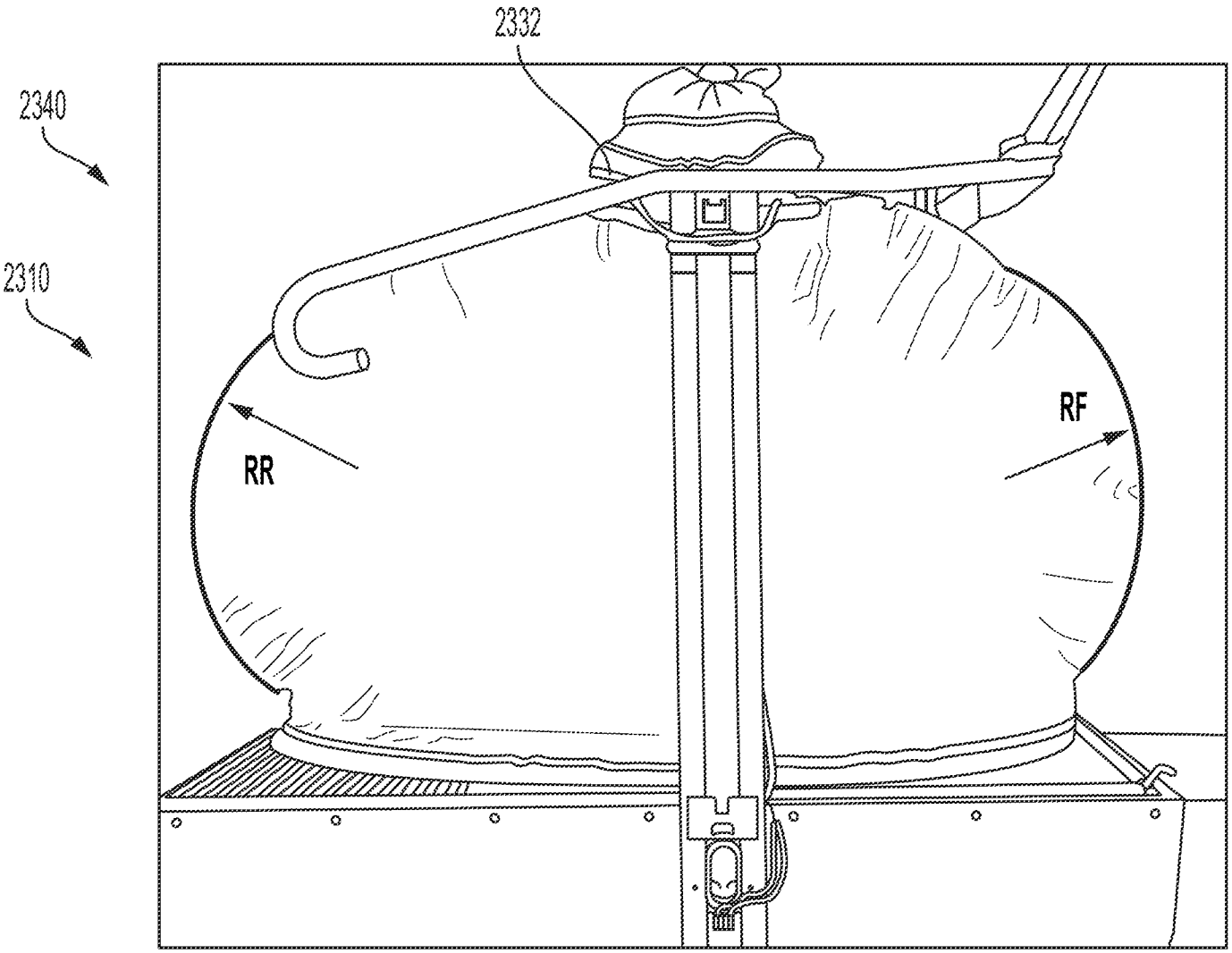
FIG. 41 shows a schematic side view of the DAP System of FIG. 39 shown with an example support platform and without the enclosure having windows formed therein.

As shown in FIG. 40, extended length enclosure 2210 can therefore provide extended space within the enclosure at front and rear portions within the 'egg' shape, which can provide for greater leg kick movements and running motion flexibility. As best seen in FIG. 9 from a top view of the enclosure, such a symmetrical shape and arrangement for enclosure 2210 having tighter radii at fore and aft regions of the enclosure can provide an efficient, bi-laterally (front & rear) tapered enclosure shape that more closely resembles a dish or disc shape when inflated compared with circular enclosure 2110. As such, enclosure 2210 can provide extended length features for the user with minimal, if any, adverse impacts for the arrangement and corresponding balance of forces pertaining to the inventive two panel enclosure construction. Rather, as noted along with FIG. 40, such an arrangement can maintain desired force application ratios for the outboard forces applied against each of the panels along with vertical lift forces and corresponding reaction forces. Further, the arrangement of enclosure 2210 formed as symmetrical, ovoid shape having increased taper features at the front and rear portions along with increased length can be provided without significant, if any, increased application of forces either vertically or applied as outboard forces.

Figure 39:
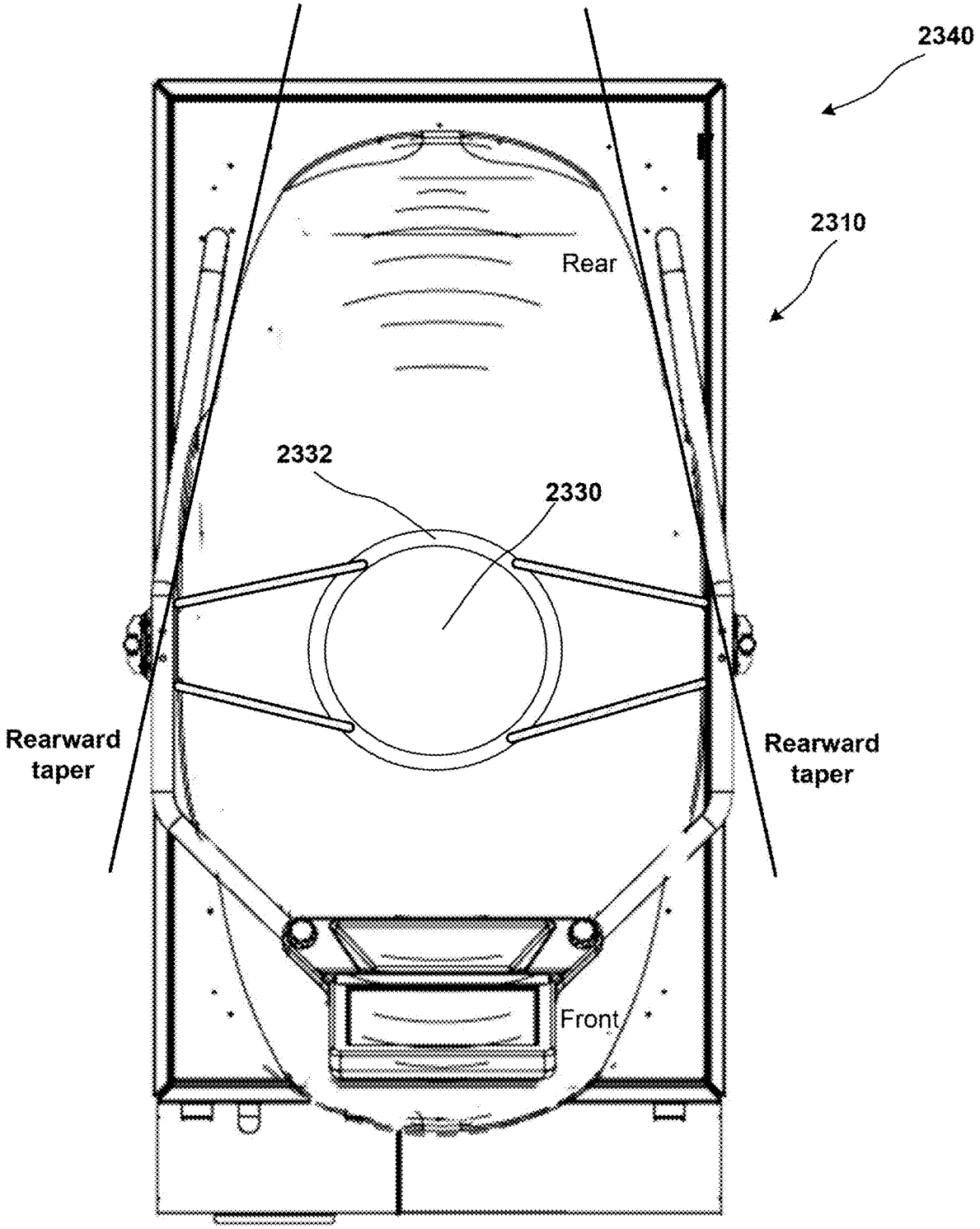
FIG. 39 shows a top view of a DAP System corresponding with the enclosure cut sheets of FIG. 39 along with an example platform thereof.

In general, a ratio for the inflated Height of an enclosure to a corresponding flat sheet Height, and also a ratio for the inflated transverse Width of the enclosure to the corresponding flat sheet Height have each been found to range from about 70% to 90% for enclosures formed from a pair of sheets joined at a perimeter seam extending along top, front and rear portions and exhibiting low hoop stress characteristics along at a top zone when inflated. This means the enclosure Height is about 10% to 30% less than the uninflated sheet Height, and that each sheet expands apart from the other when inflated a widthwise distance of about 35% to 45% of the uninflated sheet Height (collectively 70% to 90%. More specifically, for both ratios, ranges of about 75% to 85% have been shown to effectively provide two panel joined enclosure constructions having a top zone of low hoop stress, and more particularly ratios for both of about 80% are preferred. In particular regarding examples shown and discussed herein, a ratio for the inflated Height to the flat sheet Height of enclosure 2210 compared with the circular shaped arrangement increased from about 79% for example circular shaped enclosure 2110 to about 85%, and a ratio for the inflated Width to the flat sheet Height of enclosure 2210 increased from about 80% for circular enclosure 2110 to about 84%. As such, an increased length for the enclosure 2210 including enhanced leg kick regions can be provided compared with circular enclosure 2110 in a balanced arrangement of forces and with greater shape efficiency, such that the inflated enclosure 2210 can maintain a greater amount of its uninflated height via the arrangement of enclosure 2210. Further, even though the ratio of inflated Width vs. uninflated Height suggests increased width or thickness characteristics for enclosure 2210 compared with circular shaped enclosure 2110, the top view shown in FIG. 39 clearly denotes enhanced enclosure taper occurring at each end of the enclosure moving fore and aft of a middle portion of enclosure 2210.

Referring now to FIGS. 38 to 41, an additional enclosure arrangement 2310 is generally shown, which includes the same aspects, features and preferences as enclosures 2110 and 2210 discussed above along with other example enclosures described herein except as noted below. As such, like numbers refer to like features. Enclosure 2310 can provide, as an example, a customized arrangement for an optional enclosure configuration, shape or arrangement for best meeting desired motions, movements, preferences and/or types of exercises. As such, example enclosure 2310 and other customized arrangements can be provided via, for instance, an asymmetrical ovoid shape flexible sheet pattern for a corresponding pair of flexible sheets. Such an arrangement can be biased for particular exercise movements, user preferences and/or other advantages. For example, enclosure 2310 can include biased placement of the top opening and seal frame at a position closer to a front end of the material sheet and forward of its center.

In addition, a radius of curvature for the front perimeter portion can be greater than a radius of curvature for the rear perimeter portion, and a radius of curvature for a top perimeter portion can be greater than both the front and rear radii of curvature. As such, each flexible sheet pattern and the corresponding enclosure 2310 can generally include a wide, bull-nosed or bullet shaped, high height front extending from the front end to the seal frame, which can taper downward and also inward widthwise or depthwise extending from the seal frame to an extended length rear end.

Figure 38:
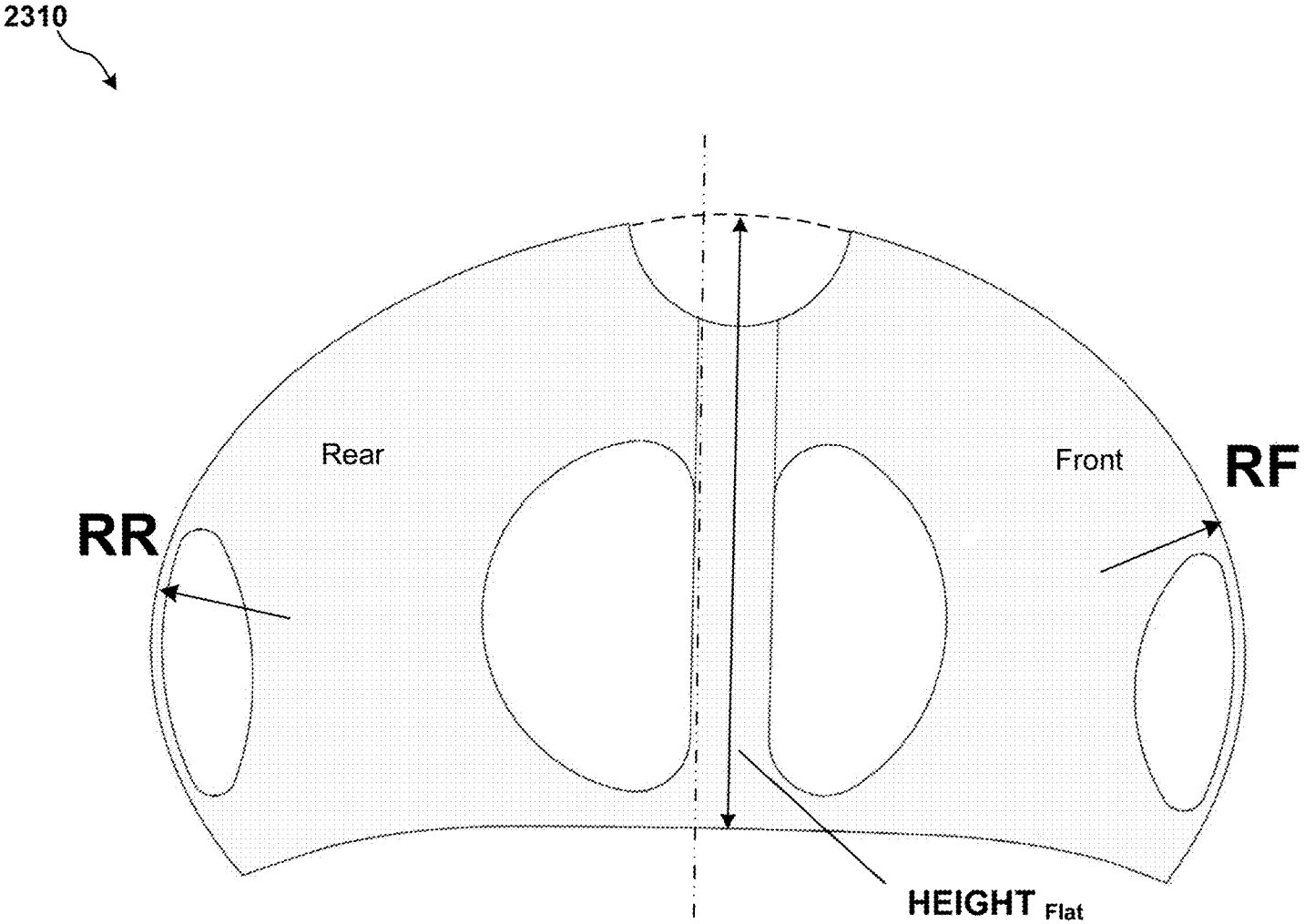
FIG. 38 shows a schematic representation of a flat material sheet cut pattern for the pair of flexible sheets of the asymmetrical ovoid-shaped enclosure of FIG. 37 depicted with windows.

Such an arrangement for enclosure 2310 can provide significant movement freedoms immediately in front of the user including increased forward space, height gap and width in front of the user, which can provide particular benefits for freedom of movement during a range of walking, running and related ambulatory movements. Further, such an arrangement can further extend the enclosure length and space rearward of the user for permitting even greater leg kick movements for running exercises and the like. Customized asymmetrical features of the enclosure arrangement 2310 can be used as a tool for providing desired enclosure features according to intended exercises, user preferences and the like, as well as for fine tuning applications of forces and related balanced ratios, such as via taper features that can reduce volume and related force applications along less significant portions of the enclosure. For instance, as can be seen in FIG. 38 along with FIGS. 39 and 40, the arrangement of enclosure 2310 has been designed to taper down height wise and width or depth wise as the enclosure extends rearward from the seal frame and user. Thus, extended leg kick space can be provided to a user and/or for exercises, such for running, in which extended length for leg kick space can be strongly desired and used along with running exercise, while height and width reductions along the extended rear region can have minimal impact on the enclosure and usage.

Example asymmetrical enclosure 2310, as well as other optional enclosure arrangements and customizations, can be fine-tuned according to desired or beneficial features for an enclosure and as appropriate for ensuring applied forces are appropriately balanced, supported by corresponding structure such as a support platform, and kept to a minimum. As noted along with FIG. 40, the arrangement of enclosure 2310 as provided via an asymmetrical ovoid shape can maintain inflated Height to flexible sheet Height ratios at about 80%, which corresponds with the ratio of circular enclosure 2110 as discussed above. Further, the arrangement of enclosure 2310 can include an Inflated Width to uninflated Height ratio of about 83% based on the maximum width or depth of the inflated enclosure, which suggests an increase for the enclosure width for enclosure 2310.

In other words, the width ratio can be misleading if considered alone in view of the ratio being based on the greatest width when inflated, which for enclosure 2310 is specifically arranged to have a maximum value at the front portion proximate the user while significantly tapering down thereafter as the enclosure extend toward the rear end according to the asymmetric ovoid arrangement. Further, the Inflated Width to Uninflated Height ratio can act as a guide for assessing applied forces of similar enclosure arrangements based on cross-sectional areas, for which max Height and max Width are quick indicators for such an assessment, as well as the impact of fine-tune enclosure modifications on significant characteristics of the same including height and width of the enclosure. Nonetheless, an effective width of enclosure 2310 can be provided for an asymmetric enclosure arrangement, such that the ratios correspond with the same or similar ratio of circular enclosure 2110 and further matches the Inflated Height to Uninflated Height ratio of about 80% for enclosure 2310 thereby indicating balanced forces are being applied thereto.

Optional Enclosure Arrangements

Referring now to FIGS. 42 to 46, optional enclosure arrangements 4810, 4910, 5010, 5210 and 5310 are generally shown along with describing optional factors, parameters and considerations for corresponding enclosure designs, as well as a top view of an example platform showing a base attachment region for the example optional enclosures. The enclosures and platform generally include aspects, features and preferences described herein and along with related applications except as noted. Accordingly, like numbers refer to like features.

Figure 42:
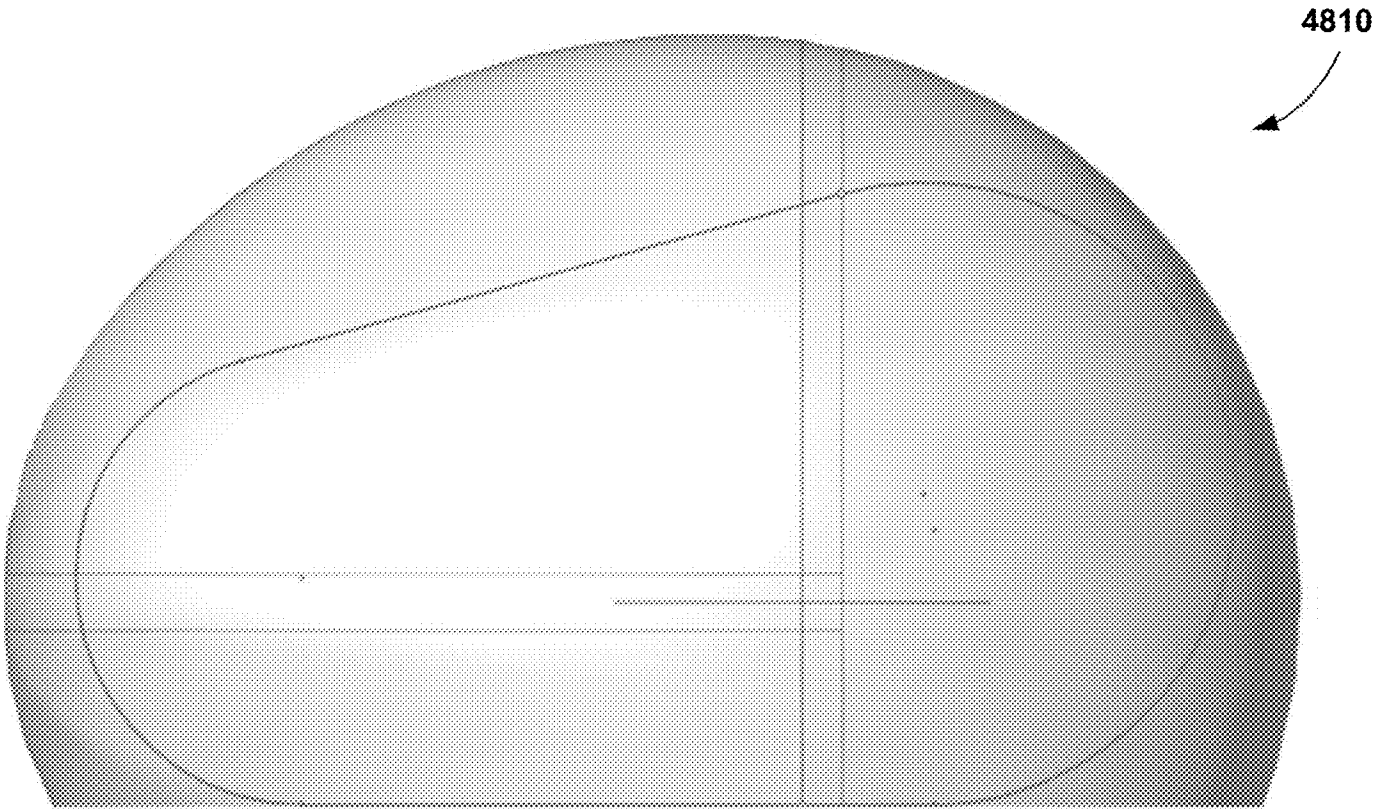
FIGS. 42 to 43B and FIGS. 45 and 46 are schematic side view representations of optional enclosure arrangements.
Figure 43B:
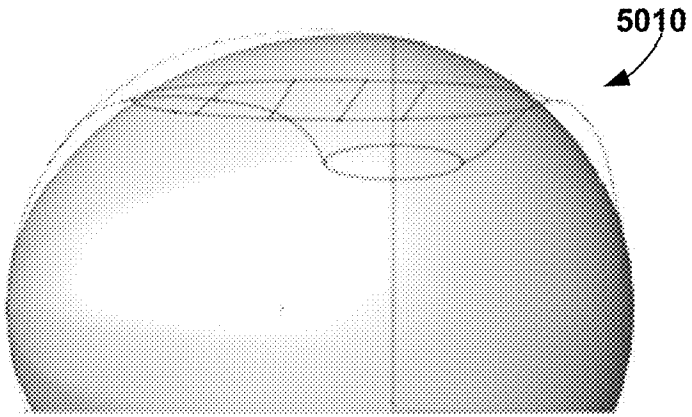
Figure 43A:
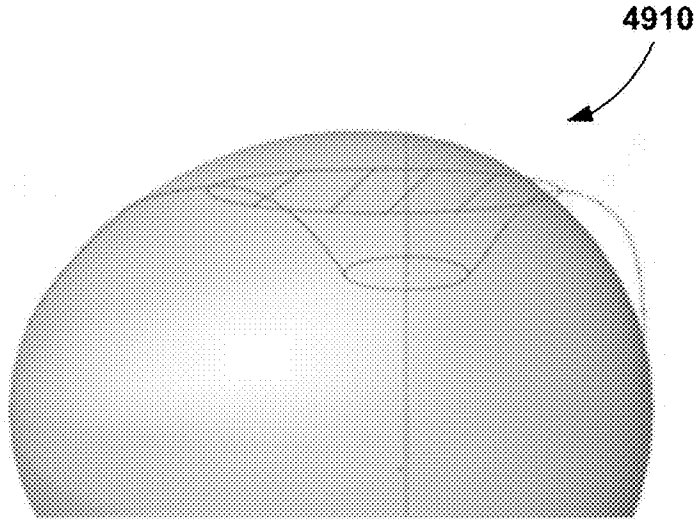
Figure 44:
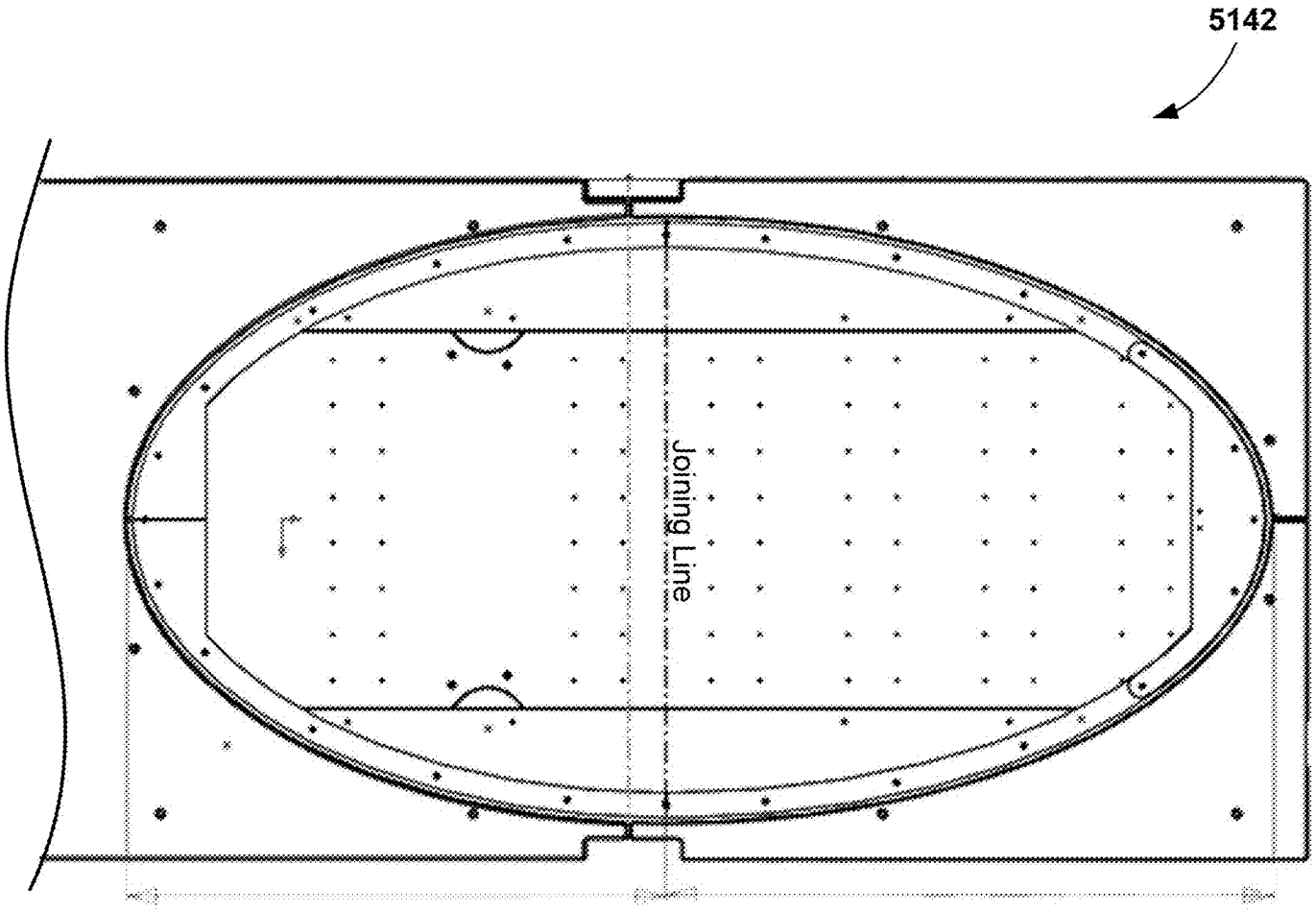
FIG. 44 is a top view of a portion of another platform according to aspect and features described herein.

Referring now to FIG. 42, the locomotion pattern of leg and volume requirements of the motion of the knee in the front and the foot in the rear matches the general shape and tapering of the volume of the chamber volume in the sloping downward as you move from the front to the rear as represented by the tapered ellipsoidal loop shown therein. By minimizing the volume of the enclosure for the required size of user and activity in enclosure 4810, which can be an asymmetric ellipsoidal egg-shaped enclosure, this will also minimize the vertical restraining loads that are imparted on the machine when used at lower than maximum height conditions.

Referring now to FIGS. 43 to 47, the cross sectional area being restrained by the vertical columns for an egg shaped enclosure 4910 is shown as compared to an ellipsoidal enclosure 5010, in which one can easily see how the area for the egg-shaped bag 4910 can be smaller, and therefore, because Force=Pressure×Area, or P×A=F, the vertical force can be smaller. The figure at the right for enclosure 5010 vs. enclosure 4910 shows an outline of an ellipsoidal bag, one that does not taperdown in the rear, and how it can shift the apex of a restrained bag towards the rear which can increase the cross sectional area that is being restrained by the vertical lifts, and thus increase the force on being restrained.

The joining line between the front geometry and the rear geometry on each of the enclosures 4910 and 5010 can therefore can define a joining line on the base opening in similar fashion by shifting the ratio of the base opening where the enclosure connects between fore and aft distances from the joining line in favor of a longer aft distance. An example of such a ratio can be for example a ratio of 1.12 to 1 in favor of a longer back to accommodate leg kick. Other ratios can be appropriate between about 1 to 1 and 1 to 1.35 in favor of rear distance from front distance. Such joining line options are depicted with respect to the platform 5142 shown in FIG. 44.

The joining line location can also define an approximate crest of the inflated shape approximately tangent to the horizon plane. As it can be beneficial to position the opening for the user with a slightly downward slope to bias their trunk in a forward lean, the user opening, or "top port" may in some cases be oriented toward the front of the enclosure from this joining line by between, for example, 1 and 8 inches in some cases, and between 2-6 inches in other cases.

Figure 46:
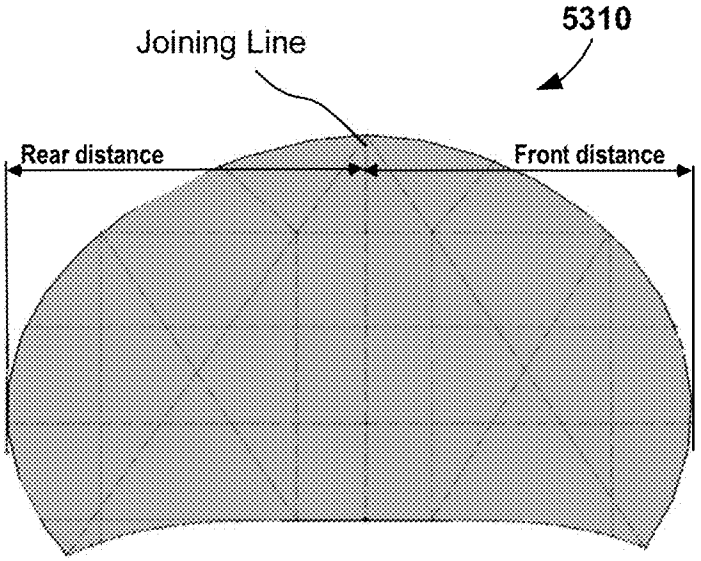
Figure 45:
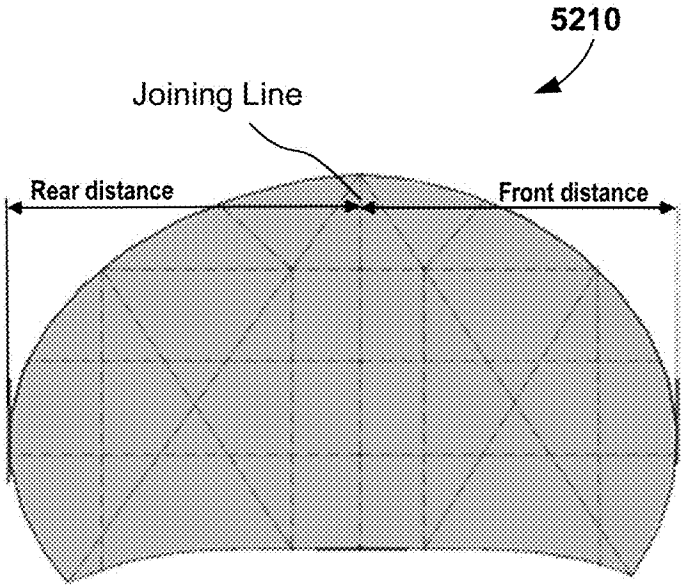

As the rear length of the enclosure is related to the leg length of the user, it may be useful to maintain a relationship between the maximum inflated height of the chamber and the maximum rear volume of the chamber. In some cases, this ratio may be determined by the cut pattern of a two panel bag having a ratio of approximately 1:1 or even having the maximum height of the cut pattern be slightly longer than the rear distance of the cut pattern up to a ratio of 1.35:1. The dimensions as related to the cut pattern for pattern height and maximum rear length for one example are shown in FIGS. 45 and 46, in which FIG. 45 depicts a cut pattern for a symmetric ellipsoid that can correspond with enclosure 5010 and FIG. 46 depicts a cut pattern for an asymmetric ellipsoid, or egg-like shape, that can correspond with enclosure 4910. It shall be noted that generally the faster the intended speed of running during use, the more this ratio may approach 1:1. Barring horizontal translation allowed by the user seal towards the rear of the enclosure, the ratio generally need not go less than 1:1.

Similarly, the ratio of back to front dimensions from the joining line of the enclosure may be more than one to one as shown below which illustrates a ratio of the cut pattern of 1.1:1. This ratio can be within a range of approximately 1:1 up to a range of approximately 1.35:1 in order to allow sufficient clearance in the front and rear for different speeds and types of gait.

Notably, inflatable enclosure 910 as shown in FIG. 30 includes multiple translucent or transparent sub-panels integrated into a pair of opposing flexible sheets that form the inflatable enclosure. The transparent or translucent sub-panels are formed as integrated portions of each sheet, and when in the inflated condition, transfer stresses and loads as integrated surface portions of the thin-shell inflated structure of inflatable enclosure 910. As such, inflatable enclosure 910 can be formed from various arrangements of sub-panels configured as integrated components of the corresponding pair of sheets, including sub-panels allowing viewability within the enclosure during use.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

Although various embodiments have been described as having particular features and/or combinations of components, other embodiments are possible having a combination of any features and/or components from any of embodiments as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

What is claimed is:

1. A differential air pressure (DAP) exercise system comprising an inflatable enclosure having a base portion secured to a DAP platform and a collapsible chamber connected to the base portion, the collapsible chamber comprising:

a pair of opposing substantially inelastic flexible sheets, each sheet having a base region attached to the inflatable enclosure base portion and a perimeter portion extending upward from the base region, each base region attached to the inflatable enclosure base portion at an opposite lateral side of the DAP platform from each other, each perimeter portion defining a chamber profile shape corresponding with a lateral profile of the chamber in an inflated, uncollapsed state, each perimeter portion comprising a top region, a front region, and a rear region; and a seam securely attaching the pair of flexible sheets to each other along the corresponding perimeter portions at the corresponding top, front and rear regions;

wherein, in the inflated state:

inner regions of each of the flexible sheets expand apart under pressure and define an enclosure inner space therebetween;

the flexible sheets each transmit outboard forces from the pressure to the seam, the outboard forces applied at the seam from opposite transverse directions in a counterbalanced arrangement; and application of the outboard forces through each sheet to the seam define a curved, low hoop stress edge portion along the enclosure at the corresponding top, front and rear regions when inflated.

2. The DAP exercise system of claim 1, further comprising:

a low hoop stress zone formed along a top edge portion of the enclosure, the low hoop stress zone comprising a series of spaced apart transverse wrinkles in the enclosure skin and a plurality of unwrinkled enclosure edge portions extending between adjacent wrinkles, each transverse wrinkle corresponding with zero or negative hoop stress extending across the edge portion, and each unwrinkled enclosure edge portion corresponding with low hoop stresses extending across the edge portion.

3. The DAP exercise system of claim 1, the collapsible chamber further comprising:

a notch defined in each flexible sheet along a middle section of the top region, wherein the corresponding notches are excluded from attachment to each other and to the seam along a perimeter region, the pair of corresponding notches defining a top opening through the enclosure top for user access into and through the enclosure inner space;

a user seal interface secured at a first end to a perimeter portion of the top opening, an opposite second end of the user seal interface configured to form an airtight attachment with a pelvic harness of a user; and a seal frame extending about the perimeter of the top opening and attached to each of the pair of sheets proximate the top opening;

wherein the seal frame receives and transmits across the top opening outboard forces applied by each of the flexible sheets toward the top opening.

4. The DAP exercise system of claim 3, wherein:

the seal frame comprises a rigid closed loop having a pre-determined shape;

the pre-determined shape is formed according to an inflated shape at the middle section of the top region for a location of the top opening including an inflated shape across low hoop stress edge portions corresponding with the top opening;

the rigid closed loop extends around a perimeter of the top opening and is attached to the enclosure at a plurality of locations proximate the top opening; and the rigid closed loop is configured to maintain a contoured perimeter corresponding with the inflated shape for the location of the top opening.

5. The DAP exercise system of claim 4, wherein:

the top opening is defined through the enclosure top along a low hoop stress edge portion;

the seal frame is disposed about the top opening and attached to the pair of sheets along the low hoop stress edge portion, the seal frame having a contoured saddle-like shape for matching the low hoop stress edge portion shape; and the seal frame is coupled to the pair of sheets and supported at the enclosure top about the top opening in a floating arrangement with the enclosure;

wherein the seal frame and the top opening allow freedom of movement for the user in combination with flexibility provided via the low hoop stress edge portions.

6. The DAP exercise system of claim 5, wherein:

at least one pair of transverse wrinkles and at least one unwrinkled enclosure edge portion are disposed along the enclosure top adjacent to the seal frame in each of a forward position in front of the seal frame and a rearward position behind the seal frame; and the seal frame and the top opening provide the user freedom of movement in forward and rearward directions along with the low hoop stress edge portions.

7. The DAP exercise system of claim 5, wherein:

at least one pair of transverse wrinkles and at least one unwrinkled enclosure edge portion are disposed along the enclosure top adjacent to the seal frame in a position longitudinally in front of and behind the seal frame; and the seal frame is configured to tilt frontward and rearward freely within the low stress zone.

8. The DAP exercise system of claim 5, wherein:

a forward low hoop stress edge portion of the enclosure is defined along portions of the front central regions of the pair of sheets; and a rearward low hoop stress edge portion of the enclosure is defined along portions of the rear central regions of the pair of sheets;

wherein:

the forward, rearward, and top low hoop stress edge portions cooperate to provide enhanced freedoms of movement for the user and enable an expanded floating arrangement for the seal frame.

9. The DAP exercise system of claim 1, further comprising an exercise device for a user defining an access region above the exercise device, wherein:

the DAP platform provides a vertical path to the access region;

the collapsible chamber extends vertically from the base portion secured to the DAP platform in the inflated condition;

the pair of opposing substantially inelastic flexible sheets are spaced apart in the inflated condition and form an elongate disc-shaped enclosure;

the base portion defines a base opening into an inner cavity of the collapsible chamber establishing a pathway between the inner cavity and the access region; and a top opening is defined through the pair of opposing substantially inelastic flexible sheets to the inner cavity at a top portion of the collapsible chamber having an attached seal frame retaining the sheets connections at portions of their perimeters and at each side of the top opening, the top opening configured to form a sealed connection with the user traversing the top; opening; and the base opening forms an enclosure support shape having a perimeter length, a maximum base length, and a maximum base depth for retaining the vertical orientation of the enclosure in the inflated condition along with transferring lift force from the base support, through the enclosure and a user interface, to the user while accessing the exercise device for moving within a range of motion through the inflatable enclosure.

10. The DAP exercise system of claim 9, wherein:

the DAP platform is disposed about the exercise device and includes an enclosure support defining an access opening above the access region, the enclosure support retaining the base opening above the access region for maintaining a pathway between the inner cavity and the access region through the access opening.

11. The DAP exercise system of claim 10, wherein the base opening and the access opening each define a cross-sectional shape having a cross-sectional area less than a cross-sectional area of the access region.

12. The DAP exercise system of claim 9, wherein:

the exercise device is a treadmill having a movable track and defining a running surface of the track;

the track having a track length and a track width of the running surface of the track; and the user access to the exercise device for the range of motion through the enclosure includes user access to the track length and the track width of the running surface; and the base opening covering a portion of the running surface.

13. The DAP exercise system of claim 9, wherein:

the base opening has a substantially elliptical shape; and a cross-sectional area of the base opening is larger than a cross-sectional area of the top opening.

14. The DAP exercise system of claim 9, the exercise device further comprising an outer perimeter, wherein the enclosure remains within the boundary of the outer perimeter when inflated.

* * * * *